US010323496B2

(12) United States Patent
Abbassian et al.

(10) Patent No.: US 10,323,496 B2
(45) Date of Patent: Jun. 18, 2019

(54) SYSTEM AND CONSOLE FOR MONITORING AND MANAGING CASING RUNNING OPERATIONS AT A WELL SITE

(71) Applicants: Fereidoun Abbassian, Houston, TX (US); Per Arild Andresen, Kristiansand (NO); Stephen Tean Edwards, Hockley, TX (US); Mark Adrian Honey, Milltimber (GB); Thomas Hestenes Jakobsen, Homborsund (NO); Nigel Charles Last, Weybridge (GB); Colin James Mason, Sunbury-on-Thames (GB); Trond Waage, Kristiansand (NO); Rune Arnt Skarbo, Amstelveen (NL); Sankarrappan Periyasamy, Katy, TX (US); Jan Kare Igland, Lindesnes (NO); Kevin Perry Richardson, Spring, TX (US); Sigurd Tjostheim, Kristiansand (NO)

(72) Inventors: Fereidoun Abbassian, Houston, TX (US); Per Arild Andresen, Kristiansand (NO); Stephen Tean Edwards, Hockley, TX (US); Mark Adrian Honey, Milltimber (GB); Thomas Hestenes Jakobsen, Homborsund (NO); Nigel Charles Last, Weybridge (GB); Colin James Mason, Sunbury-on-Thames (GB); Trond Waage, Kristiansand (NO); Rune Arnt Skarbo, Amstelveen (NL); Sankarrappan Periyasamy, Katy, TX (US); Jan Kare Igland, Lindesnes (NO); Kevin Perry Richardson, Spring, TX (US); Sigurd Tjostheim, Kristiansand (NO)

( * ) Notice: Subject to any disclaimer, the term of this patent is extended or adjusted under 35 U.S.C. 154(b) by 186 days.

(21) Appl. No.: 14/208,796

(22) Filed: Mar. 13, 2014

(65) Prior Publication Data

US 2014/0303894 A1 Oct. 9, 2014

Related U.S. Application Data

(63) Continuation of application No. 14/196,307, filed on Mar. 4, 2014.

(Continued)

(51) Int. Cl.
*E21B 44/00* (2006.01)
*E21B 47/00* (2012.01)

(Continued)

(52) U.S. Cl.
CPC ..... *E21B 44/00* (2013.01); *E21B 47/0005* (2013.01); *E21B 47/10* (2013.01); *E21B 21/08* (2013.01)

(58) Field of Classification Search
CPC ..... E21B 19/00; E21B 44/00
See application file for complete search history.

(56) References Cited

U.S. PATENT DOCUMENTS 3,517,553 A * 6/1970 Crownover, Jr. ..... E21B 21/08 166/66
4,535,851 A 8/1985 Kirkpatrick et al.

(Continued)

FOREIGN PATENT DOCUMENTS

GB 2460556 A 12/2009
WO WO200060780 A1 10/2000

(Continued)

OTHER PUBLICATIONS

Vighetto, R., Naegel, M. and Pradi, E.; Total drills extended-reach record in Tierra del Fuego, May 17, 1999, Oil & Gas Journal, v. 97, i. 20, p. 1-8.*

(Continued)

*Primary Examiner* — D. Andrews
(74) *Attorney, Agent, or Firm* — Wayne Edward Ramage; Baker Donelson

(57) ABSTRACT

A well advisor system and console for monitoring and managing installation of casing and tubular goods in a well. The system may be accessed through one or more workstations, or other computing devices, which may be located at a well site or remotely. The system is in communication with and receives input from various sensors. It collects real-time (Continued)

sensor data sampled during operations at the well site. The system processes the data, and provides nearly instantaneous numerical and visual feedback through a variety of graphical user interfaces ("GUIs"), which are presented in the form of an operation-specific console.

13 Claims, 82 Drawing Sheets

Related U.S. Application Data

(60) Provisional application No. 61/791,299, filed on Mar. 15, 2013, provisional application No. 61/772,470, filed on Mar. 4, 2013.

(51) Int. Cl.
*E21B 47/10* (2012.01)
*E21B 21/08* (2006.01)

(56) References Cited

U.S. PATENT DOCUMENTS

| | | | | |
|---|---|---|---|---|
| 4,571,993 | A * | 2/1986 | St. Onge | E21B 21/08 166/250.14 |
| 4,675,147 | A * | 6/1987 | Schaefer | G21D 3/04 345/440 |
| 5,589,825 | A | 12/1996 | Pomerleau | |
| 5,624,182 | A | 4/1997 | Dearing, Sr. et al. | |
| 6,152,246 | A | 11/2000 | King et al. | |
| 6,233,498 | B1 | 5/2001 | King et al. | |
| 6,282,452 | B1 | 8/2001 | DeGuzman et al. | |
| 6,484,816 | B1 | 11/2002 | Koederitz | |
| 6,662,110 | B1 * | 12/2003 | Bargach | E21B 44/00 175/45 |
| 6,668,943 | B1 | 12/2003 | Maus et al. | |
| 7,706,980 | B2 | 4/2010 | Winters et al. | |
| 8,121,971 | B2 | 2/2012 | Edwards et al. | |
| 9,207,143 | B2 | 12/2015 | Franklin et al. | |
| 2003/0220742 | A1 | 11/2003 | Niedermayr et al. | |
| 2004/0124009 | A1 | 7/2004 | Hoteit | |
| 2005/0279532 | A1 | 12/2005 | Ballantyne et al. | |
| 2007/0056746 | A1 | 3/2007 | Newman | |
| 2007/0151762 | A1 | 7/2007 | Reitsma | |
| 2008/0105424 | A1 | 5/2008 | Remmert et al. | |
| 2008/0173480 | A1 | 7/2008 | Annaiyappa et al. | |
| 2008/0185143 | A1 | 8/2008 | Winters et al. | |
| 2009/0090555 | A1 | 4/2009 | Boone et al. | |
| 2009/0132458 | A1 | 5/2009 | Edwards et al. | |
| 2011/0025525 | A1 | 2/2011 | Akimov et al. | |
| 2011/0192598 | A1 | 8/2011 | Roddy et al. | |
| 2012/0123822 | A1 | 5/2012 | Hnatio | |
| 2012/0197527 | A1 | 8/2012 | McKay et al. | |
| 2012/0205103 | A1 | 8/2012 | Ravi et al. | |
| 2012/0272174 | A1 | 10/2012 | Vogel et al. | |
| 2012/0274664 | A1 | 11/2012 | Fagnou | |
| 2013/0112416 | A1 | 5/2013 | Clemens et al. | |
| 2013/0135114 | A1 | 5/2013 | Ringer et al. | |
| 2013/0144531 | A1 * | 6/2013 | Johnston | E21B 44/00 702/9 |
| 2013/0311093 | A1 | 11/2013 | Winters et al. | |
| 2014/0116776 | A1 | 5/2014 | Marx et al. | |
| 2014/0124218 | A1 | 5/2014 | Pilgrim | |

FOREIGN PATENT DOCUMENTS

| | | | |
|---|---|---|---|
| WO | WO2003100537 | A1 | 12/2003 |
| WO | WO2005018308 | A1 | 2/2005 |
| WO | WO2013142950 | A1 | 10/2013 |

OTHER PUBLICATIONS

PCT International Search Report and Written Opinion, PCT/US14/020293, Kongsberg OIl and Gas AS, filed Mar. 4, 2014.
PCT International Search Report and Written Opinion, PCT/US14/026082, Kongsberg OIl and Gas AS, filed Mar. 13, 2014.
PCT International Search Report and Written Opinion, PCT/US14/026112, Kongsberg OIl and Gas AS, filed Mar. 13, 2014.
PCT International Search Report and Written Opinion, PCT/US14/026128, Kongsberg OIl and Gas AS, filed Mar. 13, 2014.
PCT International Search Report and Written Opinion, PCT/US14/026155, Kongsberg OIl and Gas AS, filed Mar. 13, 2014.
PCT International Search Report and Written Opinion, PCT/US14/044965, Kongsberg OIl and Gas AS, filed Jun. 30, 2014.
PCT International Search Report and Written Opinion, PCT/US14/044967, Kongsberg OIl and Gas AS, filed Jun. 30, 2014.
PCT International Search Report and Written Opinion, PCT/US15/038793, Kongsberg OIl and Gas AS, filed Jul. 1, 2015.
PCT International Search Report and Written Opinion, PCT/US15/038805, Kongsberg OIl and Gas AS, filed Jul. 1, 2015.
PCT International Search Report and Written Opinion, PCT/US15/038816, Kongsberg OIl and Gas AS, filed Jul. 1, 2015.
PCT International Search Report and Written Opinion, PCT/US15/038832, Kongsberg OIl and Gas AS, filed Jul. 1, 2015.
Vighetto, et al., "Total drills extended-reach record in Tierra del Fuego," Oil & Gas Journal, vol. 97, issue 20 (May 17, 1999).

* cited by examiner (from Johnston, US App. 13/312,646)

(from Johnston, US App. 13/312,646)

| | |
|---|---|
| TCRc Hookload Signature V1 | Description: TCRc Hookload Signature Smart Agent |
| Agent Type | TrippingCasingRunning Smart Agent HookloadSignatureAgent |
| Well/Wellbore | E15 Test Group/E15_Source Wellbore |

Parameters

| Key | Data Type | Value |
|---|---|---|
| AgentUtcStart | string | 10/11/14 00:00:00 |
| AgentUtcStop | string | |
| RushOutputLogs | bool | |
| TravellingAssemblyWeight | string | |
| Enable Tracing | bool | True |

Tables

| Table Key | Key | Value |
|---|---|---|

Inputs

| Key | Mnemonic | Log Name | Index Type |
|---|---|---|---|
| HookloadSignatureInput | Bit_Depth | EA_D13_TestData | Time |
| HookloadSignatureInput | HK_Hght | EA_D13_TestData | Time |
| HookloadSignatureInput | WHO_Raw | EA_D13_TestData | Time |

Outputs

| Key | Mnemonic | Log Name | Index Type | Index Curve | Index Unit | Type Log Data | Axis Count | Mnemonic unit |
|---|---|---|---|---|---|---|---|---|
| HookloadSignature | Start | HookloadSignature | Time | Time | Date Time | Double | 10 | unitless |
| HookloadSignature | Stop | HookloadSignature | Time | Time | Date Time | Double | 0 | unitless |
| HookloadSignature | SequenceNr | HookloadSignature | Time | Time | Date Time | Double | 0 | unitless |
| HookloadSignature | EventType | HookloadSignature | Time | Time | Date Time | Double | 10 | unitless |
| HookloadSignature | EventTimeStamp | HookloadSignature | Time | Time | Date Time | Double | 0 | unitless |

FIGURE 11

| | |
|---|---|
| TCRc Zone V1 | Description: TCRc Zone Smart Agent |
| Agent Type | TrippingCasingRunning Smart Agent ZoneAgent |
| Well/Wellbore | E15 Test Group/E15_Source Wellbore |

Parameters

| Key | Data Type | Value |
|---|---|---|
| TravellingAssemblyWeight | string | 1095/11/14 00:00:00 |
| RigHoistLimitKbs | string | 1000 |
| LowHookloadBest | string | 200 |
| LowHookloadWorst | string | 0 |
| LowHookloadGreenAmber | string | 100 |

Tables

| Table Key | Key | Value |
|---|---|---|

Inputs

| Key | Mnemonic | Log Name | Index Type |
|---|---|---|---|
| ZoneInput | Tw | HookloadTcrcTime | Time |
| ZoneInput | SequenceNr | HookloadTcrcTime | Time |
| ZoneInput | HKSO_MIN | HookloadTcrcTime | Time |
| ZoneInput | HKSO_MAX | HookloadTcrcTime | Time |
| ZoneInput | VSO_AVG | HookloadTcrcTime | Time |

Outputs

| Key | Mnemonic | Log Name | Index Type | Index Curve | Index Unit | Type Log Data | Axis Count | Mnemonic unit |
|---|---|---|---|---|---|---|---|---|
| CasingRunningZone | SequenceNr | CasingRunningZone | Time | Time | Date Time | Double | 0 | unitless |
| CasingRunningZone | LowHookload | CasingRunningZone | Time | Time | Date Time | Double | 0 | % |
| CasingRunningZone | HighHookload | CasingRunningZone | Time | Time | Date Time | Double | 0 | % |
| CasingRunningZone | TripInSpeed | CasingRunningZone | Time | Time | Date Time | Double | 0 | % |
| CasingRunningZone | StaticFriction | CasingRunningZone | Time | Time | Date Time | Double | 0 | % |

FIGURE 12

SYSTEM AND CONSOLE FOR MONITORING AND MANAGING CASING RUNNING OPERATIONS AT A WELL SITE

This application is a continuation of U.S. application Ser. No. 14/196,307, filed Mar. 4, 2014, which claims benefit of and priority to U.S. Provisional Application No. 61/772,470, filed Mar. 4, 2013, No. 61/791,136, filed Mar. 15, 2013, No. 61/791,299, filed Mar. 15, 2013, No. 61/791,536, filed Mar. 15, 2013, and No. 61/790,906, filed Mar. 15, 2013, and is entitled to those filing dates for priority. This application also claims benefit of and priority to U.S. Provisional Application No. 61/791,299, filed Mar. 15, 2013. The specifications, figures and complete disclosures of U.S. Provisional Application Nos. 61/772,470; 61/791,136; 61/791,299; 61/791,536; and 61/790,906 are incorporated herein in their entireties by specific reference for all purposes. This application is the result of activities and work undertaken within the scope of a joint research agreement, dated Apr. 16, 2007, entered into by BP International Limited and its affiliates, including BP Corporation North America, Inc. (collectively referred to as "BP"), and Sense Intellifield AS, a wholly-owned subsidiary of Kongsberg Maritime, whose name was subsequently changed to Kongsberg Intellifield AS as of Apr. 30, 2007, and later to Kongsberg Oil and Gas Technologies AS, for the performance of experimental, developmental, or research work in the field of the present invention.

FIELD OF INVENTION

This invention relates generally to oil and gas well drilling and production, and related operations. More particularly, this invention relates to a computer-implemented system for monitoring and managing well drilling and production operations.

BACKGROUND OF THE INVENTION

It is well-known that the drilling of an oil or gas well, and related operations, is responsible for a significant portion of the costs related to oil and gas exploration and production. In particular, as new wells are being drilled into remote or less-accessible reservoirs, the complexity, time and expense to drill a well have substantially increased.

Accordingly, it is critical that drilling operations be completed safely, accurately, and efficiently. With directional drilling techniques, and the greater depths to which wells are being drilled, many complexities are added to the drilling operation, and the cost and effort required to respond to a problem during drilling are high. This requires a high level of competence from the driller or drilling engineer at the drilling rig (or elsewhere) to safely drill the well as planned.

A "well plan" specifies a number of parameters for drilling a well, and is developed, in part, based on a geological model. A geological model of various subsurface formations is generated by a geologist from a variety of sources, including seismic studies, data from wells drilled in the area, core samples, and the like. A geological model typically includes depths to the various "tops" that define the formations (the term "top" generally refers to the top of a stratigraphic or biostratigraphic boundary of significance, a horizon, a fault, a pore pressure transition zone, change in rock type, or the like. Geological models usually include multiple tops, thereby defining the presence, geometry and composition of subsurface features.

The well plan specifies drilling parameters as the well bore advances through the various subsurface features. Parameters include, but are not limited to, mud weight, drill bit rotational speed, and weight on bit (WOB). The drilling operators rely on the well plan to anticipate tops and changes in subsurface features, account for drilling uncertainties, and adjust drilling parameters accordingly.

In many cases, the initial geological model may be inaccurate. The depth or location of a particular top may be off by a number of feet. Further, since some geological models recite distances based on the distance between two tops, an error in the absolute depth of one top can result in errors in the depths of multiple tops. Thus, a wellbore can advance into a high pressure subsurface formation before anticipated.

Such errors thus affect safety as well as cost and efficiency. It is fundamental in the art to use drilling "mud" circulating through the drill string to remove cuttings, lubricate the drill bit (and perhaps power it), and control the subsurface pressures. The drilling mud returns to the surface, where cuttings are removed, and is then recycled.

In some cases, the penetration of a high pressure formation can cause a sudden pressure increase (or "kick") in the wellbore. If not detected and controlled, a "blowout" can occur, which may result in failure of the well. Blowout preventers ("BOP") are well known in the art, and are used to protect drilling personnel and the well site from the effects of a blowout. A variety of systems and methods for BOP monitoring and testing are known in the art, including "Blowout Preventer Testing System and Method," U.S. Pat. No. 7,706,890, and "Monitoring the Health of Blowout Preventer," US 2012/0197527, both of which are incorporated herein in their entireties by specific reference for all purposes.

Conversely, if the mud weight is too heavy, or the wellbore advances into a particularly fragile or fractured formation, a "lost circulation" condition may result where drilling mud is lost into the formation rather than returning to the surface. This leads not only to the increased cost to replace the expensive drilling mud, but can also result in more serious problems, such as stuck drill pipe, damage to the formation or reservoir, and blowouts.

Similar problems and concerns arise during other well operations, such as running and cementing casing and tubulars in the wellbore, wellbore completions, or subsurface formation characterizations.

Drills strings and drilling operations equipment include a number of sensors and devices to measure, monitor and detect a variety of conditions in the wellbore, including, but not limited to, hole depth, bit depth, mud weight, choke pressure, and the like. This data can be generated in real-time, but can be enormous, and too voluminous for personnel at the drilling site to review and interpret in sufficient detail and time to affect the drilling operation. Some of the monitored data may be transmitted back to an engineer or geologist at a remote site, but the amount of data transmitted may be limited due to bandwidth limitations. Thus, not only is there a delay in processing due to transmission time, the processing and analysis of the data may be inaccurate due to missing or incomplete data. Drilling operations continue, however, even while awaiting the results of analysis (such as an updated geological model).

A real-time drilling monitor (RTDM) workstation is disclosed in "Drilling Rig Advisor Console," U.S. application Ser. No. 13/312,646. The RTDM receives sensor signals from a plurality of sensors and generates single graphical user interface with dynamically generated parameters based on the sensor signals.

Likewise, an intelligent drilling advisor system is disclosed in "Intelligent Drilling Advisor," U.S. Pat. No. 8,121,971, which is incorporated herein by specific reference for all purposes. The intelligent advisor system comprises an information integration environment that accesses and configures software agents that acquire data from sensors at a drilling site, transmit that data to the information integration environment, and drive the drilling state and the drilling recommendations for drilling operations at the drilling site.

SUMMARY OF INVENTION

In various embodiments, the present invention comprises a well advisor system for monitoring and managing well drilling and production operations. The system may be accessed through one or more workstations, or other computing devices. A workstation comprises one or more computers or computing devices, and may be located at a well site or remotely. The system can be implemented on a single computer system, multiple computers, a computer server, a handheld computing device, a tablet computing device, a smart phone, or any other type of computing device.

The system is in communication with and receives input from various sensors. In general, the system collects real-time sensor data sampled during operations at the well site, which may include drilling operations, running casing or tubular goods, completion operations, or the like. The system processes the data, and provides nearly instantaneous numerical and visual feedback through a variety of graphical user interfaces ("GUIs").

The GUIs are populated with dynamically updated information, static information, and risk assessments, although they also may be populated with other types of information. The users of the system thus are able to view and understand a substantial amount of information about the status of the particular well site operation in a single view, with the ability to obtain more detailed information in a series of additional views.

In one embodiment, the system is installed at the well site, and thus reduces the need to transmit date to a remote site for processing. The well site can be an offshore drilling platform or land-based drilling rig. This reduces delays due to transmitting information to a remote site for processing, then transmitting the results of that processing back to the well site. It also reduces potential inaccuracies in the analysis due to the reduction in the data being transmitted. The system thus allows personnel at the well site to monitor the well site operation in real time, and respond to changes or uncertainties encountered during the operation. The response may include comparing the real time data to the current well plan, and modifying the well plan.

In yet another embodiment, the system is installed at a remote site, in addition to the well site. This permits users at the remote site to monitor the well-site operation in a similar manner to a user at the well-site installation.

In some exemplary embodiments, the system is a web-enabled application, and the system software may be accessed over a network connection such as the Internet. A user can access the software via the user's web browser. In some embodiments, the system performs all of the computations and processing described herein and only display data is transmitted to the remote browser or client for rendering screen displays on the remote computer. In another embodiment, the remote browser or software on the remote system performs some of the functionality described herein.

Sensors may be connected directly to the workstation at the well site, or through one or more intermediate devices, such as switches, networks, or the like. Sensors may comprise both surface sensors and downhole sensors. Surface sensors include, but are not limited to, sensors that detect torque, revolutions per minute (RPM), and weight on bit (WOB). Downhole sensors include, but are not limited to, gamma ray, pressure while drilling (PWD), and resistivity sensors. The surface and downhole sensors are sampled by the system during drilling or well site operations to provide information about a number of parameters. Surface-related parameters include, but are not limited to, the following: block position; block height; trip/running speed; bit depth; hole depth; lag depth; gas total; lithography percentage; weight on bit; hook load; choke pressure; stand pipe pressure; surface torque; surface rotary; mud motor speed; flow in; flow out; mud weight; rate of penetration; pump rate; cumulative stroke count; active mud system total; active mud system change; all trip tanks; and mud temperature (in and out). Downhole parameters include, but are not limited to, the following: all FEMWD; bit depth; hole depth; PWD annular pressure; PWD internal pressure; PWD EMW; PWD pumps off (min, max and average); drill string vibration; drilling dynamics; pump rate; pump pressure; slurry density; cumulative volume pumped; leak off test (LOT) data; and formation integrity test (FIT) data. Based on the sensed parameters, the system causes the processors or microprocessor to calculate a variety of other parameters, as described below.

In several embodiments, the system software comprises a database/server, a display or visualization module, one or more smart agents, one or more templates, and one or more "widgets." The database/server aggregates, distributes and manages real-time data being generated on the rig and received through the sensors. The display or visualization module implements a variety of GUI displays, referred to herein as "consoles," for a variety of well site operations. The information shown on a console may comprise raw data and calculated data in real time.

Templates defining a visual layout may be selected or created by a user to display information in some portions of or all of a console. In some embodiments, a template comprises an XML file. A template can be populated with a variety of information, including, but not limited to, raw sensor data, processed sensor data, calculated data values, and other information, graphs, and text. Some information may be static, while other information is dynamically updated in real time during the well site operation. In one embodiment, a template may be built by combining one or more display "widgets" which present data or other information. Smart agents perform calculations based on data generated through or by one or more sensors, and said calculated data can then be displayed by a corresponding display widgets.

In one exemplary embodiment, the system provides the user the option to implement a number of consoles corresponding to particular well site operations. In one embodiment, consoles include, but are not limited to, rig-site fluid management, BOP management, cementing, and casing running. A variety of smart agents and other programs are used by the consoles. Smart agents and other programs may be designed for use by a particular console, or may be used by multiple consoles. A particular installation of the system may comprise a single console, a sub-set of available consoles, or all available consoles.

Agents can be configured, and configuration files created or modified, using the agent properties display. The same properties are used for each agent, whether the agent configuration is created or imported. The specific configuration information (including, but not limited to, parameters, tables, inputs, and outputs) varies depending on the smart agent. Parameters represent the overall configuration of the agent, and include basic settings including, but not limited to, start and stop parameters, tracing, whether data is read to a log, and other basic agent information. Tables comprise information appearing in database tables associated with the agent. Inputs and outputs are the input or output mnemonics that are being tracked or reported on by the agent. For several embodiments, in order for data to be tracked or reported on, each output must have an associated output. This includes, but is not limited to, log and curve information.

In one embodiment, the system comprises a Casing Running Console used to monitor the running and installation of casing and tubular goods in a wellbore. The Casing Running Console may comprise several agents (e.g., Hookload Signature Agent, and Zone Agent), and at least four widgets (e.g., Trip Schedule, Drag Chart, Hookload Signature, and Zone). The smart agents receive and pass information to these programs.

In a further embodiment, the system comprises a Cementing Console used to manage and monitor cement jobs within the wellbore. It may comprise a configuration screen and at least four widgets (e.g., Frequency Analysis, Plan Tracking, Pumping Stage, and 2D Wellbore Schematic), which allow the user to monitor fluid displacement, densities, pressure, and pump plans in real-time, and compare the real-time data to a cementing plan.

In yet another embodiment, the system comprises a Rig Site Fluid Management Console used to monitor real-time data to provide early warnings and intelligence to users during all drilling and well construction activities and operations. More particularly, the console aggregates and presents the data in manner to assist a user to visualize and interpret the data, and identify and predict fluid gains and losses during operations. The Rig Site Fluid Management Console may comprises smart agents and numerous widgets (e.g., 2D Wellbore Schematic, Zone, Gas Monitor, Flow Back, Pressure While Drilling, Fluid Monitoring Configuration, Log Widget Template configurations, Pore Pressure Fracture Gradient Look-Ahead, and Under Reaming).

The Zone Widget used in conjunction with several of the consoles is a performance metric program designed to display the current status of the selected parameters based on pre-established threshold values, which may be user defined. The visual display is the form of a polygon (symmetric or asymmetric) with a number of vertices, with each vertex representing a particular parameter. The vertex may be labeled. A similar number of threshold values are established for each parameter, and the scale is normalized so that the corresponding threshold appears to be the same distance along a line between the center of the polygon and the respective vertex. Examples of parameters that may be displayed include, but are not limited to, High Hookload, Hookload Variation, Low Hookload, Static Friction, TripIn Speed, and TripOut Speed.

In one exemplary embodiment, the visual display of the Zone Widget has three areas, which may be colored or patterned: normal (green); warning (amber); and alert (red). The background area in the polygon is colored or patterned accordingly. The value of a particular parameter in real-time is plotted as a point along its respective line (typically with the base normal value in the center, with warning and alert thresholds proceeding outward), and can be plotted in real time or by using the most recent value for the parameter available. The plotted points of adjacent parameters are connected by a straight line on the display, the total effect comprising a polygon of changing size and shape over time that overlays the background. The user can thereby quickly determine if any parameters are in a warning or alert status, and take appropriate action. Historical data may be stored, so that a user can view the history of the parameters over time by viewing the change in shape and size of the parameter polygon.

BRIEF DESCRIPTION OF THE DRAWINGS

FIG. 11 shows a Hookload Signature agent configuration input screen.

FIG. 12 shows a Zone Signature agent configuration input screen.

DETAILED DESCRIPTION OF EXEMPLARY EMBODIMENTS

Computing Environment Context

Figure 1:
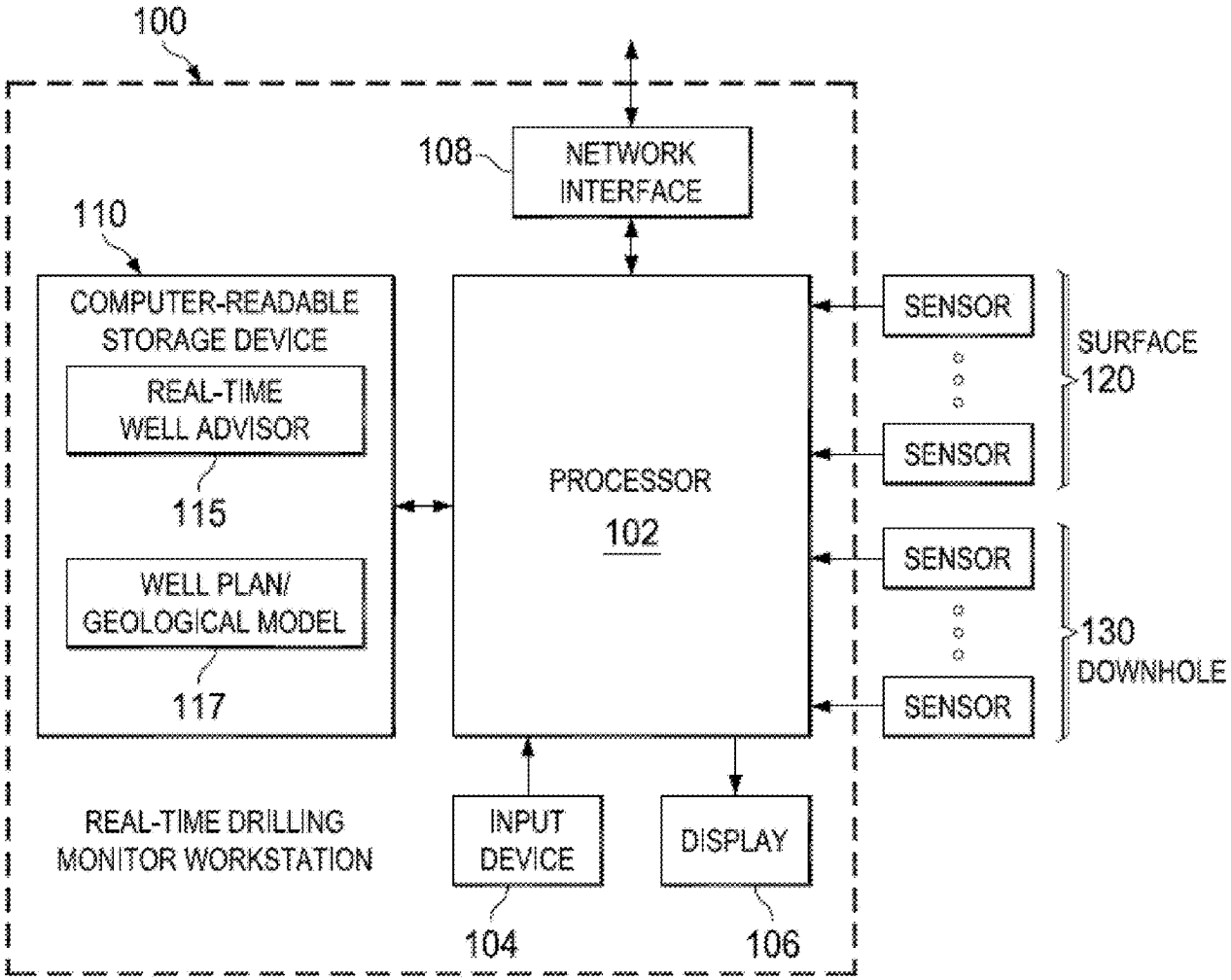
FIG. 1 shows a view of a system in accordance with an embodiment of the present invention.

The following discussion is directed to various exemplary embodiments of the present invention, particularly as implemented into a situationally-aware distributed hardware and software architecture in communication with one or more operating drilling rigs. However, it is contemplated that this invention may provide substantial benefits when implemented in systems according to other architectures, and that some or all of the benefits of this invention may be applicable in other applications. For example, while the embodiments of the invention may be described herein in connection with wells used for oil and gas exploration and production, the invention also is contemplated for use in connection with other wells, including, but not limited to, geothermal wells, disposal wells, injection wells, and many other types of wells. One skilled in the art will understand that the examples disclosed herein have broad application, and that the discussion of any particular embodiment is meant only to be exemplary of that embodiment, and not intended to suggest that the scope of the disclosure, including the claims, is limited to that embodiment.

In order to provide a context for the various aspects of the invention, the following discussion provides a brief, general description of a suitable computing environment in which the various aspects of the present invention may be implemented. A computing system environment is one example of a suitable computing environment, but is not intended to suggest any limitation as to the scope of use or functionality of the invention. A computing environment may contain any one or combination of components discussed below, and may contain additional components, or some of the illustrated components may be absent. Various embodiments of the invention are operational with numerous general purpose or special purpose computing systems, environments or configurations. Examples of computing systems, environments, or configurations that may be suitable for use with various embodiments of the invention include, but are not limited to, personal computers, laptop computers, computer servers, computer notebooks, hand-held devices, microprocessor-based systems, multiprocessor systems, TV set-top boxes and devices, programmable consumer electronics, cell phones, personal digital assistants (PDAs), network PCs, minicomputers, mainframe computers, embedded systems, distributed computing environments, and the like.

Embodiments of the invention may be implemented in the form of computer-executable instructions, such as program code or program modules, being executed by a computer or computing device. Program code or modules may include programs, objections, components, data elements and structures, routines, subroutines, functions and the like. These are used to perform or implement particular tasks or functions. Embodiments of the invention also may be implemented in distributed computing environments. In such environments, tasks are performed by remote processing devices linked via a communications network or other data transmission medium, and data and program code or modules may be located in both local and remote computer storage media including memory storage devices.

In one embodiment, a computer system comprises multiple client devices in communication with at least one server device through or over a network. In various embodiments, the network may comprise the Internet, an intranet, Wide Area Network (WAN), or Local Area Network (LAN). It should be noted that many of the methods of the present invention are operable within a single computing device.

A client device may be any type of processor-based platform that is connected to a network and that interacts with one or more application programs. The client devices each comprise a computer-readable medium in the form of volatile and/or nonvolatile memory such as read only memory (ROM) and random access memory (RAM) in communication with a processor. The processor executes computer-executable program instructions stored in memory. Examples of such processors include, but are not limited to, microprocessors, ASICs, and the like.

Client devices may further comprise computer-readable media in communication with the processor, said media storing program code, modules and instructions that, when executed by the processor, cause the processor to execute the program and perform the steps described herein. Computer readable media can be any available media that can be accessed by computer or computing device and includes both volatile and nonvolatile media, and removable and non-removable media. Computer-readable media may further comprise computer storage media and communication media. Computer storage media comprises media for storage of information, such as computer readable instructions, data, data structures, or program code or modules. Examples of computer-readable media include, but are not limited to, any electronic, optical, magnetic, or other storage or transmission device, a floppy disk, hard disk drive, CD-ROM, DVD, magnetic disk, memory chip, ROM, RAM, EEPROM, flash memory or other memory technology, an ASIC, a configured processor, CDROM, DVD or other optical disk storage, magnetic cassettes, magnetic tape, magnetic disk storage or other magnetic storage devices, or any other medium from which a computer processor can read instructions or that can store desired information. Communication media comprises media that may transmit or carry instructions to a computer, including, but not limited to, a router, private or public network, wired network, direct wired connection, wireless network, other wireless media (such as acoustic, RF, infrared, or the like) or other transmission device or channel. This may include computer readable instructions, data structures, program modules or other data in a modulated data signal such as a carrier wave or other transport mechanism. Said transmission may be wired, wireless, or both. Combinations of any of the above should also be included within the scope of computer readable media. The instructions may comprise code from any computer-programming language, including, for example, C, C++, C#, Visual Basic, Java, and the like.

Components of a general purpose client or computing device may further include a system bus that connects various system components, including the memory and processor. A system bus may be any of several types of bus structures, including, but not limited to, a memory bus or memory controller, a peripheral bus, and a local bus using any of a variety of bus architectures. Such architectures include, but are not limited to, Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computing and client devices also may include a basic input/output system (BIOS), which contains the basic routines that help to transfer information between elements within a computer, such as during start-up. BIOS typically is stored in ROM. In contrast, RAM typically contains data or program code or modules that are accessible to or presently being operated on by processor, such as, but not limited to, the operating system, application program, and data.

Client devices also may comprise a variety of other internal or external components, such as a monitor or display, a keyboard, a mouse, a trackball, a pointing device, touch pad, microphone, joystick, satellite dish, scanner, a disk drive, a CD-ROM or DVD drive, or other input or output devices. These and other devices are typically connected to the processor through a user input interface coupled to the system bus, but may be connected by other interface and bus structures, such as a parallel port, serial port, game port or a universal serial bus (USB). A monitor or other type of display device is typically connected to the system bus via a video interface. In addition to the monitor, client devices may also include other peripheral output devices such as speakers and printer, which may be connected through an output peripheral interface.

Client devices may operate on any operating system capable of supporting an application of the type disclosed herein. Client devices also may support a browser or browser-enabled application. Examples of client devices include, but are not limited to, personal computers, laptop computers, personal digital assistants, computer notebooks, hand-held devices, cellular phones, mobile phones, smart phones, pagers, digital tablets, Internet appliances, and other processor-based devices. Users may communicate with each other, and with other systems, networks, and devices, over the network through the respective client devices.

By way of further background, the term "software agent" refers to a computer software program or object that is capable of acting in a somewhat autonomous manner to carry out one or more tasks on behalf of another program or object in the system. Software agents can also have one or more other attributes, including mobility among computers in a network, the ability to cooperate and collaborate with other agents in the system, adaptability, and also specificity of function (e.g., interface agents). Some software agents are sufficiently autonomous as to be able to instantiate themselves when appropriate, and also to terminate themselves upon completion of their task.

The term "expert system" refers to a software system that is designed to emulate a human expert, typically in solving a particular problem or accomplishing a particular task. Conventional expert systems commonly operate by creating a "knowledge base" that formalizes some of the information known by human experts in the applicable field, and by codifying some type of formalism by way the information in the knowledge base applicable to a particular situation can be gathered and actions determined. Some conventional expert systems are also capable of adaptation, or "learning", from one situation to the next. Expert systems are commonly considered to be in the realm of "artificial intelligence."

The term "knowledge base" refers to a specialized database for the computerized collection, organization, and retrieval of knowledge, for example in connection with an expert system. The term "rules engine" refers to a software component that executes one or more rules in a runtime environment providing among other functions, the ability to: register, define, classify, and manage all the rules, verify consistency of rules definitions, define the relationships among different rules, and relate some of these rules to other software components that are affected or need to enforce one or more of the rules. Conventional approaches to the "reasoning" applied by such a rules engine in performing these functions involve the use of inference rules, by way of which logical consequences can be inferred from a set of asserted facts or axioms. These inference rules are commonly specified by means of an ontology language, and often a description language. Many reasoners use first-order predicate logic to perform reasoning; inference commonly proceeds by forward chaining and backward chaining.

The present invention may be implemented into an expert computer hardware and software system, implemented and operating on multiple levels, to derive and apply specific tools at a drilling site from a common knowledge base, including, but not limited to, information from multiple drilling sites, production fields, drilling equipment, and drilling environments. At a highest level, a knowledge base is developed from attributes and measurements of prior and current wells, information regarding the subsurface of the production fields into which prior and current wells have been or are being drilled, lithology models for the subsurface at or near the drilling site, and the like. In this highest level, an inference engine drives formulations (in the form of rules, heuristics, calibrations, or a combination thereof) based on the knowledge base and on current data. An interface to human expert drilling administrators is provided for verification of these rules and heuristics. These formulations pertain to drilling states and drilling operations, as well as recommendations for the driller, and also include a trendologist function that manages incoming data based on the quality of that data, such management including the amount of processing and filtering to be applied to such data, as well as the reliability level of the data and of calculations therefrom.

At another level, an information integration environment is provided that identifies the current drilling sites, and drilling equipment and processes at those current drilling sites. Based upon that identification, and upon data received from the drilling sites, servers access and configure software agents that are sent to a host client system at the drilling site; these software agents operate at the host client system to acquire data from sensors at the drilling site, to transmit that data to the information integration environment, and to derive the drilling state and drilling recommendations for the driller at the drilling site. These software agents include one or more rules, heuristics, or calibrations derived by the inference engine, and called by the information integration environment. In addition, the software agents sent from the information integration environment to the host client system operate to display values, trends, and reliability estimates for various drilling parameters, whether measured or calculated.

The information integration environment is also operative to receive input from the driller via the host client system, and to act as a knowledge base server to forward those inputs and other results to the knowledge base and the inference engine, with verification or input from the drilling administrators as appropriate.

According to another aspect of the invention, the system develops a knowledge base from attributes and measurements of prior and current wells, and from information regarding the subsurface of the production fields into which prior and current wells have been or are being drilled. According to this aspect of the invention, the system self-organizes and validates historic, real time, and/or near real time depth or time based measurement data, including information pertaining to drilling dynamics, earth properties, drilling processes and driller reactions. This drilling knowledge base suggests solutions to problems based on feedback provided by human experts, learns from experience, represents knowledge, instantiates automated reasoning and argumentation for embodying best drilling practices.

According to yet another aspect of the invention, the system includes the capability of virtualizing information from a well being drilled into a collection of metalayers, such metalayers corresponding to a collection of physical information about the layer (material properties, depths at a particular location, and the like) and also information on how to successfully drill through such a layer, such metalayers re-associating as additional knowledge is acquired, to manage real-time feedback values in optimizing the drilling operation, and in optimizing the driller response to dysfunction. Normalization into a continuum, using a system of such metalayers, enables real-time reaction to predicted downhole changes that are identified from sensor readings.

According to another aspect of the invention, the system is capable of carrying out these functions by creating and managing a network of software agents that interact with the drilling environment to collect and organize information for the knowledge base, and to deliver that information to the knowledge base. The software agents in this network are persistent, autonomous, goal-directed, sociable, reactive, non-prescriptive, adaptive, heuristic, distributed, mobile and self-organizing agents for directing the driller toward drilling optimization, for collecting data and information, and for creating dynamic transitional triggers for metalayer instantiation. These software entities interact with their environment through an adaptive rule-base to intelligently collect, deliver, adapt and organize information for the drilling knowledge base. According to this aspect of the invention, the software agents are created, modified and destroyed as needed based on the situation at the drilling rig, within the field, or at any feasible knowledge collection point or time instance within the control scope of any active agent.

According to another aspect of the invention, the software agents in the network of agents are controlled by the system to provide the recommendations to the drillers, using one or more rules, heuristics, and calibrations derived from the knowledge base and current sensor signals from the drilling site, and as such in a situationally aware manner. In this regard, the software agents interact among multiple software servers and hardware states in order to provide recommendations that assist human drillers in the drilling of a borehole into the earth at a safely maximized drilling rate. The software "experts" dispatch agents, initiate transport of remote memory resources, and provide transport of knowledge base components including rules, heuristics, and calibrations according to which a drilling state or drilling recommendation is identified responsive to sensed drilling conditions in combination with a selected parameter that is indicative of a metalayer of the earth, and in combination with selected minimums and maximums of the drilling equipment sensor parameters. The software experts develop rules, heuristics, and calibrations applicable to the drilling site derived from the knowledge base that are transmitted via an agent to a drilling advisor application, located at the drilling site, that is coupled to receive signals from multiple sensors at the drilling site, and also to one or more servers that configure and service multiple software agents.

According to another aspect of the invention, the system is applied to circulation actors to optimize circulation, hydraulics at the drill bit point of contact with the medium being drilled, rationalization of distributed pressure and temperature measurements and to provide recommendations to avoid or recover from loss of circulation events.

In addition, while this invention is described in connection with a multiple level hardware and software architecture system, in combination with drilling equipment and human operators, it is contemplated that several portions and facets of this invention are separately and independently inventive and beneficial, whether implemented in this overall system environment or if implemented on a stand-alone basis or in other system architectures and environments. Those skilled in the art having reference to this specification are thus directed to consider this description in such a light.

Well Advisor System and Consoles

FIG. 1 illustrates a workstation showing a well advisor system 100 in accordance with various exemplary embodiments of the present invention. The workstation comprises one or more computers or computing devices, and may be located at a well site or remotely. The system can be implemented on a single computer system, multiple computers, a computer server, a handheld computing device, a tablet computing device, a smart phone, or any other type of computing device.

The system is in communication with and receives input from various sensors 120, 130. In general, the system collects real-time sensor data sampled during operations at the well site, which may include drilling operations, running casing or tubular goods, completion operations, or the like. The system processes the data, and provides nearly instantaneous numerical and visual feedback through a variety of graphical user interfaces (GUIs).

The GUIs are populated with dynamically updated information, static information, and risk assessments, although they also may be populated with other types of information, as described below. The users of the system thus are able to view and understand a substantial amount of information about the status of the particular well site operation in a single view, with the ability to obtain more detailed information in a series of additional views.

In one embodiment, the system is installed at the well site, and thus reduces the need to transmit date to a remote site for processing. The well site can be an offshore drilling platform or land-based drilling rig. This reduces delays due to transmitting information to a remote site for processing, then transmitting the results of that processing back to the well site. It also reduces potential inaccuracies in the analysis due to the reduction in the data being transmitted. The system thus allows personnel at the well site to monitor the well site operation in real time, and respond to changes or uncertainties encountered during the operation. The response may include comparing the real time data to the current well plan, and modifying the well plan.

In yet another embodiment, the system is installed at a remote site, in addition to the well site. This permits users at the remote site to monitor the well-site operation in a similar manner to a user at the well-site installation.

The architecture of the system workstation shown in FIG. 1 is only one example of multiple possible architectures. In one embodiment, the workstation comprises one or more processors or microprocessors 102 coupled to one or more input devices 104 (e.g., mouse, keyboard, touchscreen, or the like), one or more output devices 106 (e.g., display, printer, or the like), a network interface 108, and one or more non-transitory computer-readable storage devices 110. In some embodiments, the input and output devices may be part of the workstation itself, while in other embodiment such devices may be accessible to the workstation through a network or other connection.

In one exemplary embodiment, the network interface may comprise a wire-based interface (e.g., Ethernet), or a wireless interface (e.g., BlueTooth, wireless broadband, IEEE 802.11x WiFi, or the like), which provides network connectivity to the workstation and system to enable communications across local and/or wide area networks. For example, the workstation can receive portions of or entire well or cementing plans or geological models 117 from a variety of locations.

The storage devices 110 may comprise both non-volatile storage devices (e.g., flash memory, hard disk drive, or the like) and volatile storage devices (e.g., RAM), or combinations thereof. The storage devices store the system software 115 which is executable by the processors or microprocessors to perform some or all of the functions describe below. The storage devices also may be used to store well plans, geological models 117, configuration files and other data.

In some exemplary embodiments, the system is a web-enabled application, and the system software may be accessed over a network connection such as the Internet. A user can access the software via the user's web browser. In some embodiments, the system performs all of the computations and processing described herein and only display data is transmitted to the remote browser or client for rendering screen displays on the remote computer. In other embodiments, the remote browser or software on the remote system performs some of the functionality described herein.

Sensors 120, 130 may be connected directly to the workstation at the well site, or through one or more intermediate devices, such as switches, networks, or the like. Sensors may comprise both surface sensors 120 and downhole sensors 130. Surface sensors include, but are not limited to, sensors that detect torque, revolutions per minute (RPM), and weight on bit (WOB). Downhole sensors include, but are not limited to, gamma ray, pressure while drilling (PWD), and resistivity sensors. The surface and downhole sensors are sampled by the system during drilling or well site operations to provide information about a number of parameters. Surface-related parameters include, but are not limited to, the following: block position; block height; trip/running speed; bit depth; hole depth; lag depth; gas total; lithography percentage; weight on bit; hook load; choke pressure; stand pipe pressure; surface torque; surface rotary; mud motor speed; flow in; flow out; mud weight; rate of penetration; pump rate; cumulative stroke count; active mud system total; active mud system change; all trip tanks; and mud temperature (in and out). Downhole parameters include, but are not limited to, the following: all FEMWD; bit depth; hole depth; PWD annular pressure; PWD internal pressure; PWD EMW; PWD pumps off (min, max and average); drill string vibration; drilling dynamics; pump rate; pump pressure; slurry density; cumulative volume pumped; leak off test (LOT) data; and formation integrity test (FIT) data. Based on the sensed parameters, the system causes the processors or microprocessor to calculate a variety of other parameters, as described below.

Figure 2:
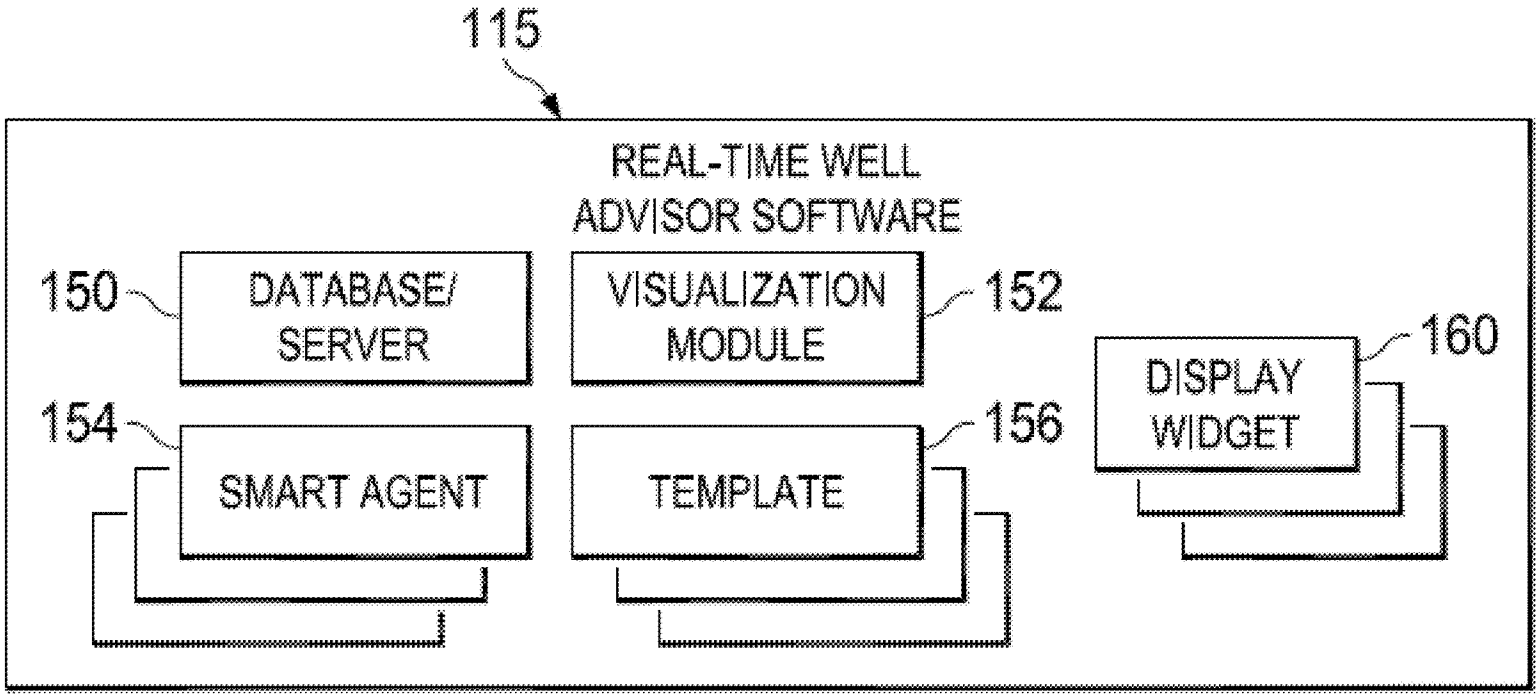
FIG. 2 shows a software architecture in accordance with various embodiments of the present invention.

FIG. 2 provides an example of the system software architecture. The system software comprises a database/server 150, a display or visualization module 152, one or more smart agents 154, one or more templates 156, and one or more "widgets" 160. The database/server 150 aggregates, distributes and manages real-time data being generated on the rig and received through the sensors. The display or visualization module 152 implements a variety of graphical user interface displays, referred to herein as "consoles," for a variety of well site operations. The information shown on a console may comprise raw data and calculated data in real time.

Templates 156 defining a visual layout may be selected or created by a user to display information in some portions of or all of a console. In some embodiments, a template comprises an XML file. A template can be populated with a variety of information, including, but not limited to, raw sensor data, processed sensor data, calculated data values, and other information, graphs, and text. Some information may be static, while other information is dynamically updated in real time during the well site operation. In one embodiment, a template may be built by combining one or more display "widgets" 160 which present data or other information. Smart agents 154 perform calculations based on data generated through or by one or more sensors, and said calculated data can then be displayed by a corresponding display widgets.

In one exemplary embodiment, the system provides the user the option to implement a number of consoles corresponding to particular well site operations. In one embodiment, consoles include, but are not limited to, rig-site fluid management, BOP management, cementing, and casing running. A variety of smart agents and other programs are used by the consoles. Smart agents and other programs may be designed for use by a particular console, or may be used by multiple consoles. A particular installation of the system may comprise a single console, a sub-set of available consoles, or all available consoles.

Figure 3:
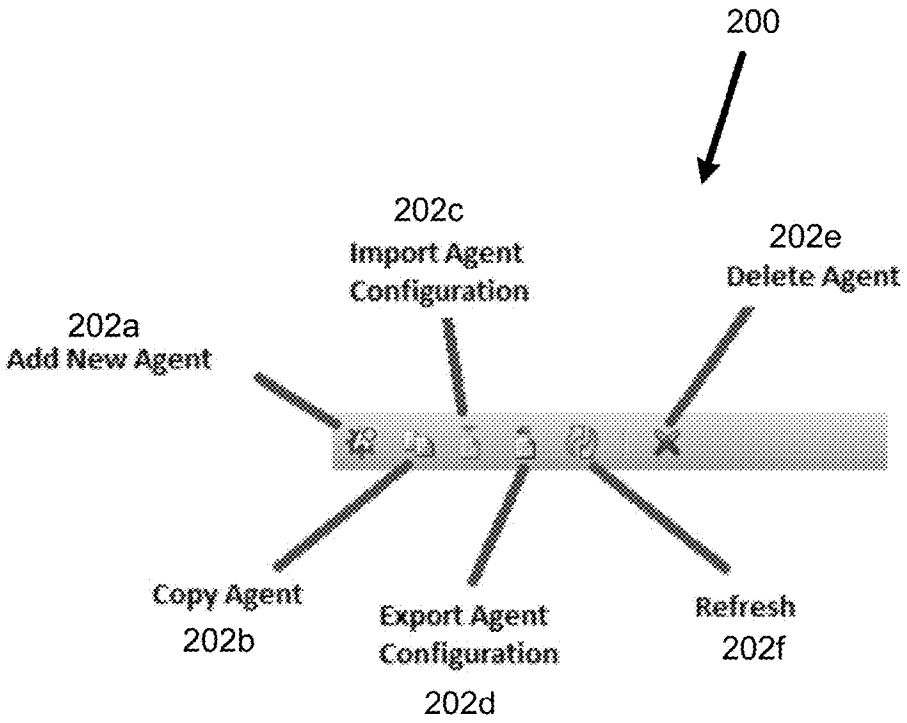
FIG. 3 shows a smart agent management toolbar.
Figure 4:
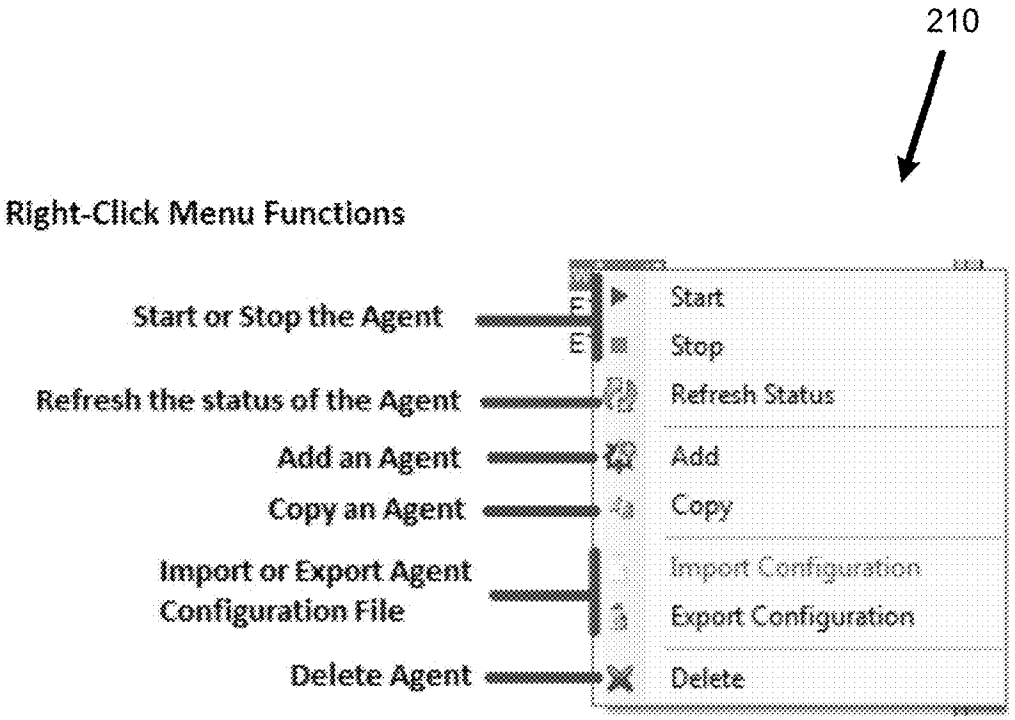
FIG. 4 shows a smart agent management menu.

In various embodiments, smart agents in the system can be managed with a toolbar 200 (as seen in FIG. 3) or by a drop-down menu 210 (as seen in FIG. 4), which may be activated by clicking on a smart agent icon, right-click on a mouse button, or the like. Functions include, but are not limited to, adding a new agent 202*a*, copying an agent configuration 202*b*, importing 202*c* or exporting 202*d* an agent configuration file, deleting an agent 202*e*, refreshing the status of an agent 202*f*, or starting or stopping an agent.

Figure 5:
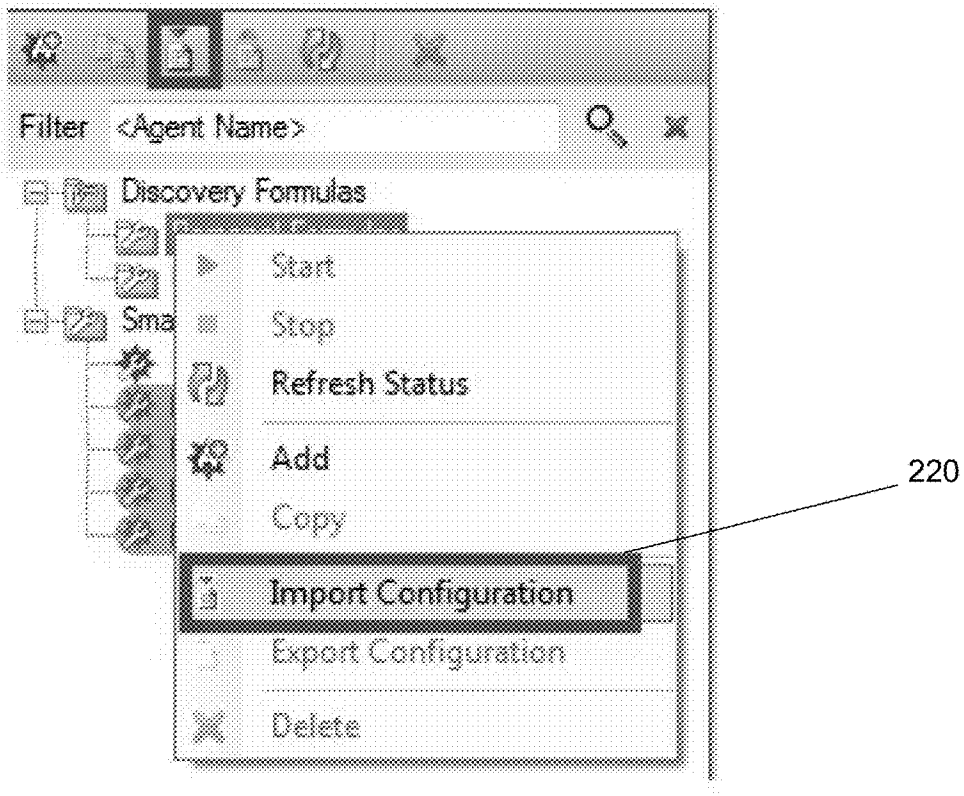
FIG. 5 shows a smart agent configuration file import menu.

For certain smart agents, an agent configuration file must be imported 220 to use the smart agent, as seen in FIG. 5. In one embodiment, configuration files are denominated as *.agent files. Selecting the import option provides the user the option to enter the configuration file name, or browse to a location where the configuration file is stored.

Figure 6:
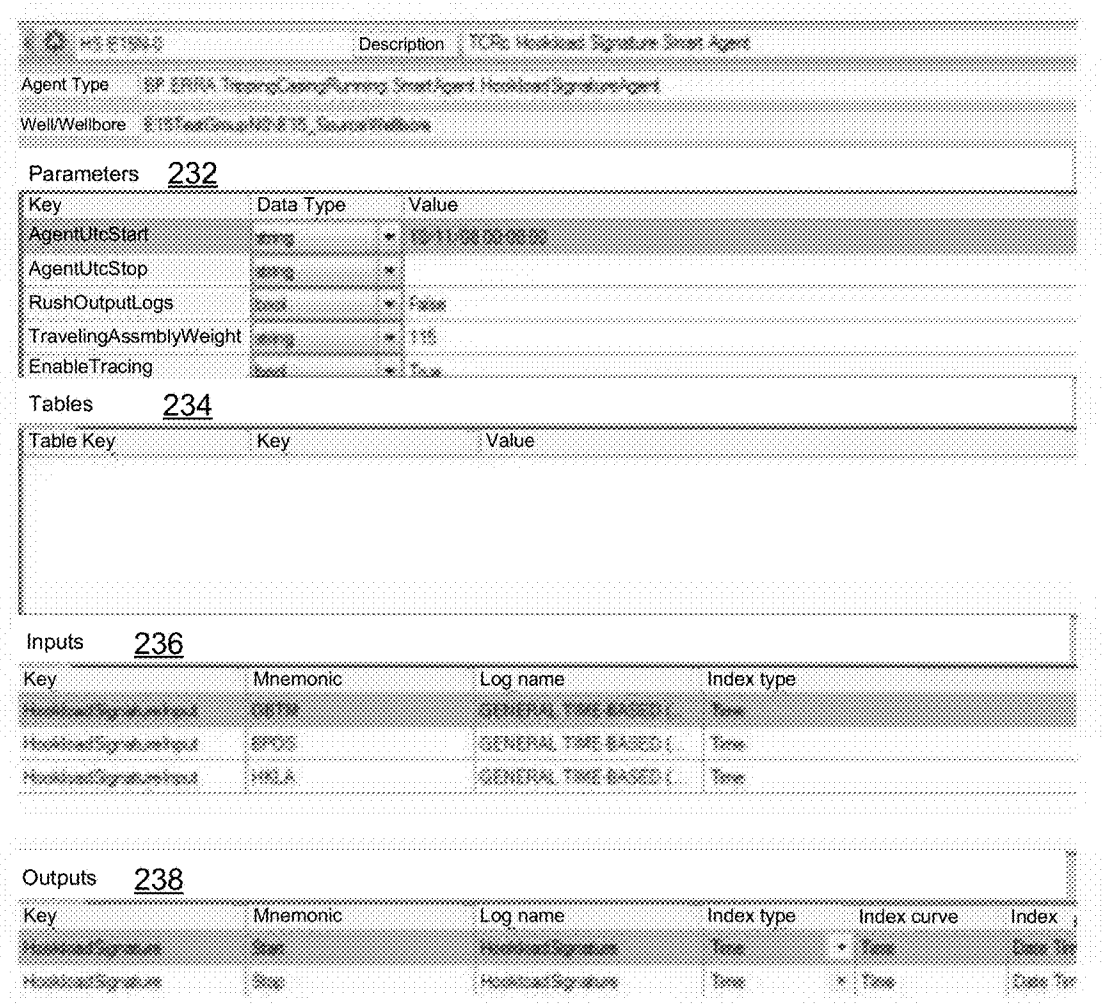
FIG. 6 shows a smart agent configuration display screen.

Agents can be configured, and configuration files created or modified, using the agent properties display, as seen in FIG. 6. The same properties are used for each agent, whether the agent configuration is created or imported. The specific configuration information (including, but not limited to, parameters, tables, inputs, and outputs) varies depending on the smart agent. Parameters 232 represent the overall configuration of the agent, and include basic settings including, but not limited to, start and stop parameters, tracing, whether data is read to a log, and other basic agent information. Tables 234 comprise information appearing in database tables associated with the agent. Inputs 236 and outputs 238 are the input or output mnemonics that are being tracked or reported on by the agent. For several embodiments, in order for data to be tracked or reported on, each output must have an associated output. This includes, but is not limited to, log and curve information.

Figure 7:
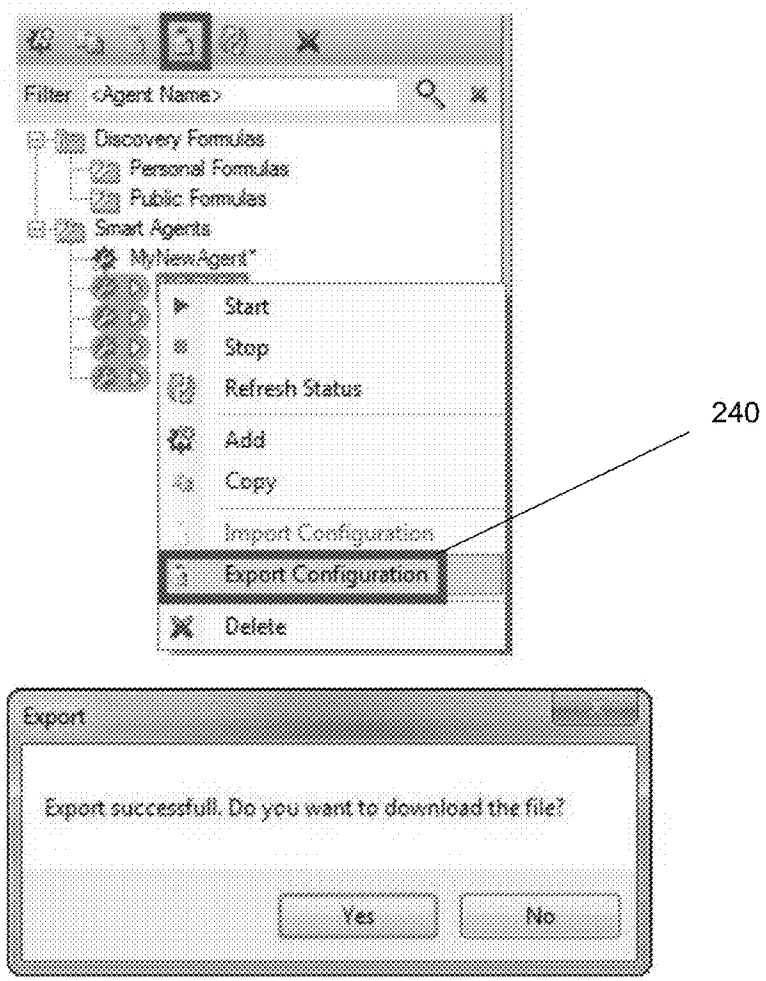
FIG. 7 shows a smart agent configuration file export menu.
Figure 8:
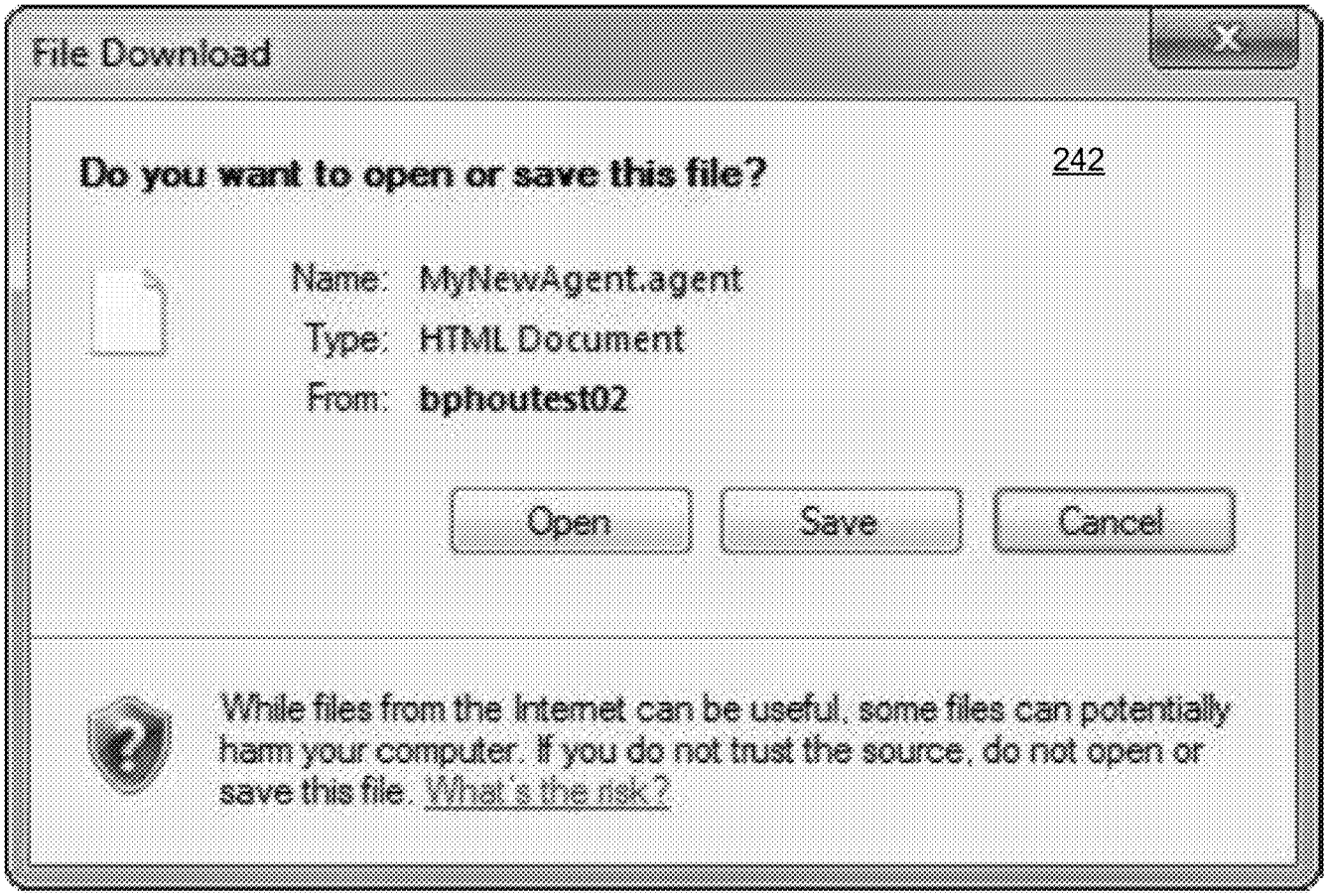
FIG. 8 shows a smart agent configuration file download display screen.

Users can export an agent configuration file for other users to import and use. The export configuration button in the toolbar can be used for a selected agent, or the agent can be right-clicked on and the export configuration option 240 chosen, as shown in FIG. 7. The user confirms 242 the action to download the file to a local hard drive or other file storage location, as seen in FIG. 8. The user may name the file as desired. Once downloaded, the file can be copied, emailed, or otherwise transferred to another user for importation and use.

Figure 9:
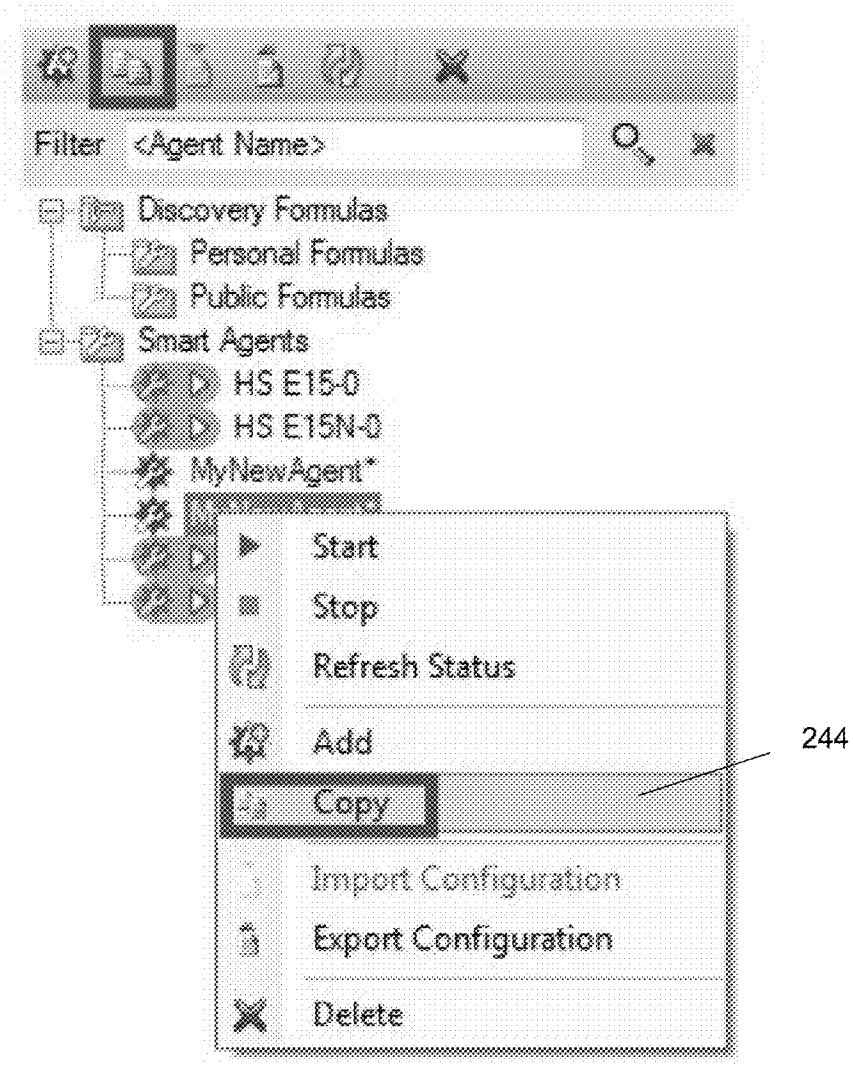
FIG. 9 shows a smart agent configuration file copy menu.

Copying an agent configuration 244, as seen in FIG. 9, allows the user to copy an agent configuration file and rename it. This saves the user from having to perform an initial setup of the agent properties or create a new configuration file multiple times, if the user has agent configurations that are similar. In one embodiment, the user right clicks on the desired agent, selects the copy option, and identifies the wellbore for which the configuration is to be used. The user can name or rename the new agent configuration.

Casing Running Console

Figure 10:
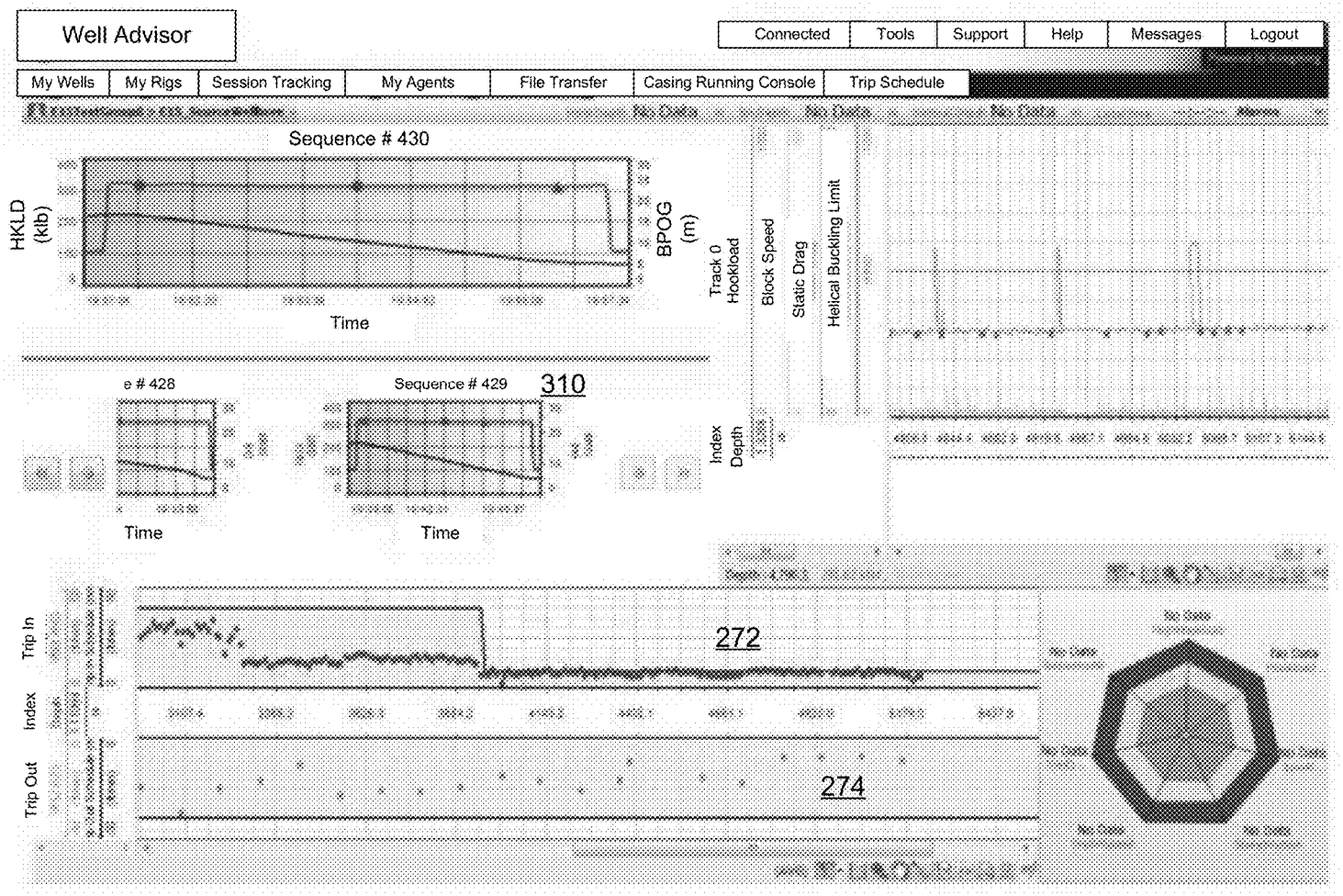
FIG. 10 shows a Casing Running Console display screen.

The GUI display for an embodiment of a Casing Running Console is shown in FIG. 10. The Casing Running Console is used to monitor the running and installation of casing and tubular goods in a wellbore. In the embodiment shown, the Casing Running Console comprises two agents (Hookload Signature Agent, and Zone Agent), and at least four widgets (Trip Schedule, Drag Chart, Hookload Signature, and Zone). The smart agents receive and pass information to these programs.

The Casing Running smart agents must be configured with parameter, table, input and output settings for the desired operation. FIG. 11 shows an example of an input screen for inputting or displaying this configuration information for the Hookload Signature Agent.

The Hookload Signature Agent outputs data to several output logs (e.g., HookloadTcrcTime). The Zone Agent reads information from the output logs and processes it for display using the Zone Widget (described below). FIG. 12 shows an example of an input screen for inputting or displaying this configuration information for the Zone Agent.

Figure 13:
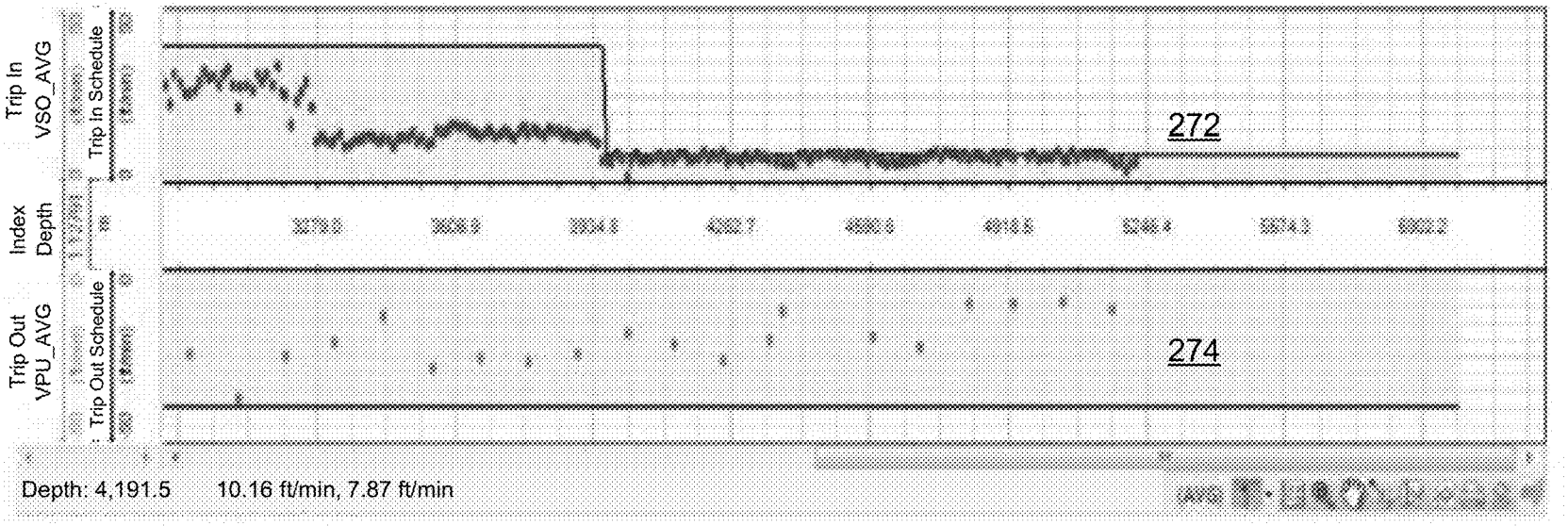
FIG. 13 shows a display produced by the Trip Schedule Widget.

FIG. 13 shows an example of a visual display produced by the Trip Schedule Widget. The Trip Schedule Widget calculates and displays average trip time in 272 and out 274 during the casing running operation. It requires that the Hookload Signature Agent be running, and that the appropriate output logs are being created (e.g., HookloadTcrcTime, and TripSchedule).

Figure 14:
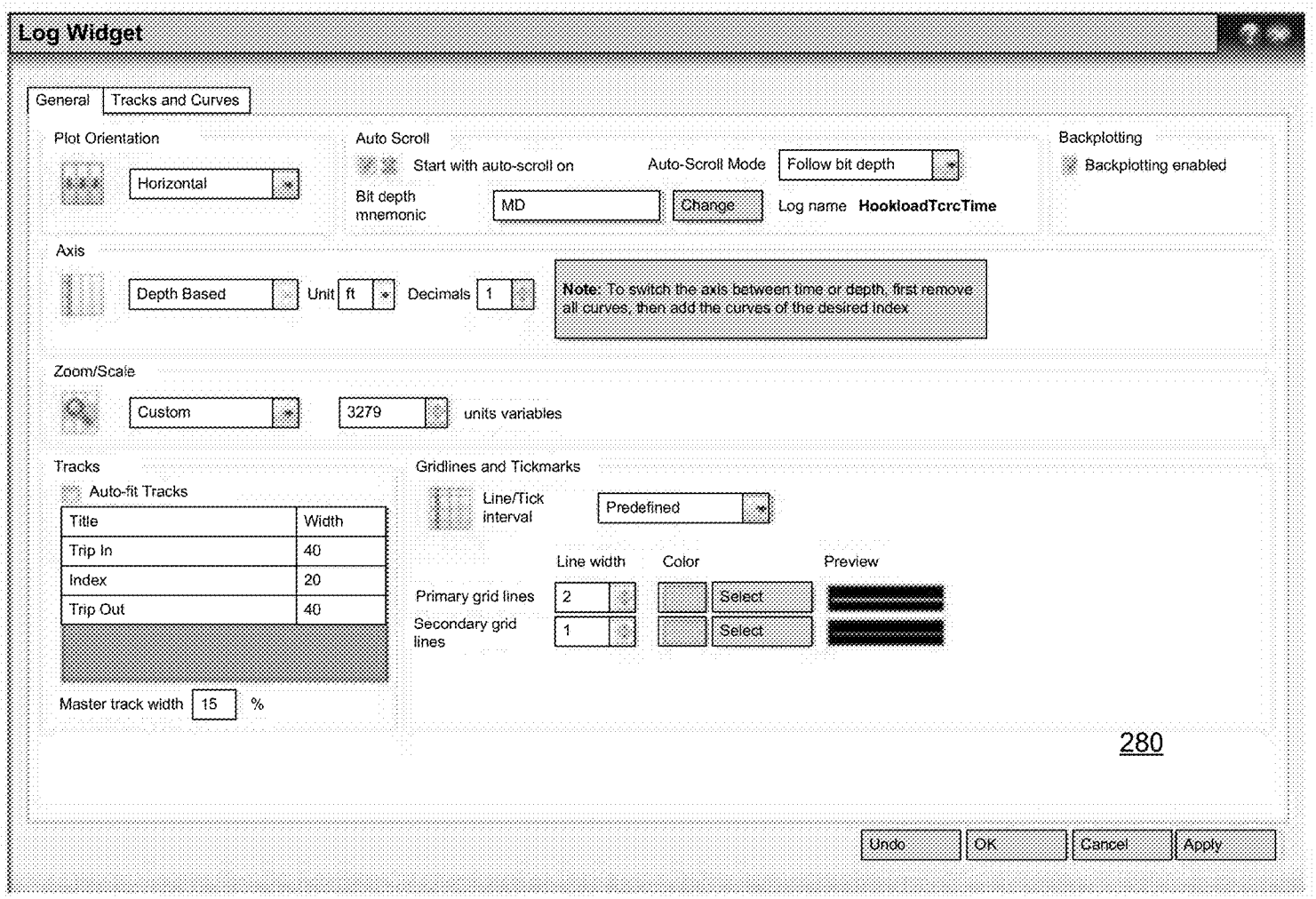
FIG. 14 shows a Trip Schedule Widget general settings input screen.

An instance of the Trip Schedule Widget can be created by clicking the "Add Log Widget" icon in the console menu. The user is then presented with the "General" tab settings screen 280 as seen in FIG. 14, where the user can set a variety of parameters for the display, including, but not limited to, plot orientation, auto-scrolling, axis labels and scaling, zoom, number and size of tracks, and width and color of gridlines and tickmarks.

Figure 15:
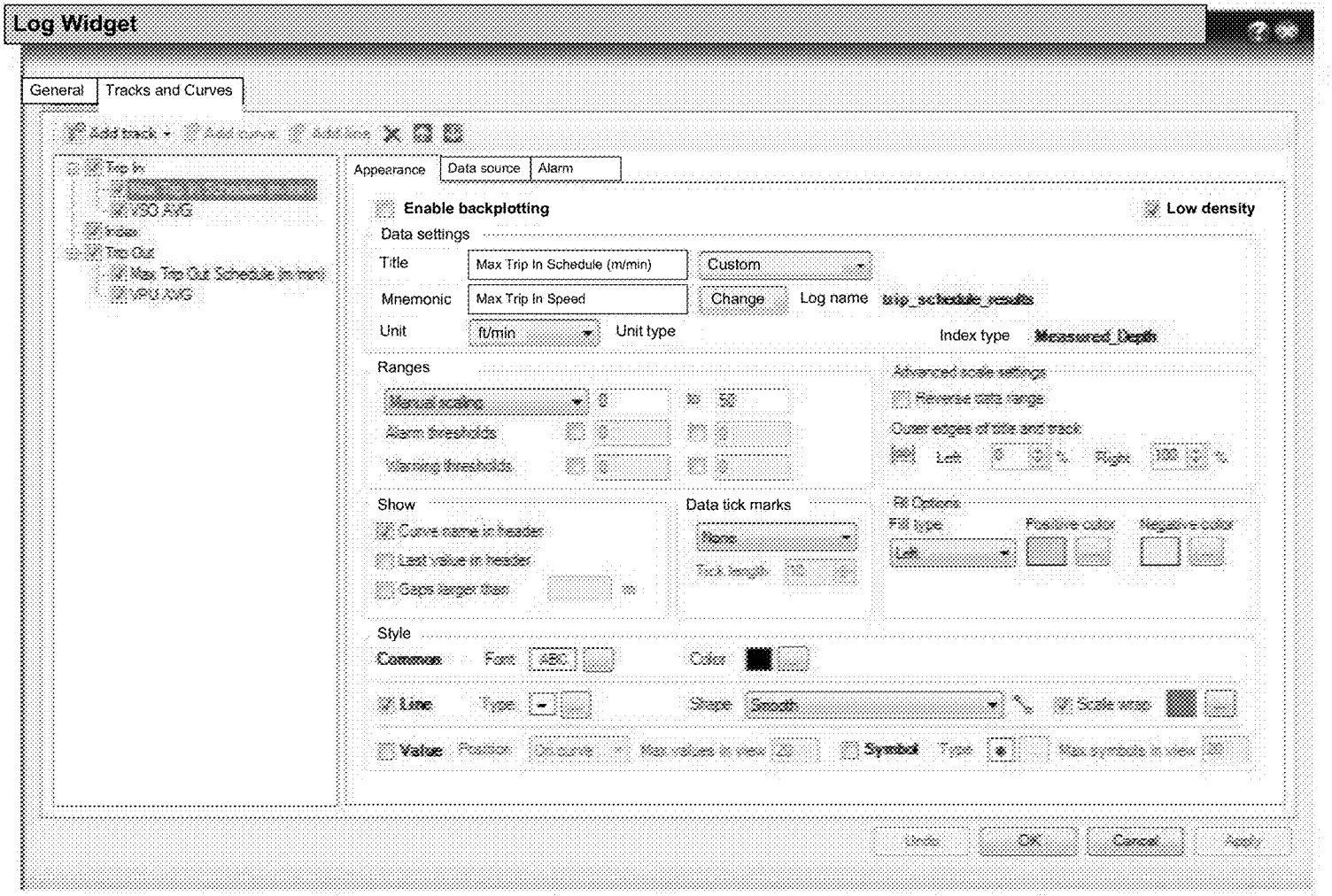
FIGS. 15-18 show various Trip Schedule Widget Tracks and Curves input screens.
Figure 16:
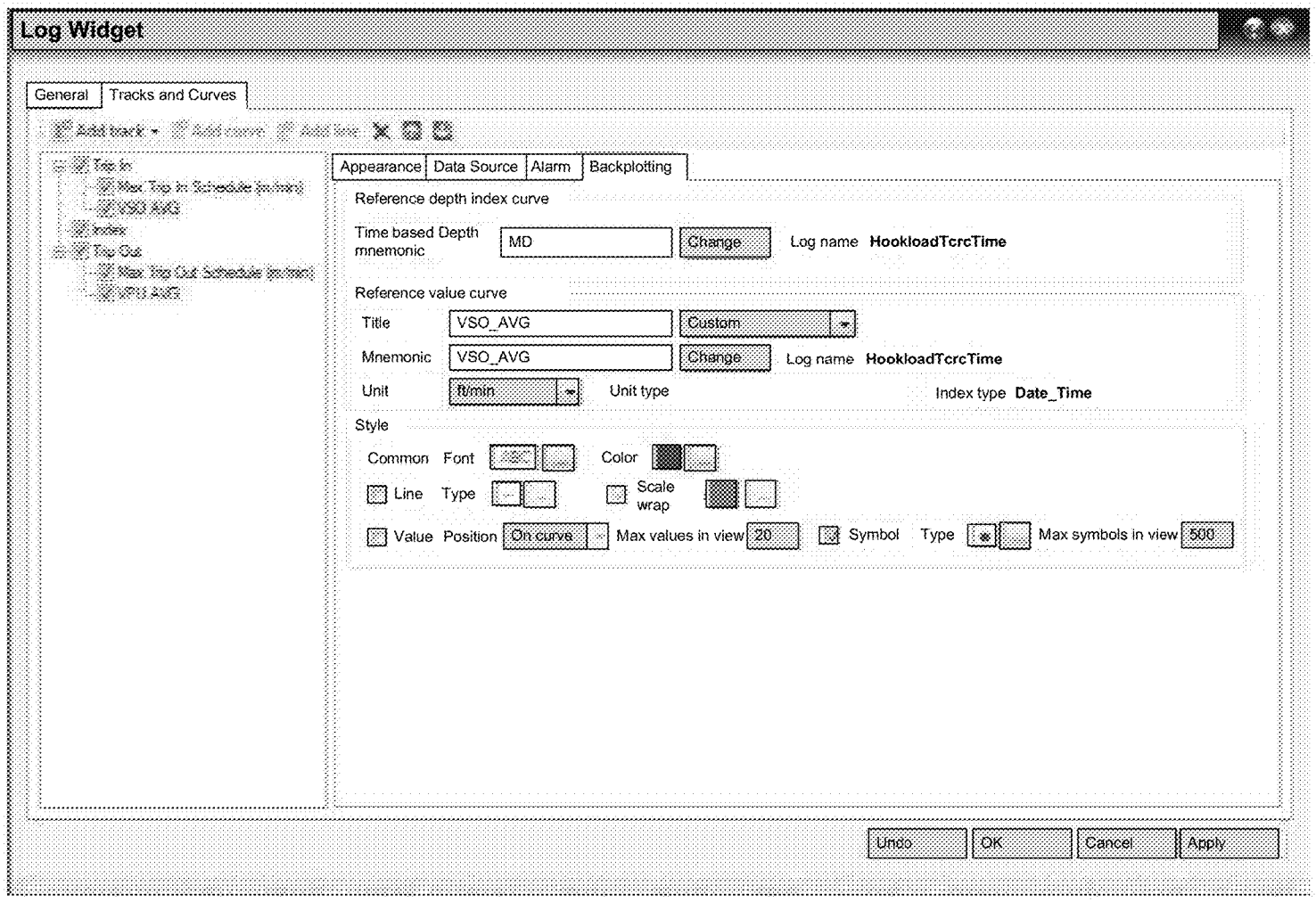
Figure 17:
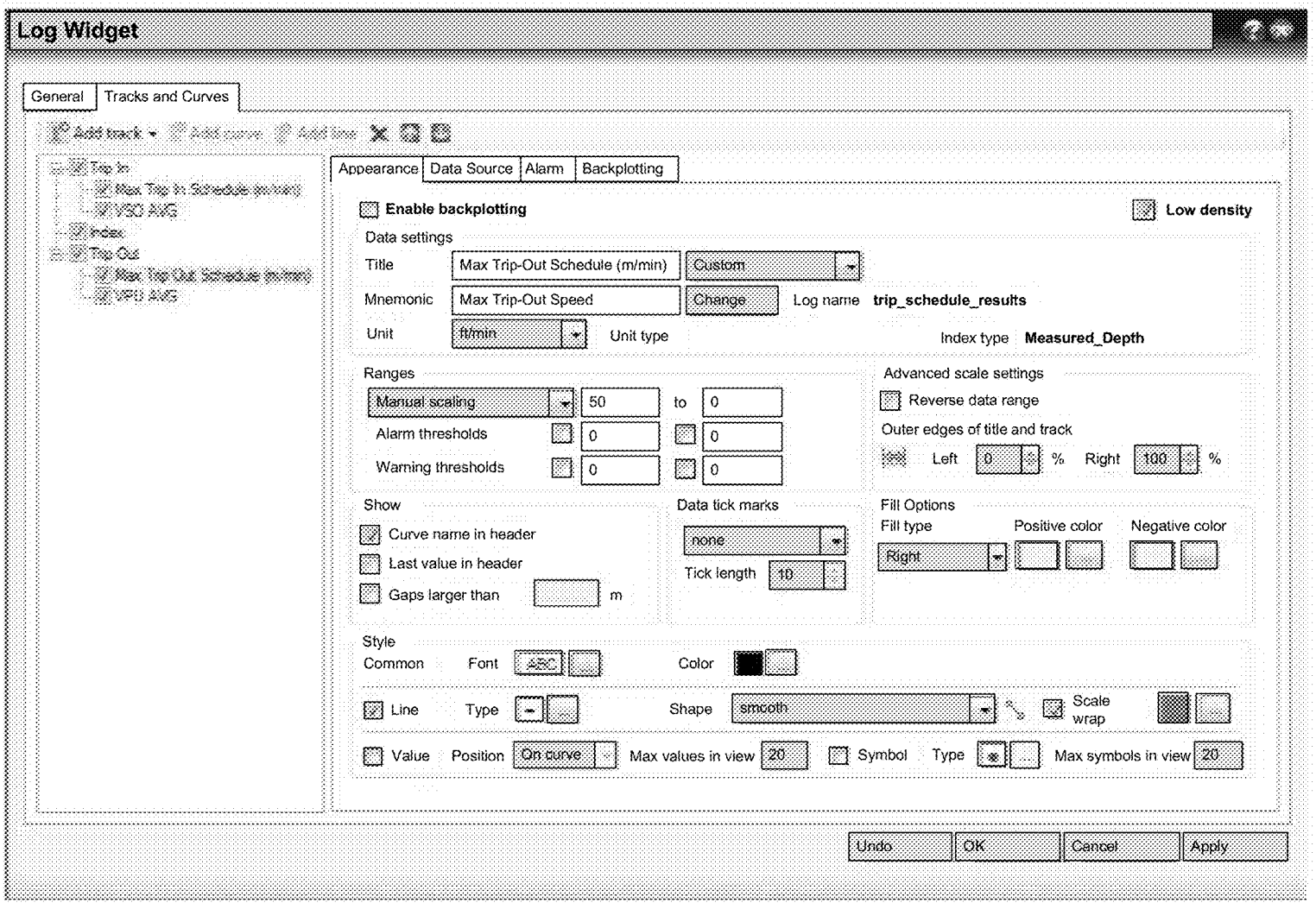
Figure 18:
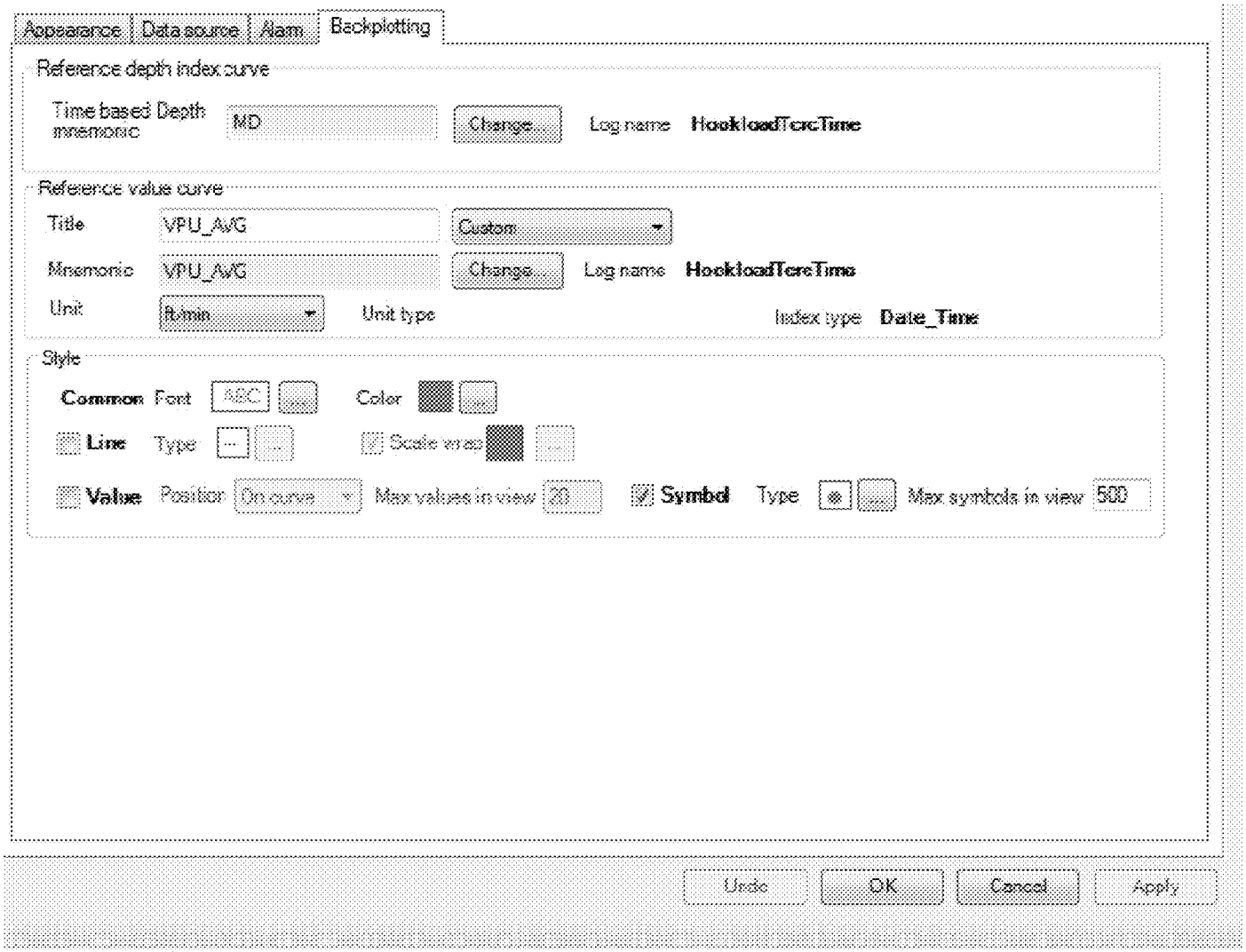

Examples of the "Tracks and Curves" settings screens are seen in FIGS. 15-18. FIGS. 15 and 17 show Appearance settings screens. FIGS. 16 and 18 show Backplotting setting screens. Users can add a trip-in schedule curve, trip-out schedule curve, VSO_AVG curve, VPU_AVG curve, or other curve as desired.

Figure 19:
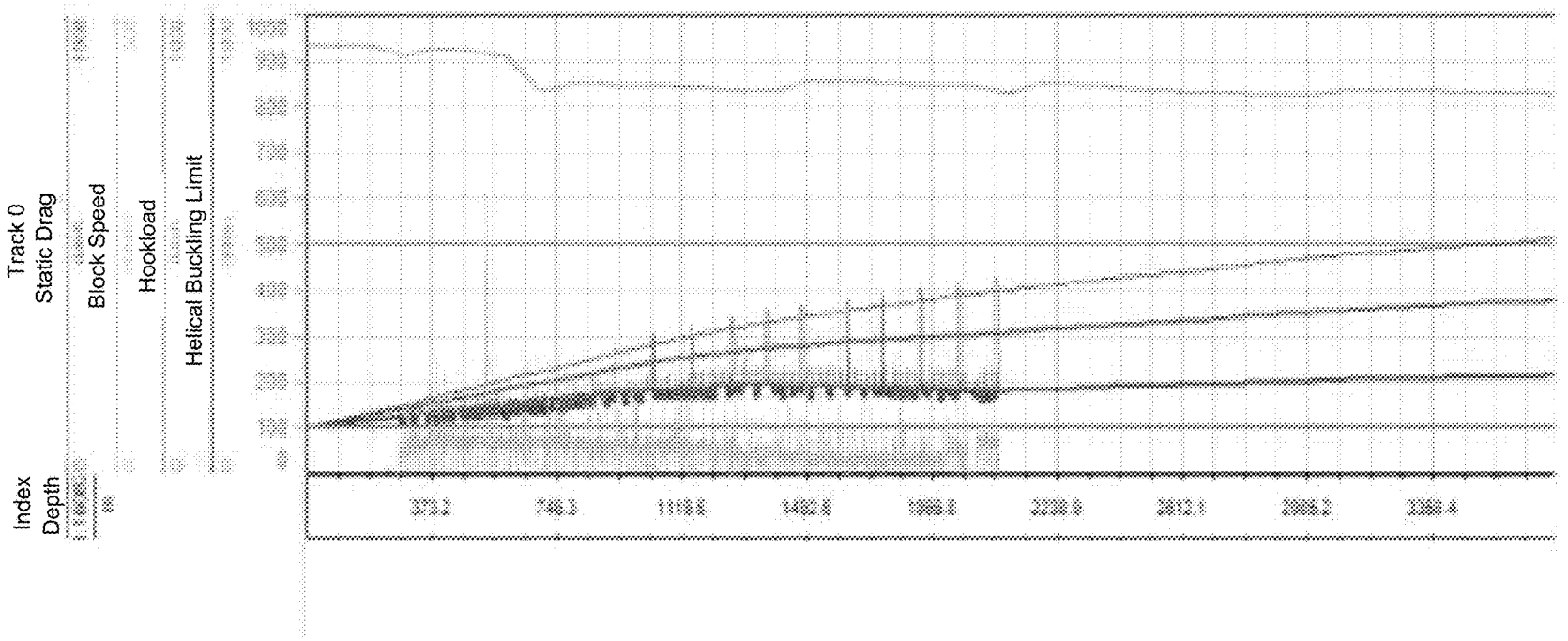
FIG. 19 shows a display produced by the Drag Chart Widget.
Figure 20:
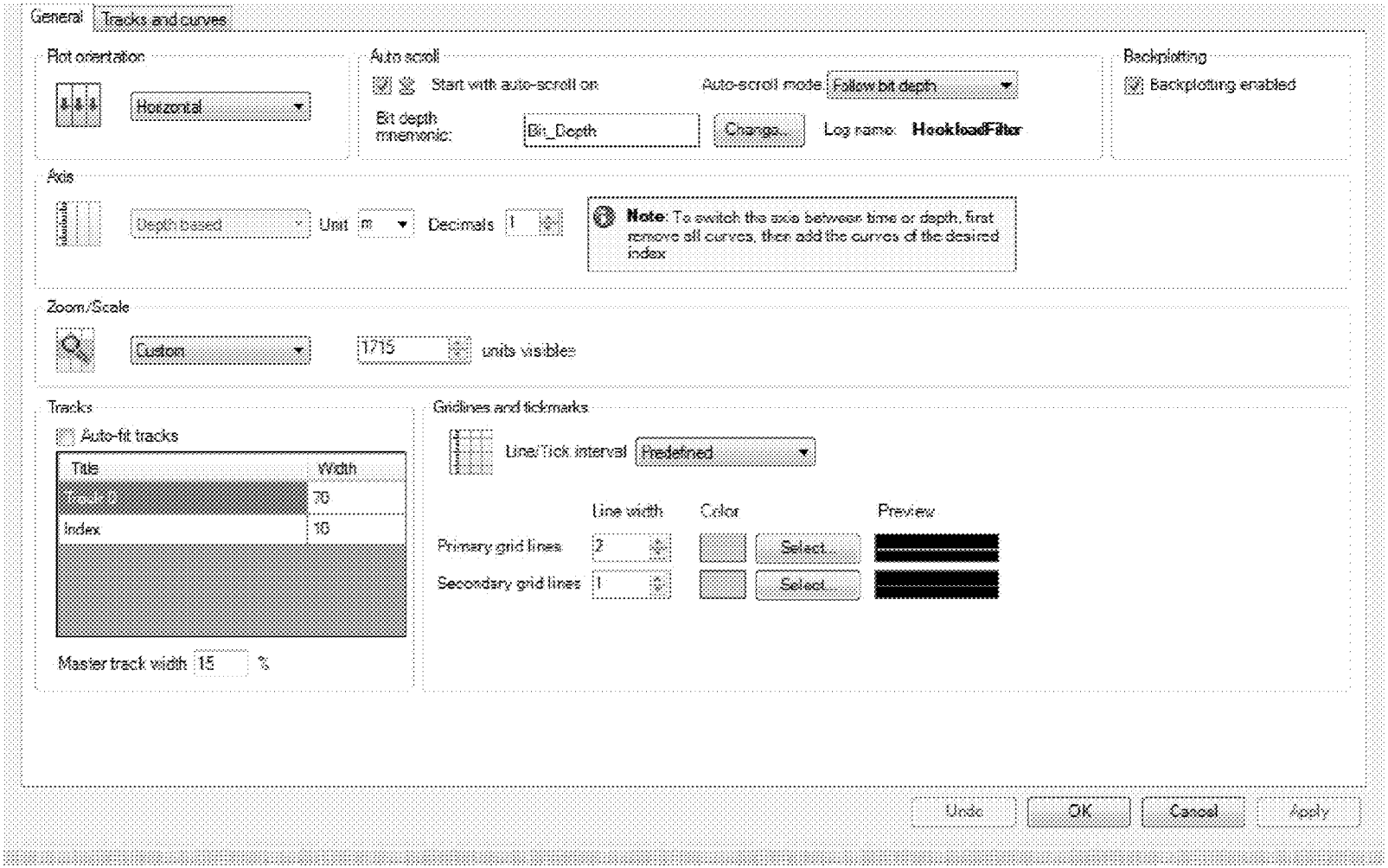
FIG. 20 shows a Drag Chart Widget general settings input screen.
Figure 21:
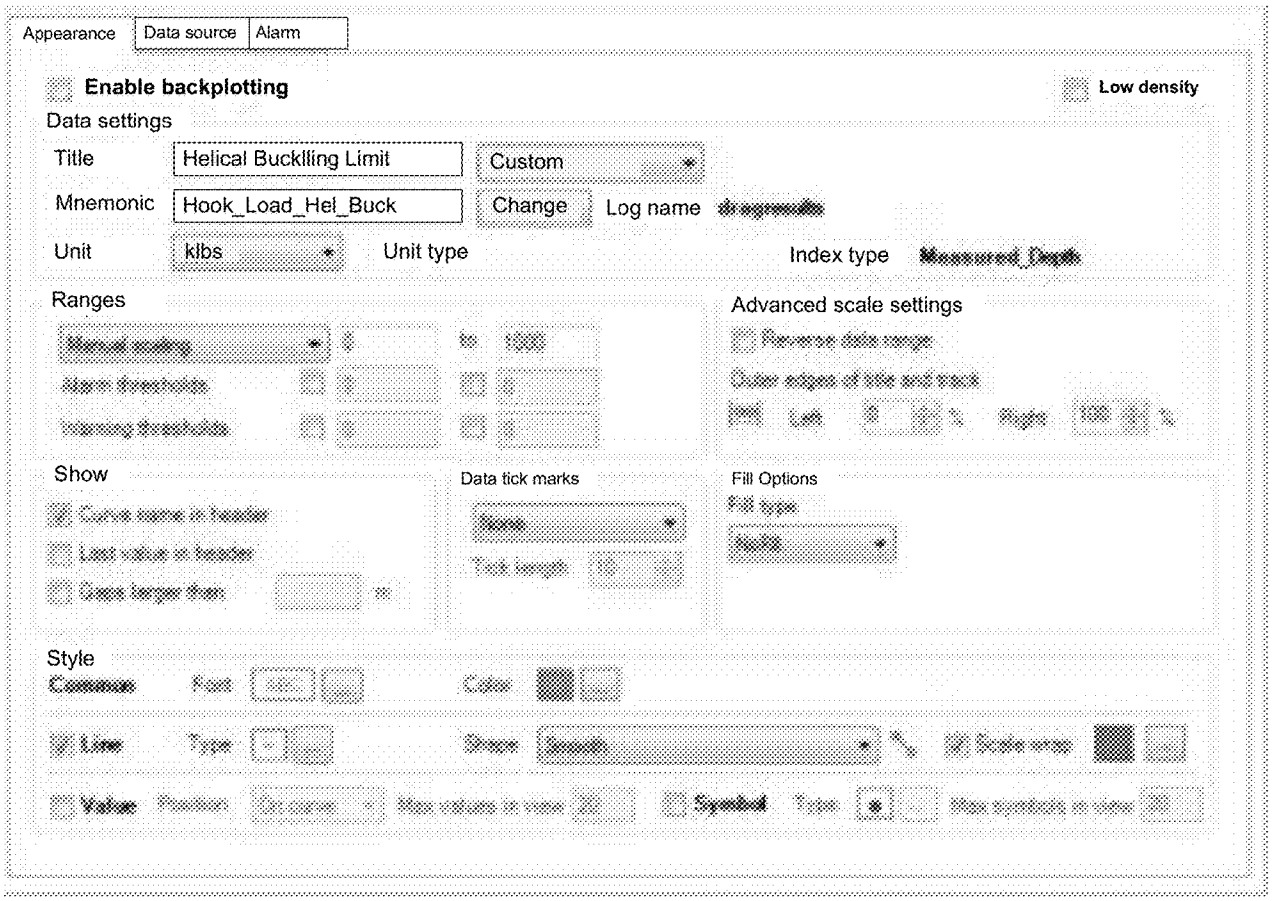
FIGS. 21-23 show various Drag Chart Widget Tracks and Curves input screens.
Figure 22:
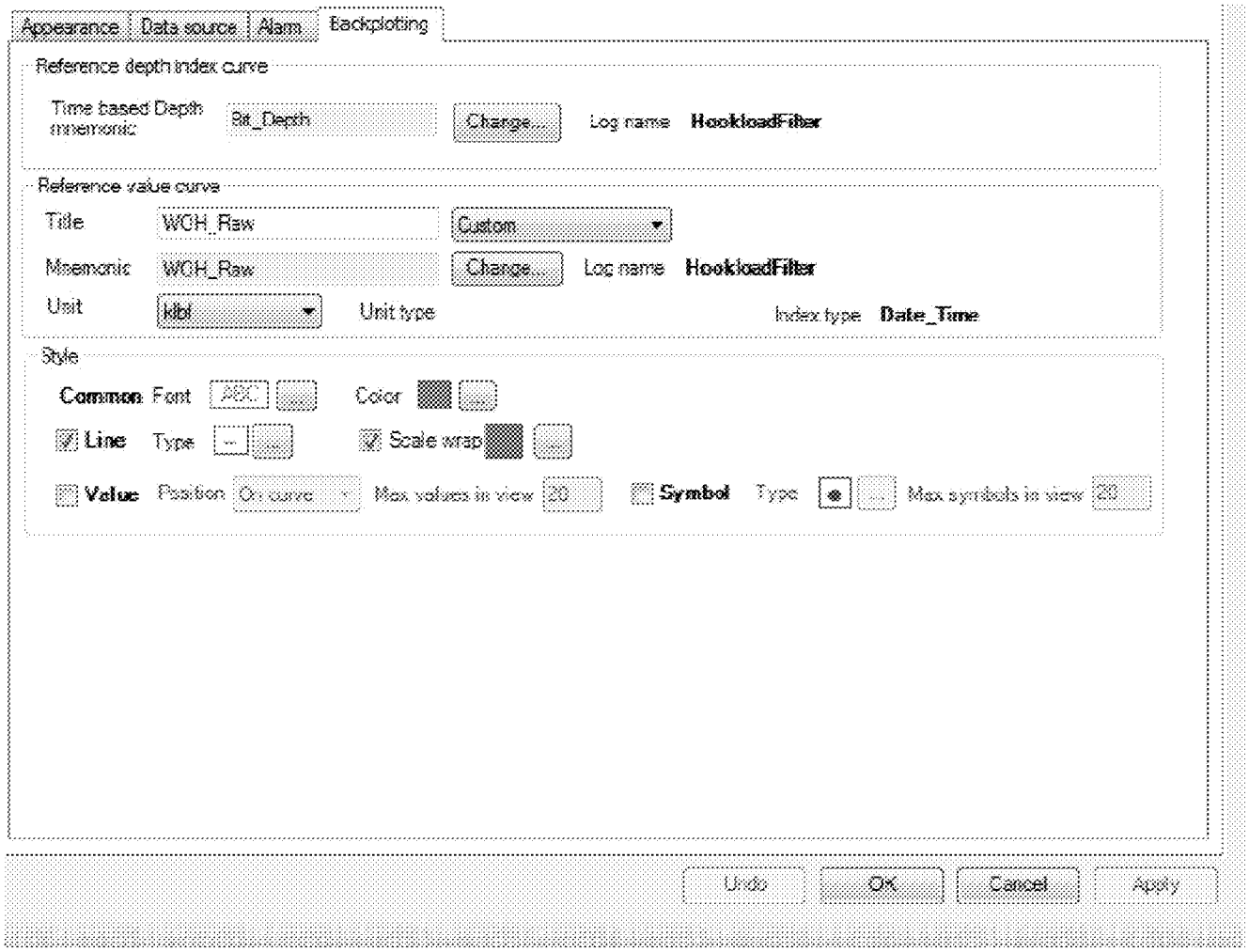
Figure 23:
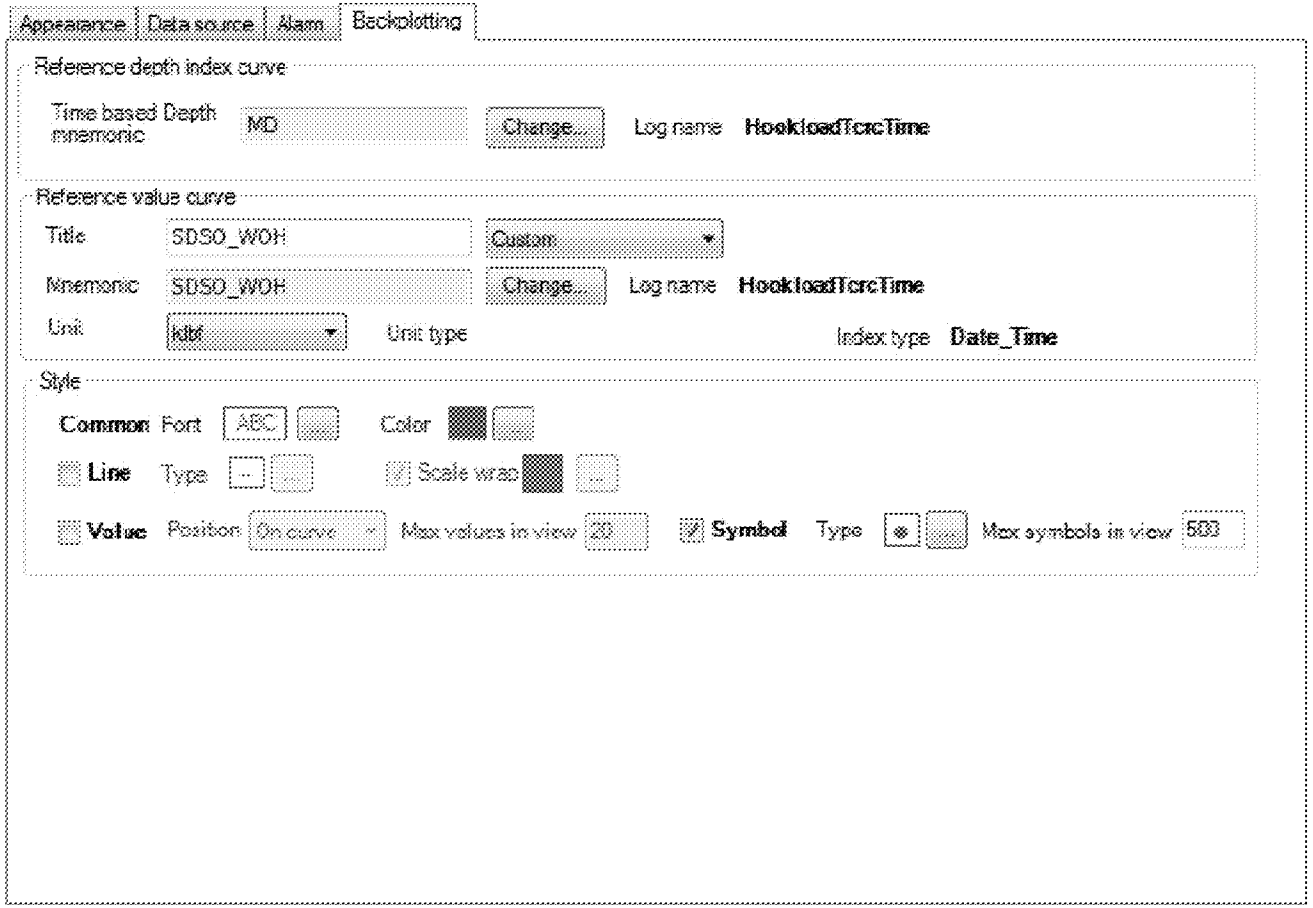

FIG. 19 shows an example of a visual display provided by the Drag Chart Widget. It displays drag chart data on several tracks. It requires that the Hookload Signature Agent be running, and that the appropriate output logs are being created (e.g., HookloadTcrcTime, HookloadFilter, and DragResults). An instance of the Drag Chart Widget is created in the same manner as the Trip Schedule Widget, and presents corresponding "General" and "Tracks and Curves" screens, as shown in FIGS. 20-23. Curve tracks that may be added include, but are not limited to, drag results curves, hookload and block speed curves, and static drag curves.

Figure 24:
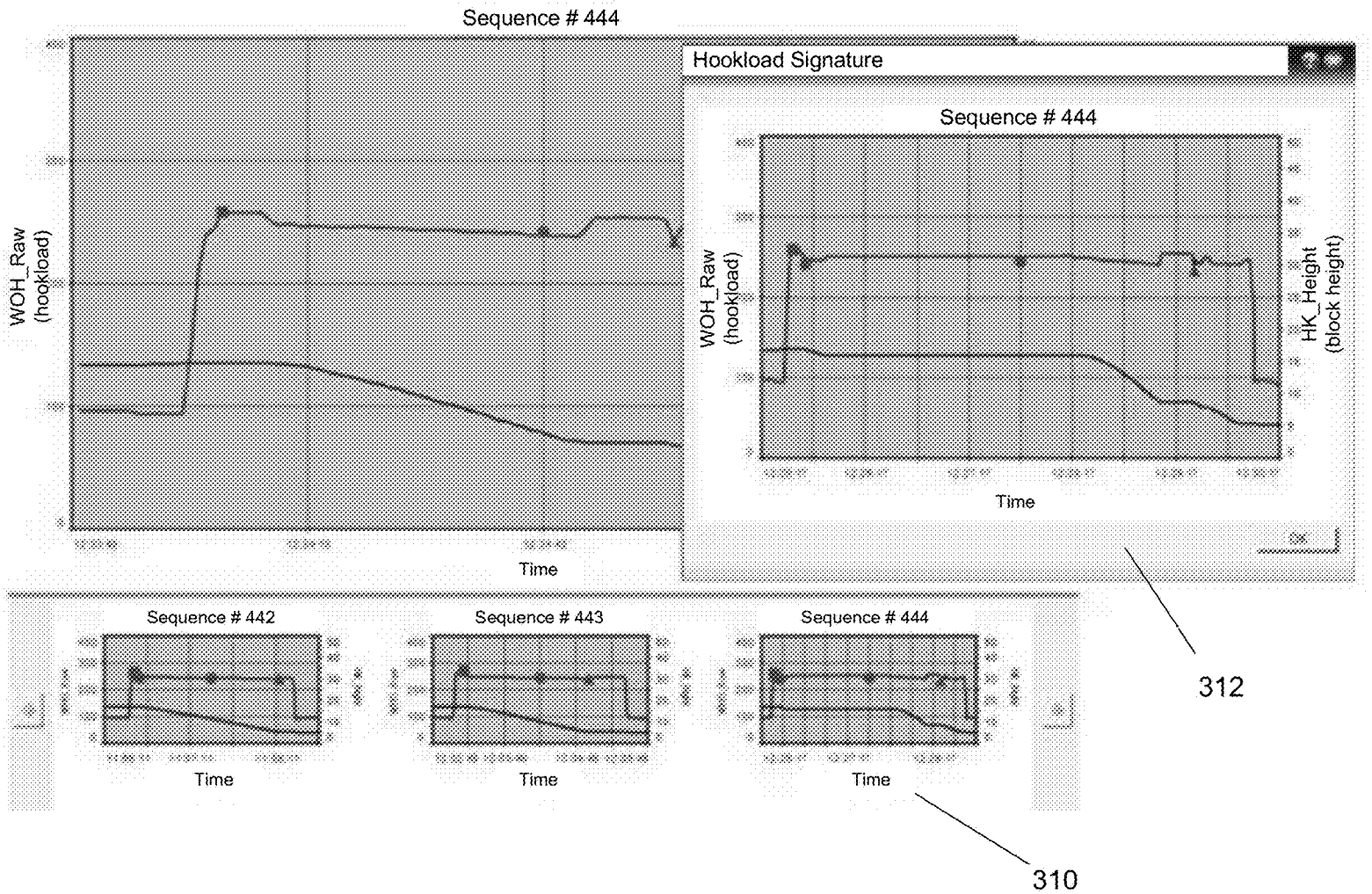
FIG. 24 shows a display produced by the Hookload Signature Widget.

FIG. 24 shows an example of a visual display provided by the Hookload Signature Widget. The Hookload Signature Widget analyzes hookload and block height data while doing casing runs. It also provides a historical view, where previous runs can be compared against each other to look at overall performance and tendencies. Clicking on one of the thumbnail images 310 causes a larger view 312 of that image to appear. The Hookload Signature Widget uses a specially designed WITSML log produced by the Hookload Signature Agent.

The plot line in the Hookload Signature Widget displays several symbols referred to as "events." Each symbol represents a specific event. In one exemplary embodiment, the symbols are as follows (green triangle, green circle, green square, red circle, red square):

| Symbol | Event Code | TCRC Log Mnemonic | Description |
|---|---|---|---|
| ▲ | 7 | HKSOmin | Minimum Dynamic Slack Off Hookload |
| ● | 8 | HKSOavg | Average Dynamic Slack Off Hookload |
| ■ | 9 | HKPUmax | Maximum Dynamic Pick Up Hookload |
| ● | 10 | SDSO | Static Drag (down force) |
| ■ | 11 | SDPU | Static Drag (up force) |

Figure 25:
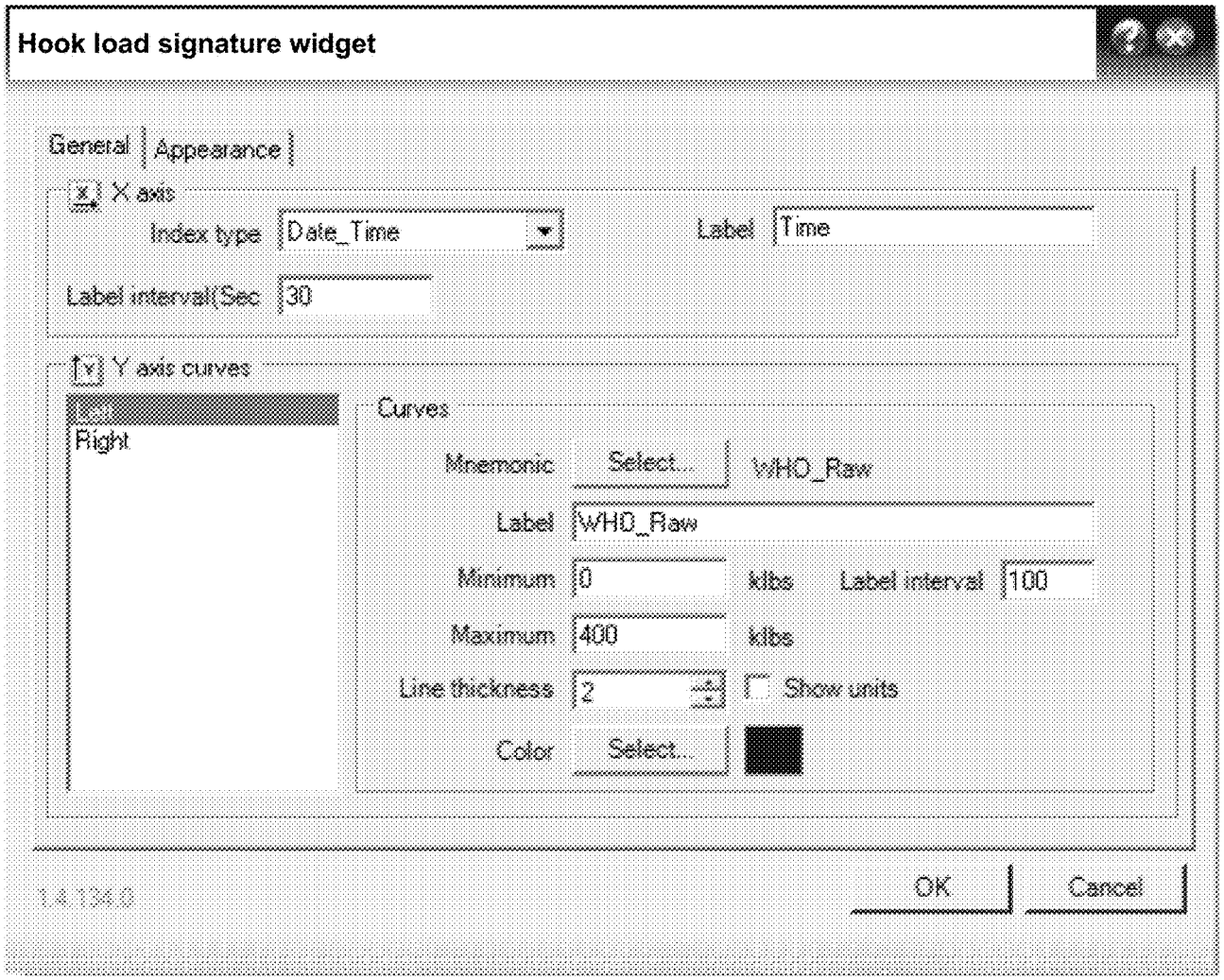
FIG. 25 shows a Hookload Signature Widget general settings screen.
Figure 26:
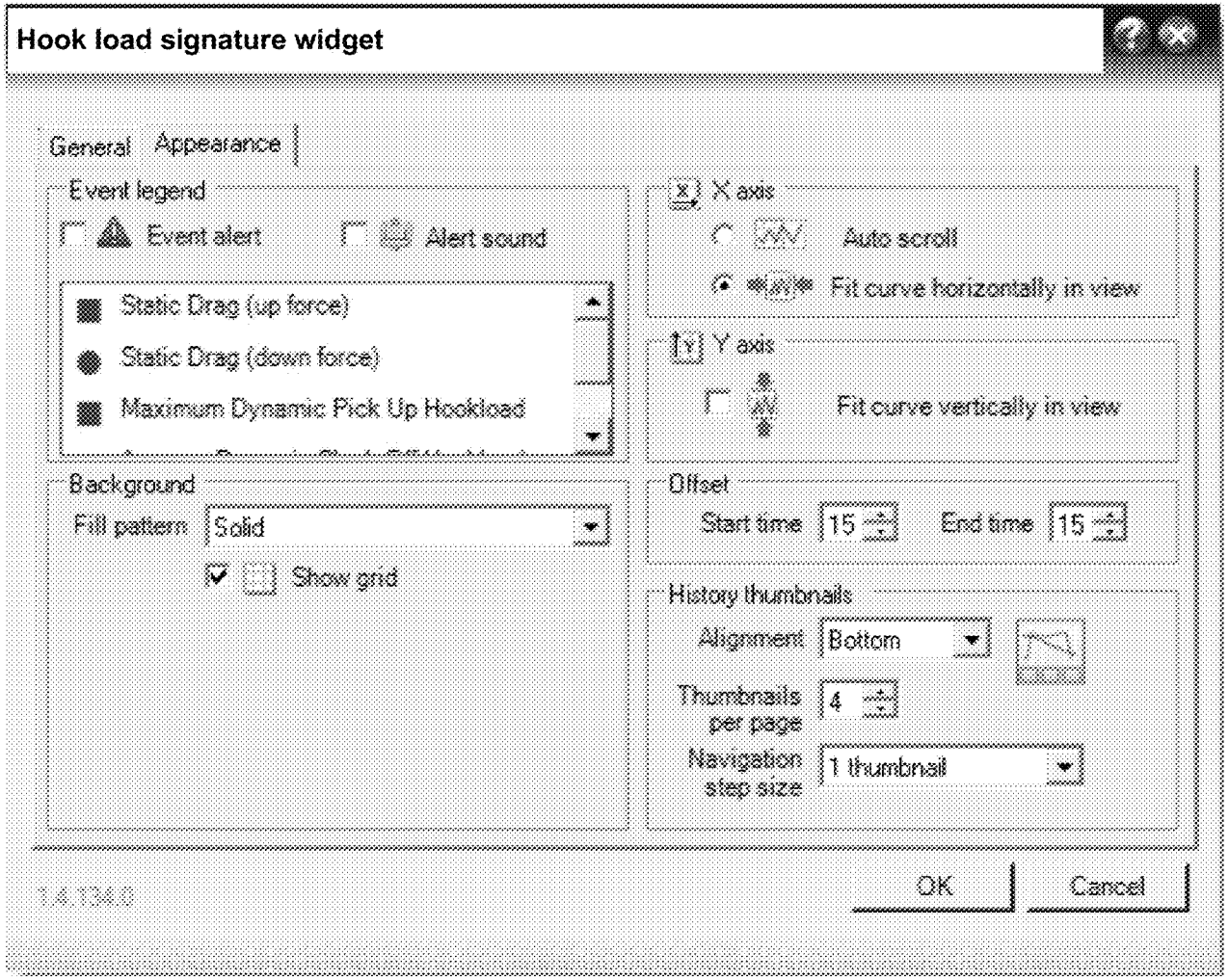
FIG. 26 shows a Hookload Signature Widget appearance settings screen.

As with the widgets described above, the user can change labels, curve colors, line thickness, background color, grid lines, axis and axis interval, scroll mode, curve offset values, the location of the history area, and the number of history boxes and navigation elements, among other parameters. An example of the general and appearance settings screens are shown in FIGS. 25 and 26.

Both the left and right axes can be assigned to a curve. In one embodiment, the left axis is most commonly used as the real-time hookload curve, while the right axis is usually the real-time block height curve.

Figure 27A:
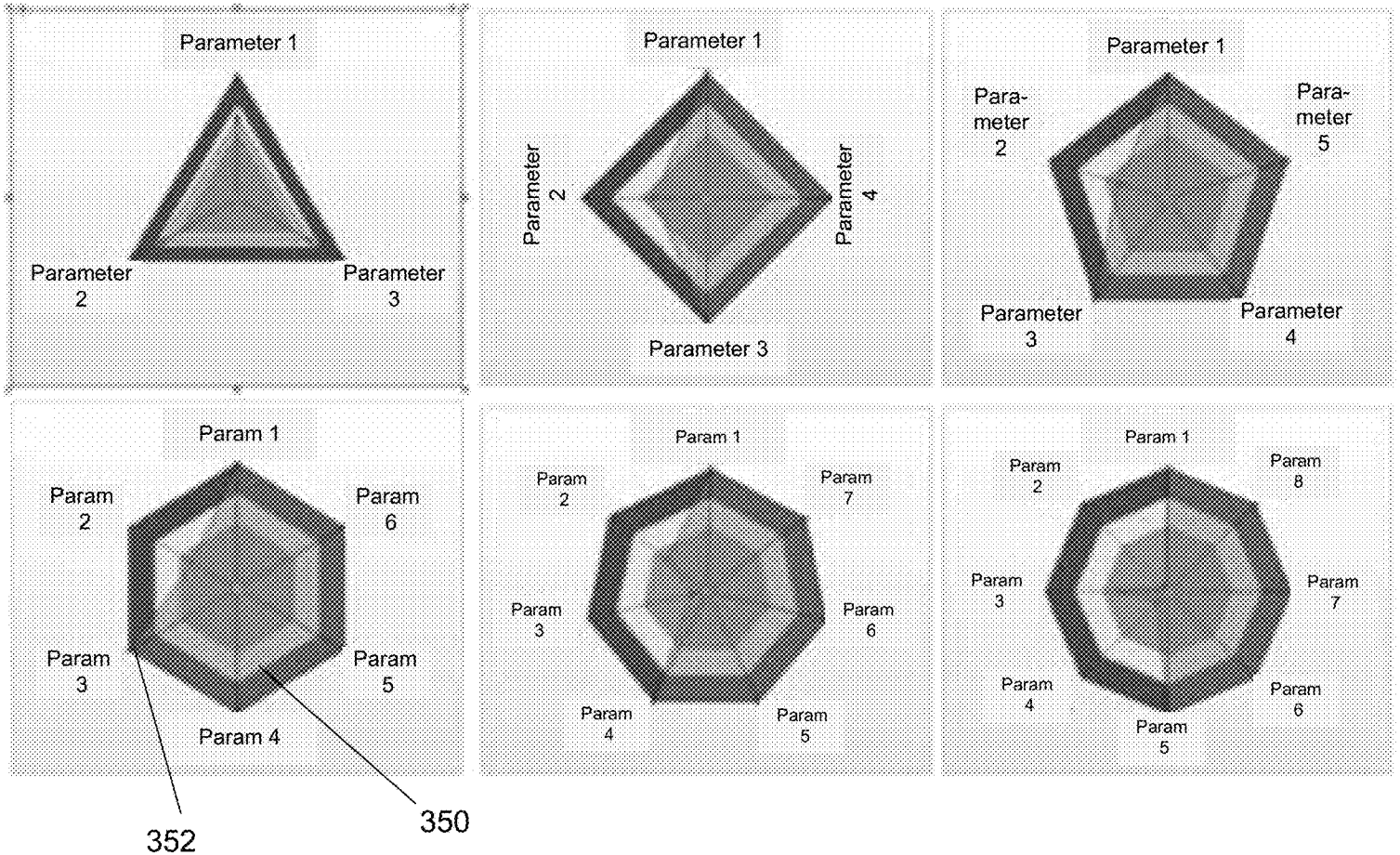
FIG. 27A shows various displays produced by the Zone Widget.
Figure 27B:
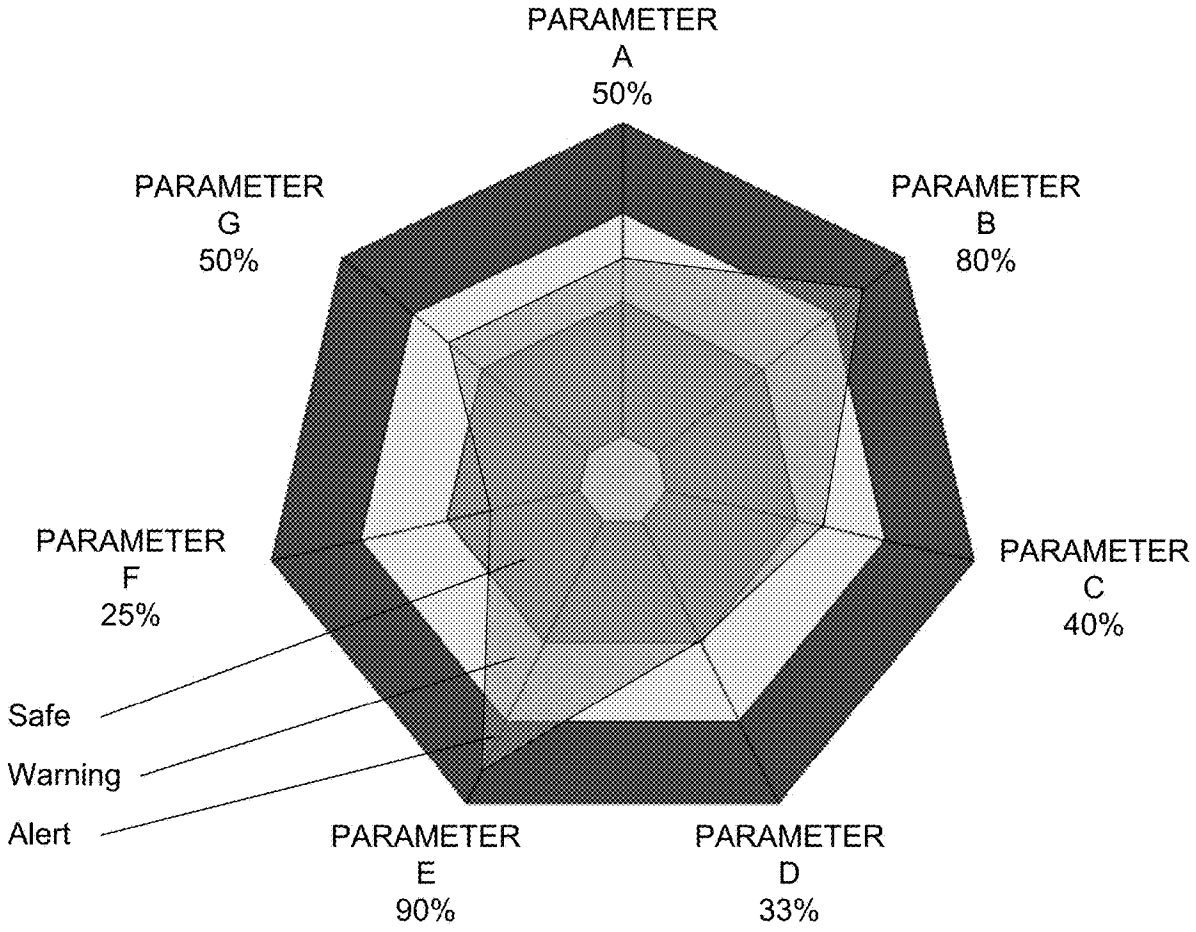
FIG. 27B shows another display produced by the Zone Widget.

FIGS. 27A and 27B show several examples of a visual display produced by the Zone Widget. The Zone Widget is a performance metric program designed to display the current status of the selected parameters based on pre-established threshold values, which may be user defined. The visual display is the form of a polygon 350 (symmetric or asymmetric) with a number of vertices 352, with each vertex representing a particular parameter. The vertex may be labeled, as shown. A similar number of threshold values are established for each parameter, and the scale is normalized so that the corresponding threshold appears to be the same distance along a line between the center of the polygon and the respective vertex.

Examples of parameters that may be displayed include, but are not limited to, High Hookload, Hookload Variation, Low Hookload, Static Friction, TripIn Speed, and TripOut Speed.

In one exemplary embodiment, the visual display has three areas, which may be colored or patterned: normal (green); warning (amber); and alert (red). The background area in the polygon is colored or patterned accordingly. The value of a particular parameter in real-time is plotted as a point along its respective line (typically with the base normal value in the center, with warning and alert thresholds proceeding outward), and can be plotted in real time or by using the most recent value for the parameter available. The plotted points of adjacent parameters are connected by a straight line on the display, the total effect comprising a polygon of changing size and shape over time that overlays the background. The user can thereby quickly determine if any parameters are in a warning or alert status, and take appropriate action. Historical data may be stored, so that a user can view the history of the parameters over time by viewing the change in shape and size of the parameter polygon.

Figure 28:
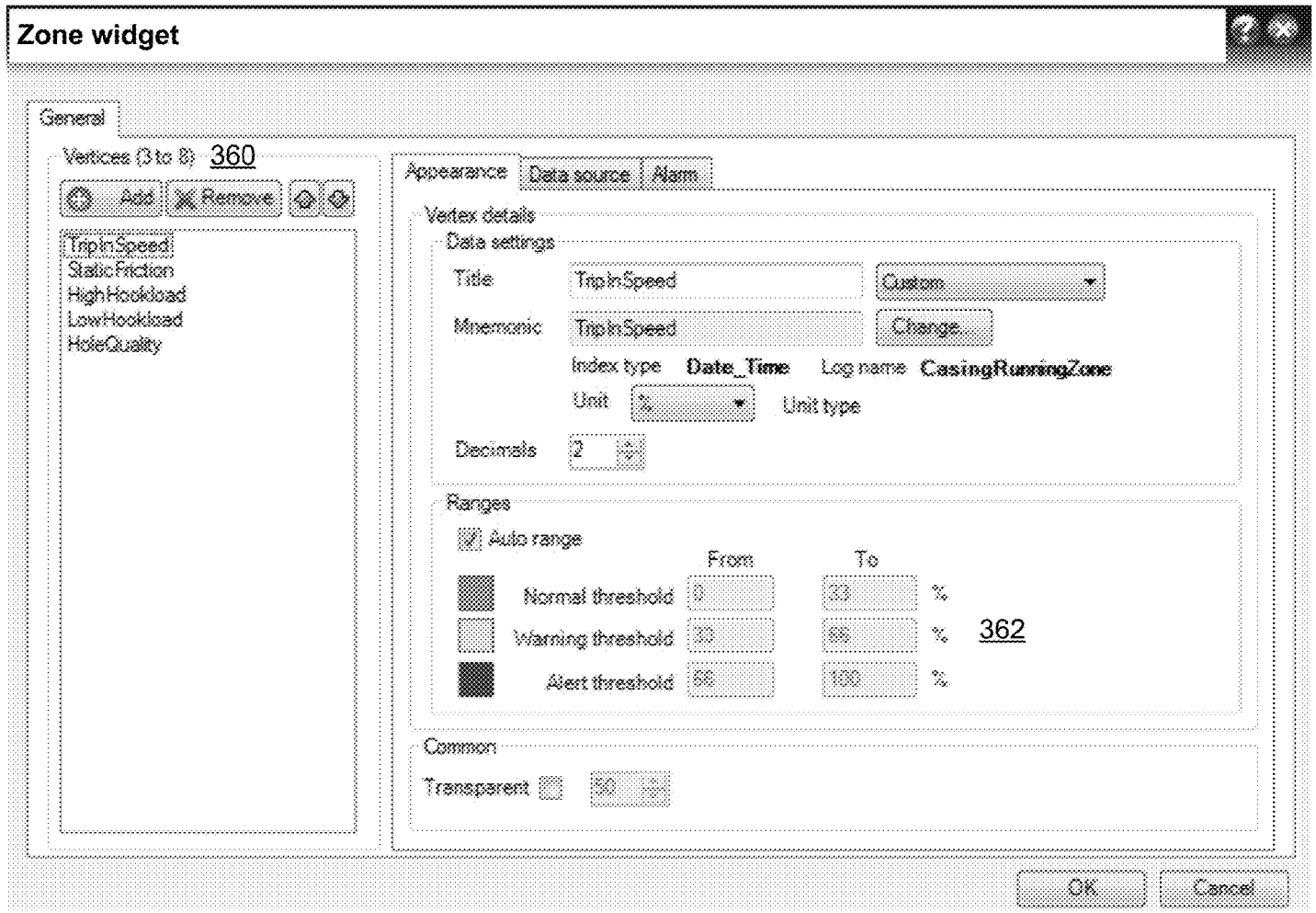
FIG. 28 shows a Zone Widget general setting screen.

As seen in FIG. 28, the user can change the number of vertices 360 (shown as 3 to 8, although a lower or higher range can be used), designate the data source or parameter to be used for each vertex, set the threshold levels, level of transparency, and other parameters. The user can group particular parameters together (e.g., on one side of the polygon), or arrange them in any other manner desired.

In one embodiment, the normal (green) to warning (amber) threshold is normalized to be at 33% of the distance from the center to the vertex, while the warning (amber) to alert (red) threshold is set at 66% 362. This results in the normal (green) area being visually twice the size of the other areas. Parameter values are expected to most often occur in this zone, and this visual effect helps the user to see changes and fluctuations with this normal value range.

In one embodiment, the background colors may be brighter than the parameter polygon. The parameter polygon overlay may be wholly or partially transparent. Alternatively, the background colors may be lighter or more faded, so that parameter polygon shows as a brighter color when it overlays a particular area. Thus, a portion of the parameter polygon will show as a bright yellow or red around a parameter whose value has passed those thresholds, thereby drawing the attention of the user. In yet another embodiment, the background may not be colored, with the parameter polygon showing as a bright color (e.g., green, amber, red) when it overlays a particular area.

Other colors may be used. Similarly, other forms of alert may be provided through the alert tab. For example, the vertex label can change to an amber or red color when the parameter passes the respective threshold. The vertex label or the plotted parameter point, or both, also may blink or flash periodically, to draw the attention of the user. The frequency of the blinking or flashing may vary depending on the actual parameter value. An audible alert or alarm also may be used. And in yet another embodiment, the system may automatically send an email, text, phone call, or other form of notice to a user (or a plurality of users) when certain conditions are met (such as two or more particular parameters exceeding the alert threshold for more than a set period of time).

Cementing Console

Figure 29:
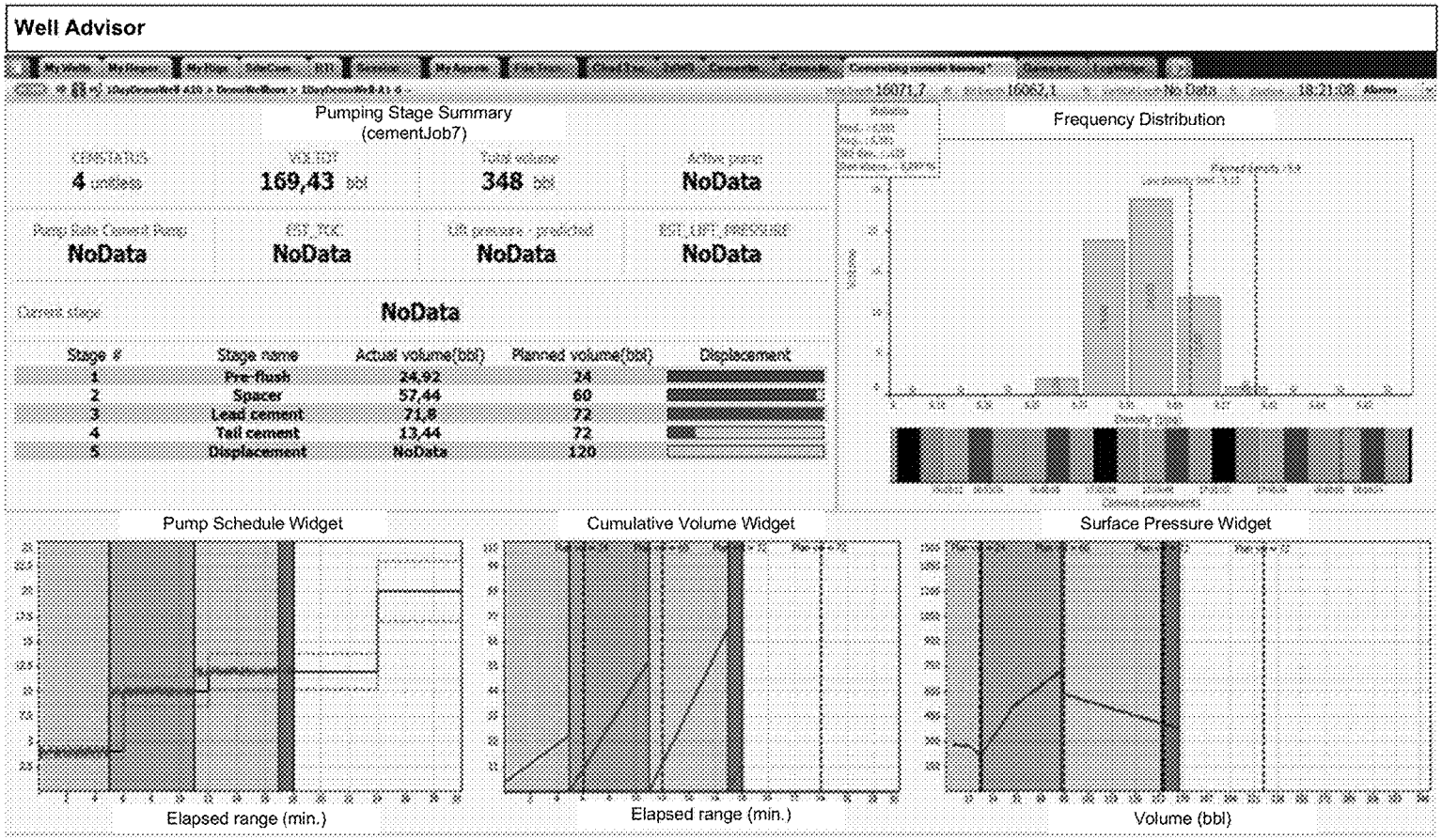
FIG. 29 shows a Cementing Console display screen.

The GUI display for an embodiment of a Cementing Console is shown in FIG. 29. The Cementing Console is used to manage and monitor cement jobs within the wellbore. In the embodiment shown, the Cementing Console comprises a configuration screen and at least four widgets (Frequency Analysis, Plan Tracking, Pumping Stage, and 2D Wellbore Schematic), which allow the user to monitor fluid displacement, densities, pressure, and pump plans in real-time, and compare the real-time data to a cementing plan.

Figure 30:
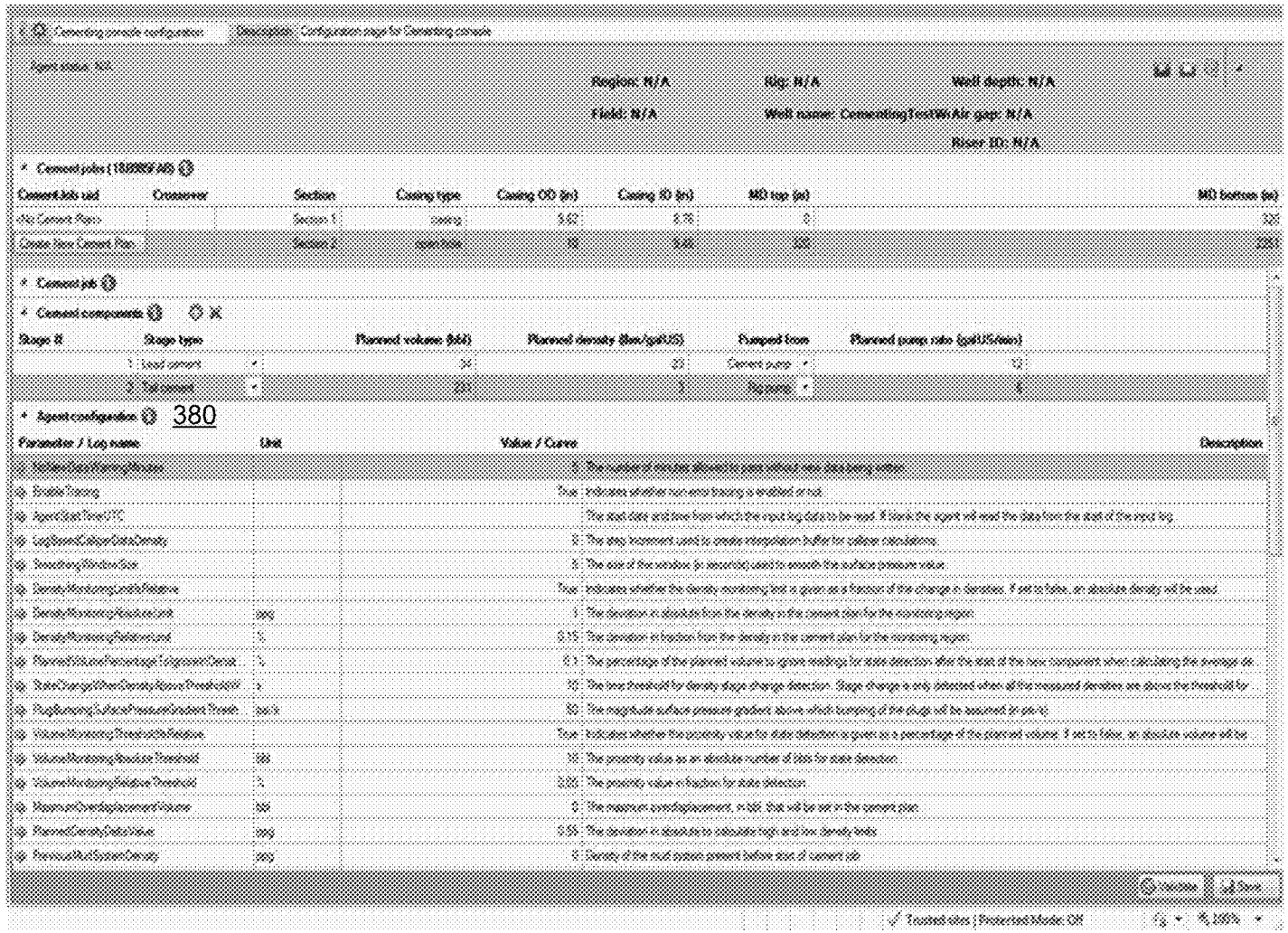
FIG. 30 shows a Cementing Console configuration screen.

FIG. 30 shows an example of a Cementing Console configuration screen, which is the main entry point for a cement job. Cement jobs can be configured and planned using this screen, although a stored configuration or plan file can be uploaded in some embodiments. The user can input or modify, validate, and save the various parameters 380 shown.

Figure 31:
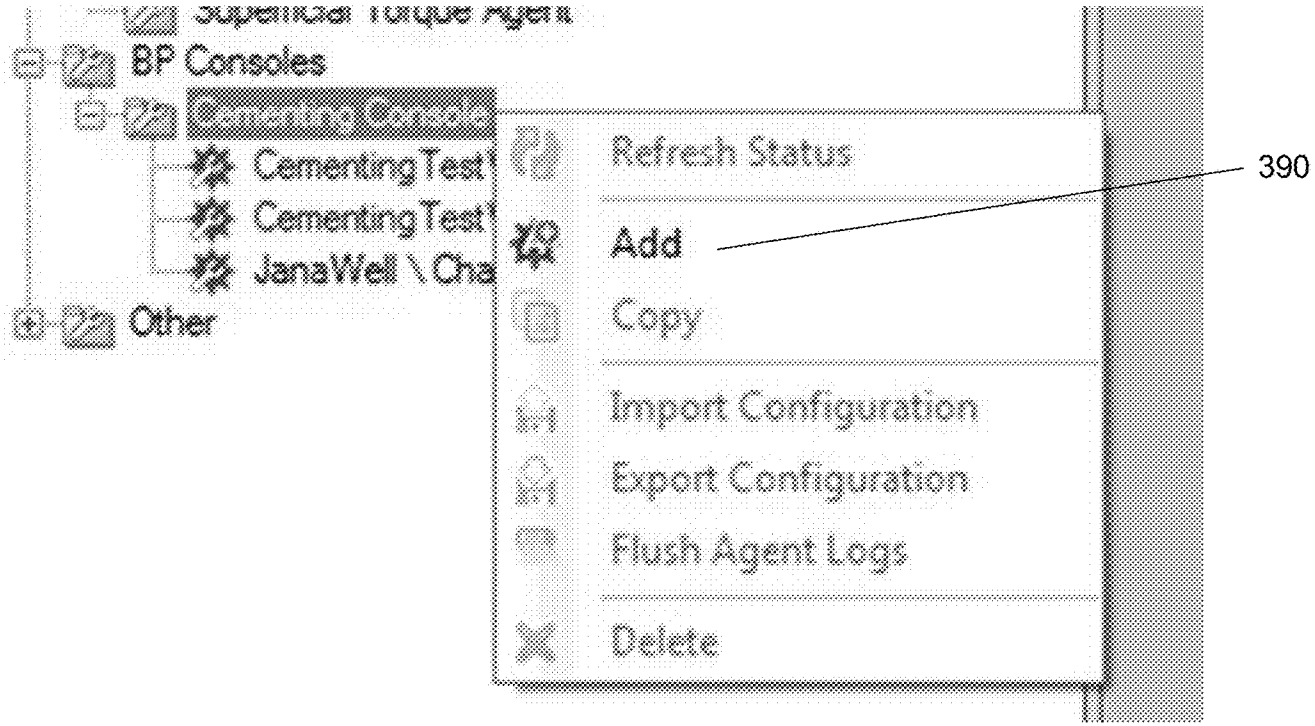
FIG. 31 shows an example of configuration menu.
Figure 32:
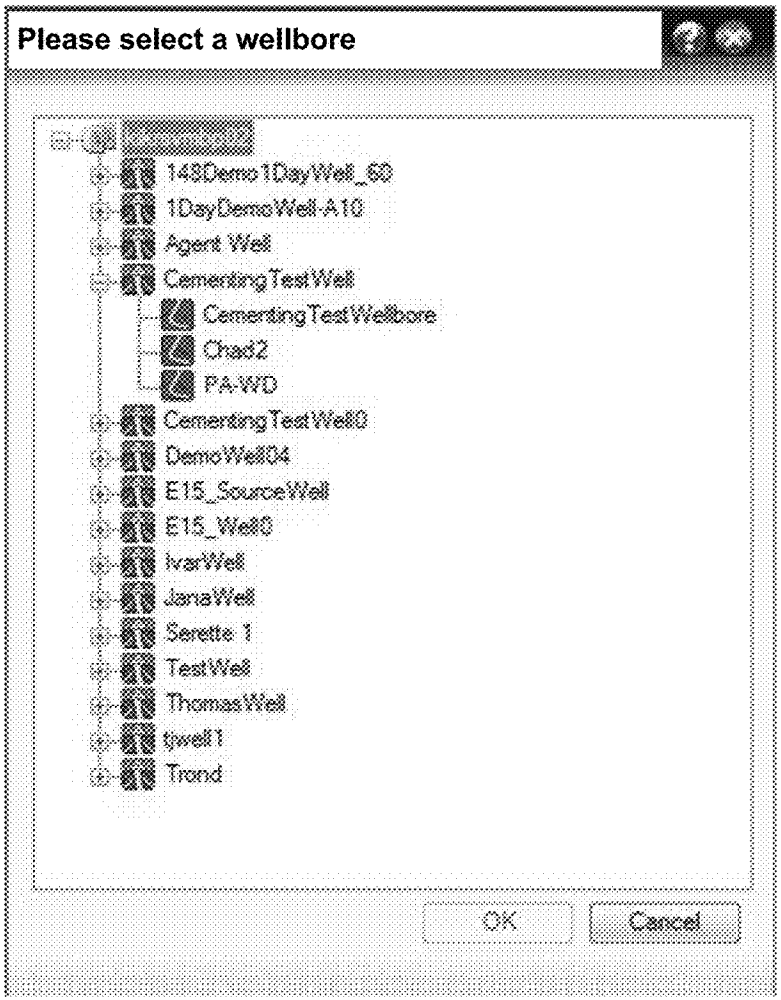
FIG. 32 shows an example of a wellbore selection dialog screen.

A new Cementing Console configuration can be created in the manner described above for smart agent configuration. In one exemplary embodiment, the user creates the new configuration by right clicking on the "Cementing Console" node in the system map, and selecting "Add" 390, as shown in FIG. 31. This brings up the wellbore selector dialog window, as seen in FIG. 32, where the user selects the wellbore in which the cement job is to be performed. In the embodiment shown, there is only one cementing configuration file per wellbore, although multiple cement jobs can be configured within that one configuration file. Alternatively, each cement job may have its own configuration file.

Figure 33:
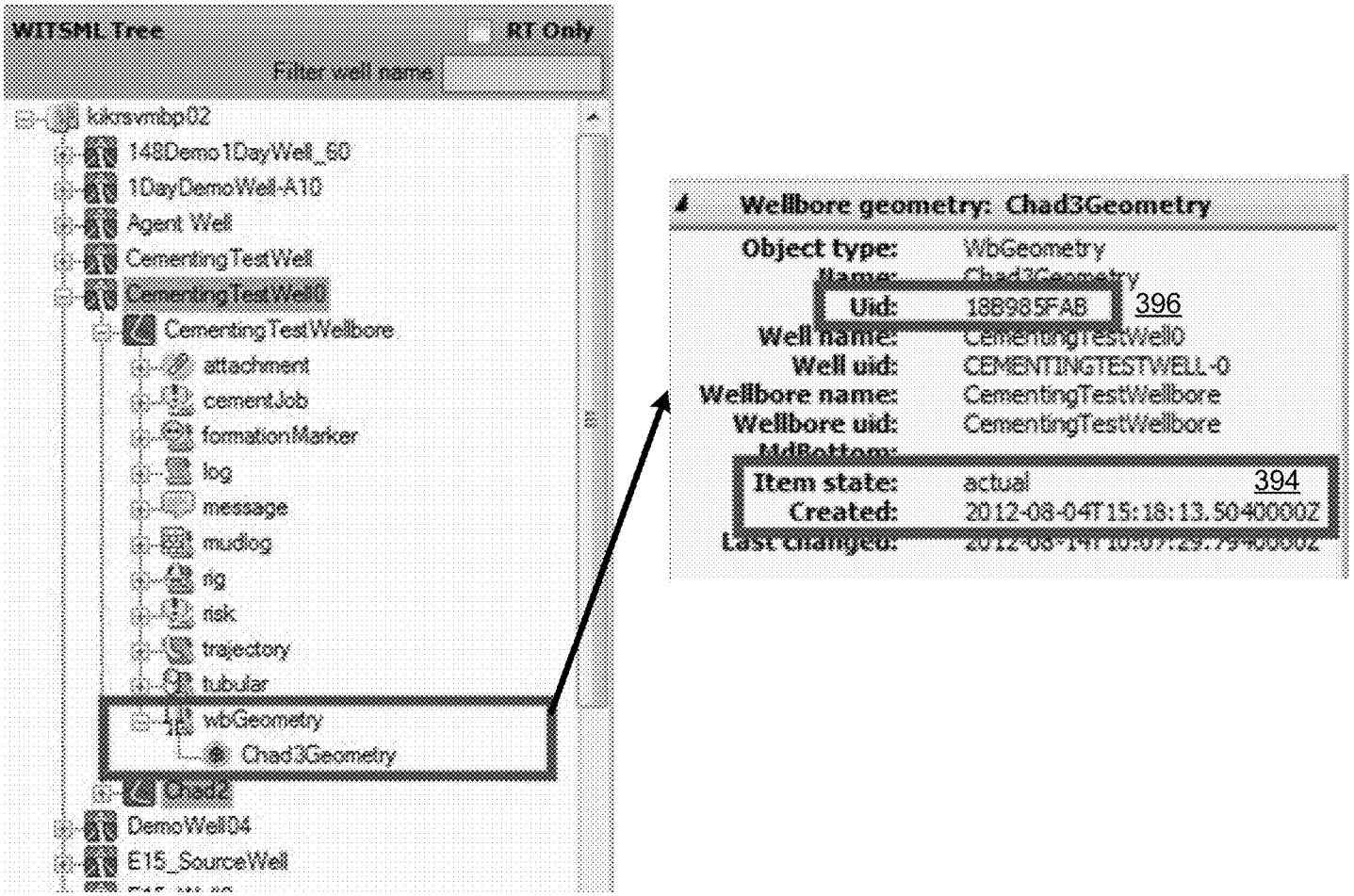
FIG. 33 shows an example of a wellbore geometry window.

The user is then shown the currently active wellbore geometry object with all of its wellbore geometry sections (i.e., the latest object with "Item State" set to "actual" and the newest creation date 394), as seen in FIG. 33. This shows the current geometry of various sections of the wellbore. The user can use the WITSML tree in the side bar of the display to confirm what object is currently in use. The user can select the wellbore geometry objects on the desired wellbore, and view the detail information box section to see the Item State and creation date. The user can also confirm the unique identifier ("Uid") 396 of the object in use, which can be displayed in the header of cement jobs section of the configuration screen as well as in the information box.

Figure 34:
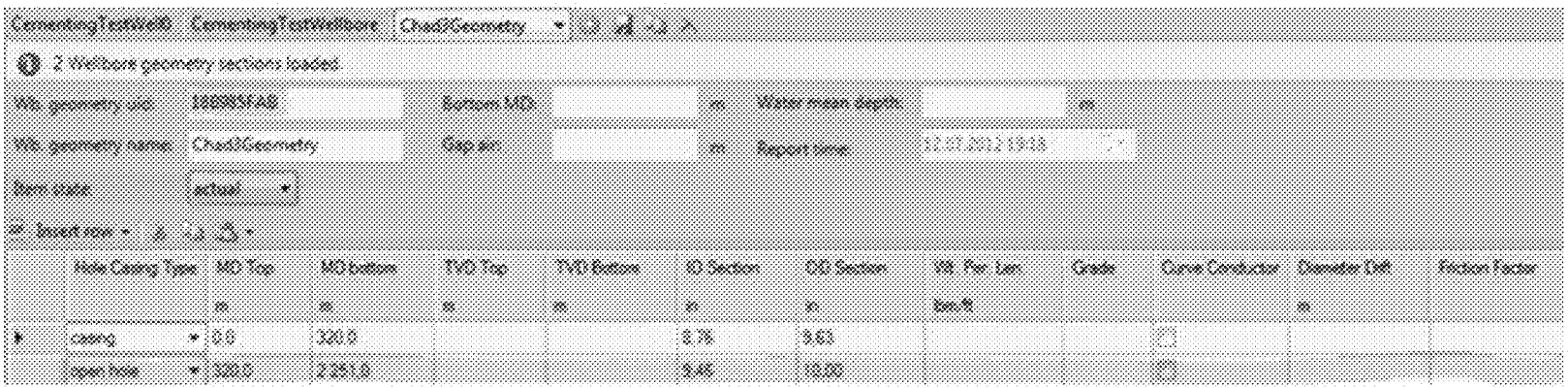
FIG. 34 shows an example of a WITSML tree display.

New cement jobs and plans should be created on open hole sections within the wellbore. In one embodiment, if an open hole section is unavailable in the wellbore geometry object, a new cement job or plan cannot be configured. Thus, the wellbore geometry object should be updated well in advance of the cement job, and ideally, right after the new wellbore section has been drilled. The wellbore geometry object can be updated through the WITSML WellboreGeometry editor, which can be initiated through the system's WITSML tree in the side bar 410, as seen in FIG. 34. Once the wellbore geometry object has been updated, the system replicates the changes to the server and various widgets and editors in the system. In one embodiment, the cementing configuration screen must be manually refreshed to reflect any change made to the wellbore geometry object. The cementing configuration screen does not modify or change the wellbore geometry data itself, and only reads the data.

Figure 35:
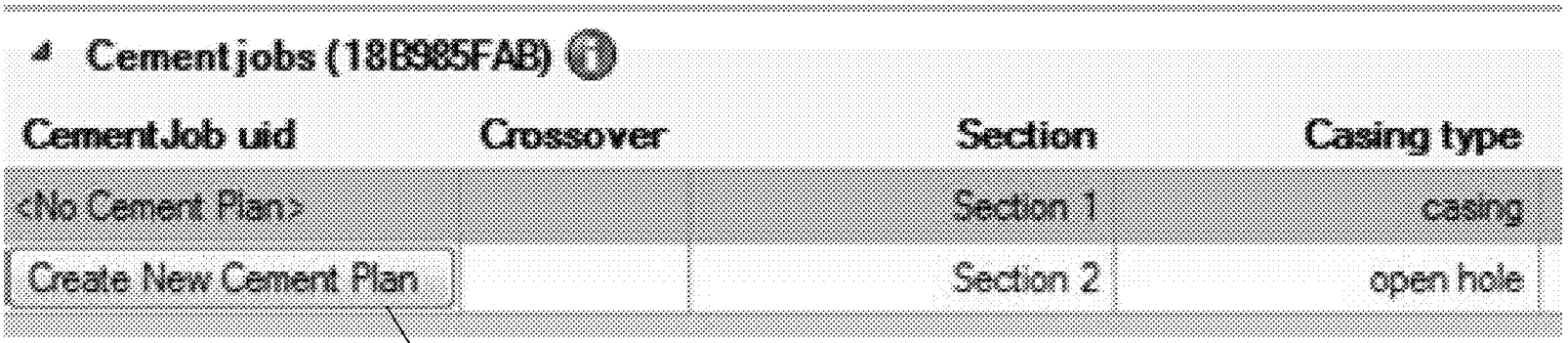
FIG. 35 shows a cement jobs grid from the Cementing Console configuration display.

When an open hole section exists in the wellbore geometry object, and the cementing configuration screen has been refreshed (if needed), a "Create New Cement Plan" button or icon 420 is enabled on the open hole row (or rows) of the cement jobs grid, as seen in FIG. 35. When a plan is created for that section of the wellbore, a unique identifier replaces the create plan button.

Figure 36:
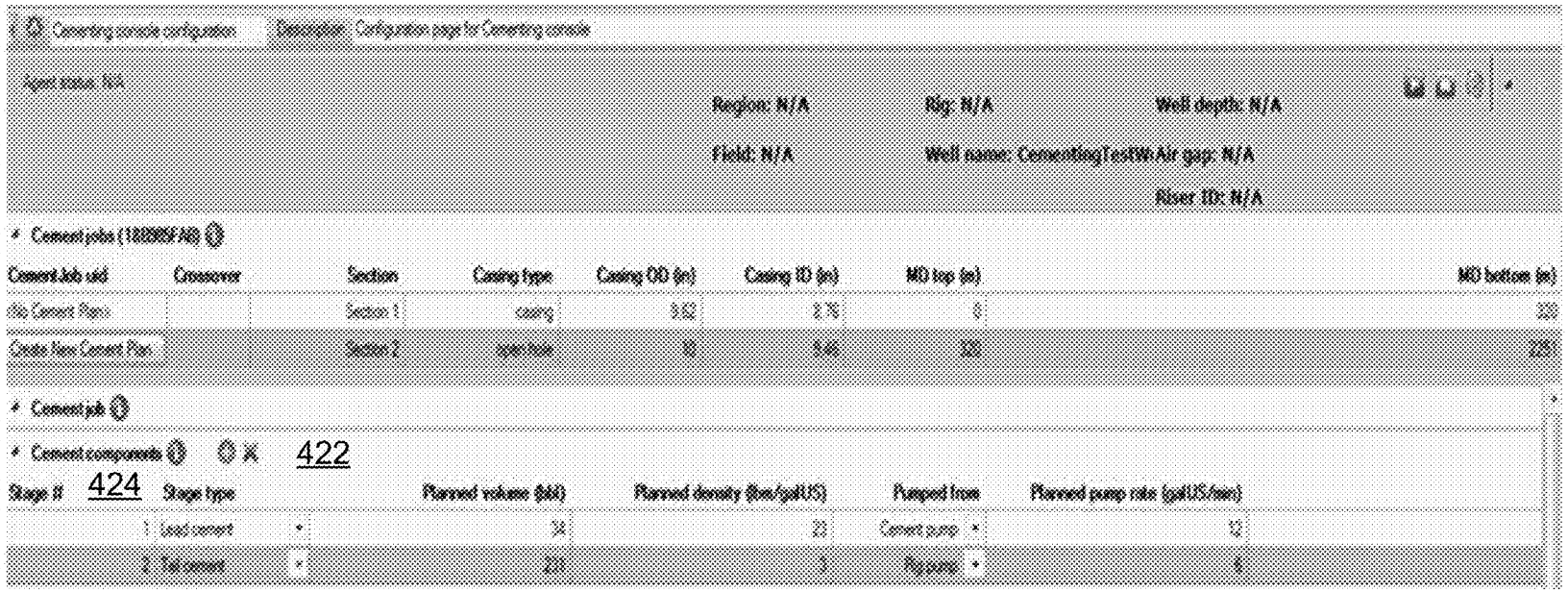
FIG. 36 shows a cement component section from the Cementing Console configuration display.

Clicking the "Create New Cement Plan" button 420 enables the user to create and configure the cement plan, and also configure the cementing smart agent. The cement plan is configured in the "cement component" section 422 of the configuration screen, as seen in FIG. 36. Components can be added or removed by clicking the appropriate buttons or icons (in one embodiment, a green "+" button is used to add components, and a red "X" button is used to delete components).

Figure 37:
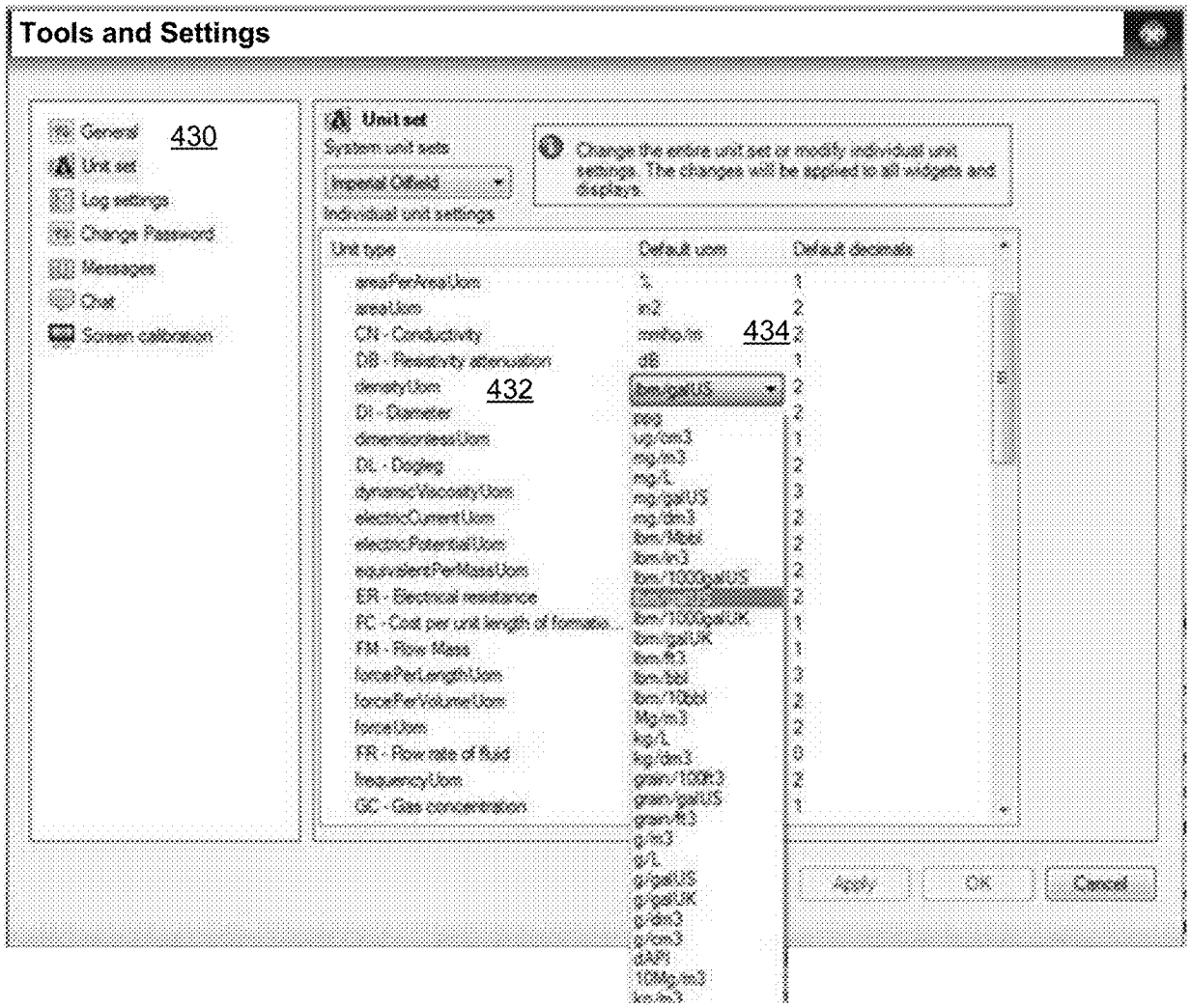
FIG. 37 shows an example of a tools and settings options menu.

The "Stage #" column 424 indicates the order in which the components will be pumped in the cementing job (e.g., starting with 1). For each component, at least the following parameters must be input: component or stage type, planned volume, planned density, the pump the component will be pumped from, and planned pumped rate. Units for these parameters are displayed in the headers for each column, and are automatically set based upon the global system settings for the user and the type of unit. Users can change the units by using the "Tools and Settings" option from the system menu, and select "Unit set" from the dialog window 430, as shown in FIG. 37. For example, the user can change the planned density unit of measure ("uom") 432 default to the desired units ("lbm/galUS" 434, for example, as seen in FIG. 37), as well as the number of default decimals for the value. Once applied or accepted, the main screen will update accordingly.

Figure 38:
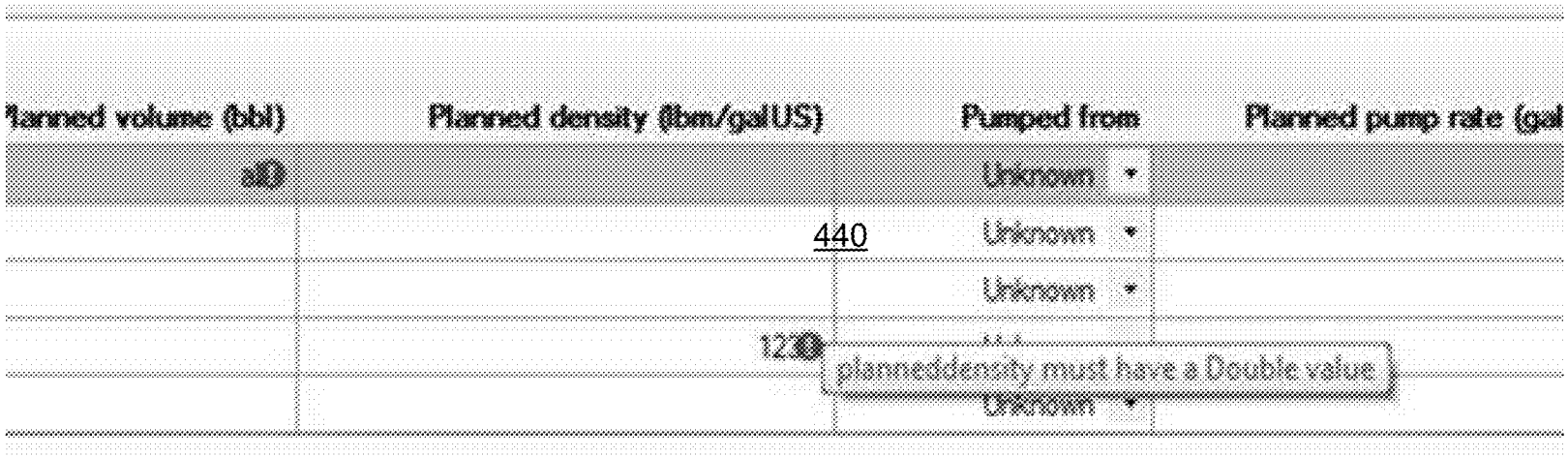
FIG. 38 shows an example of a validity error message.
Figure 39:
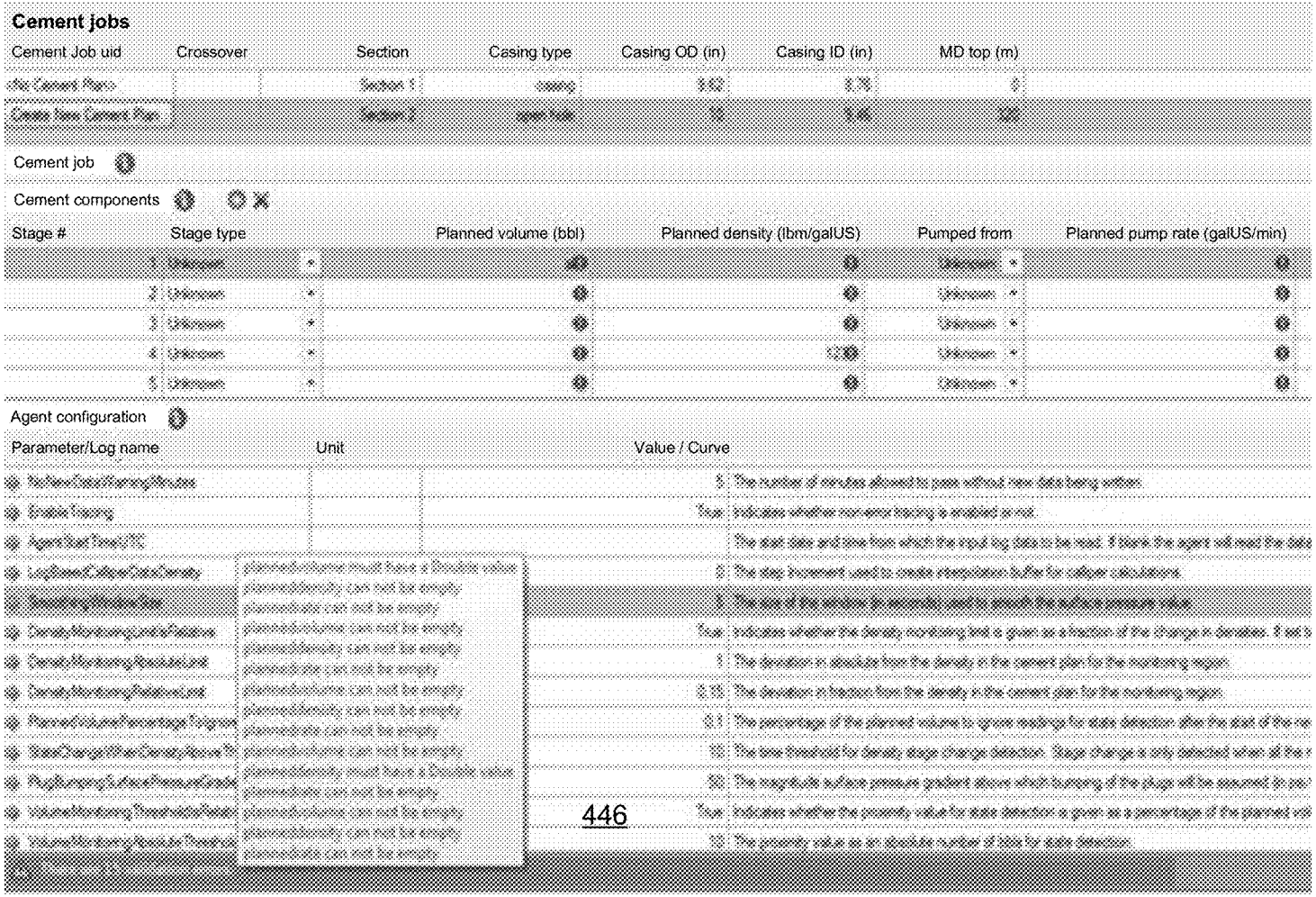
FIG. 39 shows an example of a validity error summary window.

In one embodiment, the unit types (as shown in FIG. 37) for the basic set of cementing components are as follows:

Planned Volume: volumeUom
Planned Density: densityUom
Planned Pump Rate: volumeFlowRateUom
Casing OD: DI—Diameter
Casing ID: DI—Diameter
MD Top: LD—Length and depth Once the user has configured all stages of the cementing job, the validate button is used to check all of the entries to ensure validity. As seen in FIG. 38, an error icon (in this example, an exclamation point 440, although other icons can be used), is displayed in the cell or cells that contain errors. A short error message can be displayed by hovering the mouse or pointer over an icon. As seen in FIG. 39, a summary total of validation errors is displayed in the status information bar 446 at the bottom of the screen. Hovering the mouse or pointer over this status bar will display the error messages for all validation errors.

After correcting the errors, the user can re-validate the input, and then save the cement job configuration.

Figure 40:
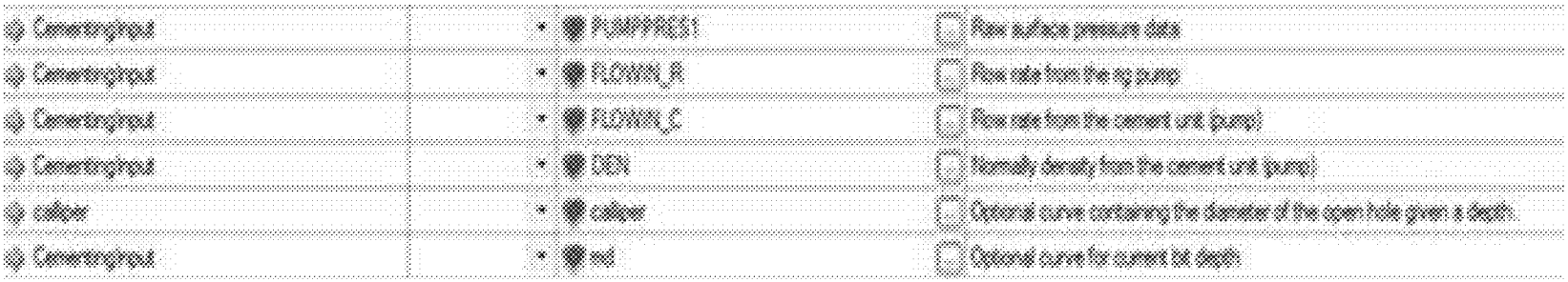
FIG. 40 shows an input source data selection grid from the agent configuration section of the Cementing Console configuration display.
Figure 41:
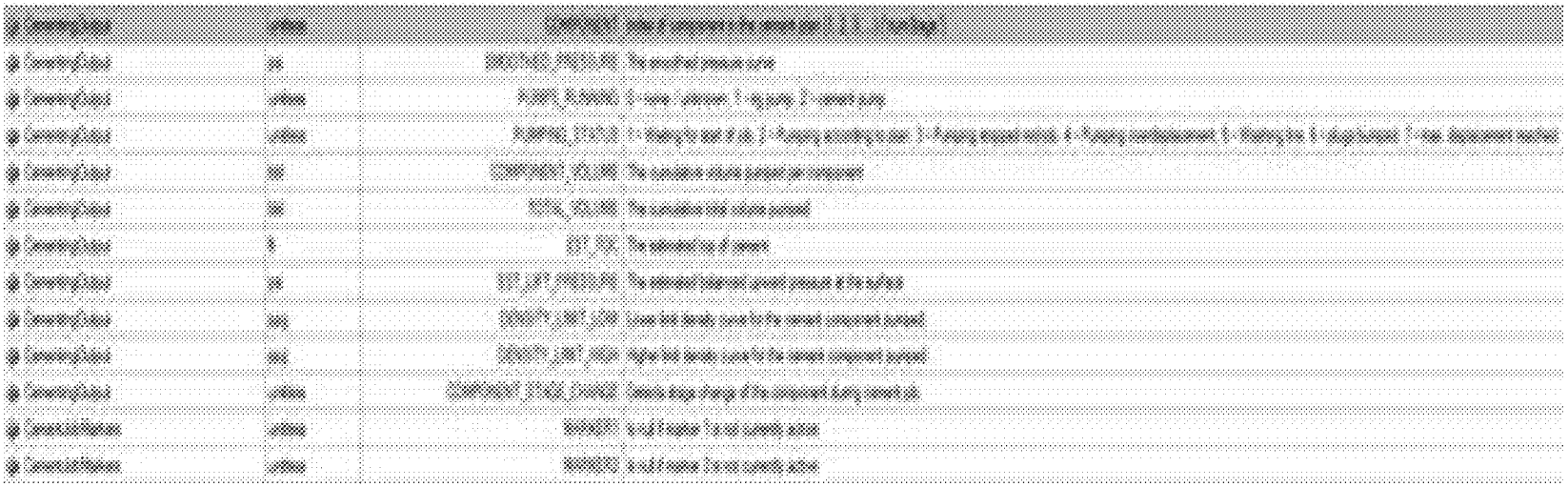
FIG. 41 shows an output data selection grid from the agent configuration section of the Cementing Console configuration display.

The cementing smart agent is configured in the "agent configuration" section of the screen. There are several types of configuration data displayed. Parameters (indicated by orange arrows in this example) are input variable to the smart agent. In the input sections (indicated by green arrows in this example), the user selects the input source data for the agent (see FIG. 40). The output data section (indicated by blue arrows in this example) shows all the outputs from the smart agent (see FIG. 41). In the embodiment shown, the outputs are static, and do not need to be configured.

Figure 42:
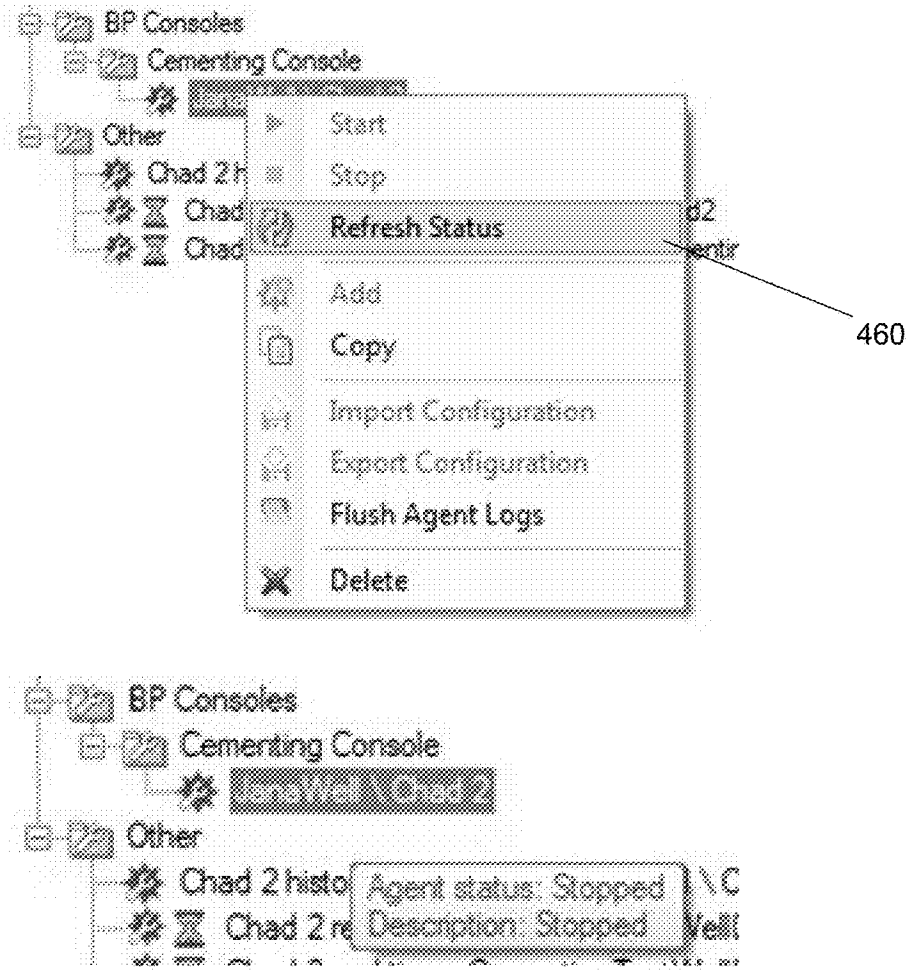
FIG. 42 shows an example of the smart agent status display.

Once the cement job has been configured, validated and saved, the system replicates the cement plan and configuration to the appropriate servers in the system. After replication, the cementing smart agent can be started and stopped as needed. Once started, the status is updated in the upper left corner of the configuration screen as well as in the tree view (as seen in FIG. 42). The status can be manually refreshed by right clicking the agent node and selecting "Refresh status" 460 in the menu.

Figure 43:
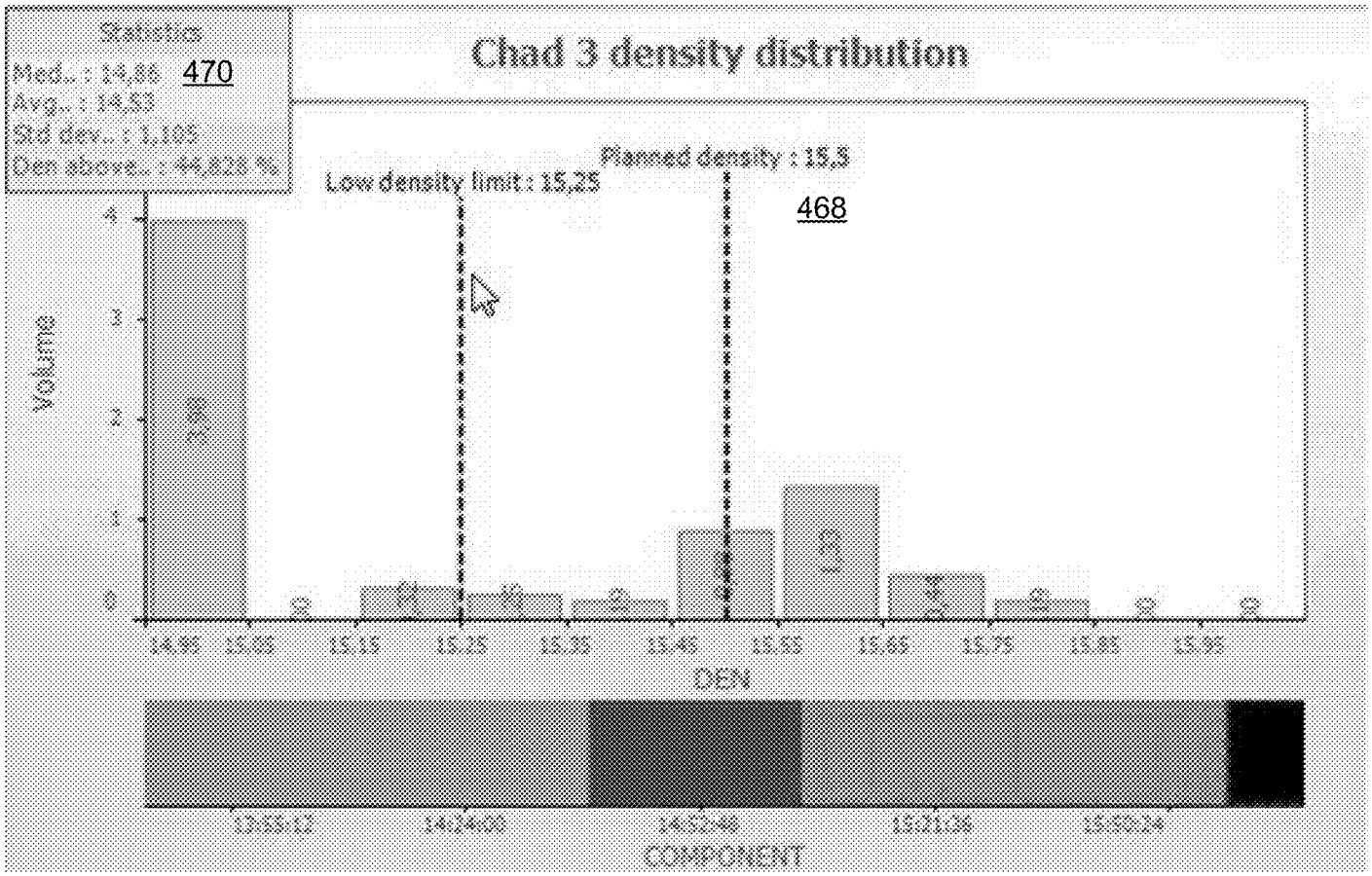
FIG. 43 shows a display produced by the Frequency Analysis Widget.

FIG. 43 shows an example of a visual display provided by the Frequency Analysis Widget. The Frequency Analysis Widget allows the user to do a frequency distribution of data in real-time by monitoring the density of the various fluids that are pumped during the cement job, and measuring those densities against planned densities 468. Several relevant statistics 470 can be calculated and displayed, as shown.

Figure 44A:
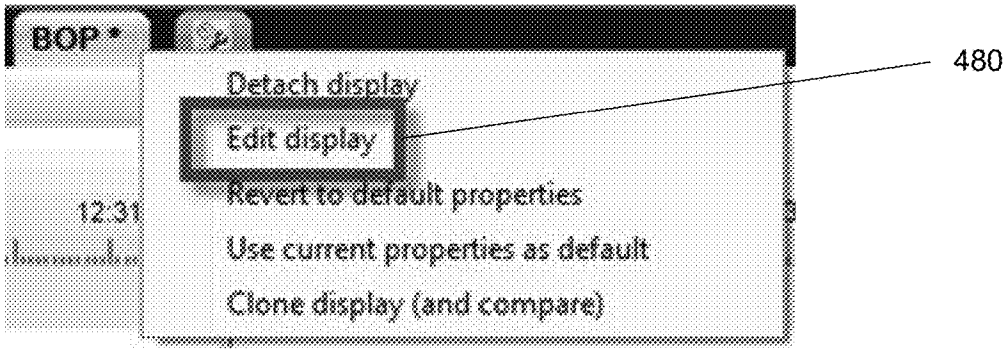
FIG. 44A shows an example of a "edit display" menu.
Figure 44B:
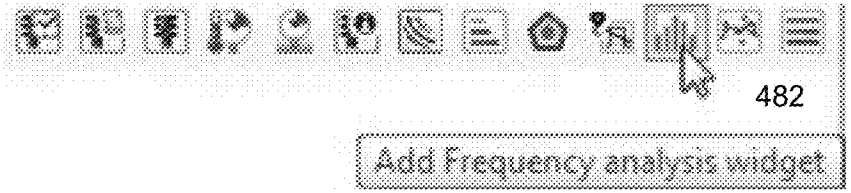
FIG. 44B shows a row of design mode icons.
Figure 45:
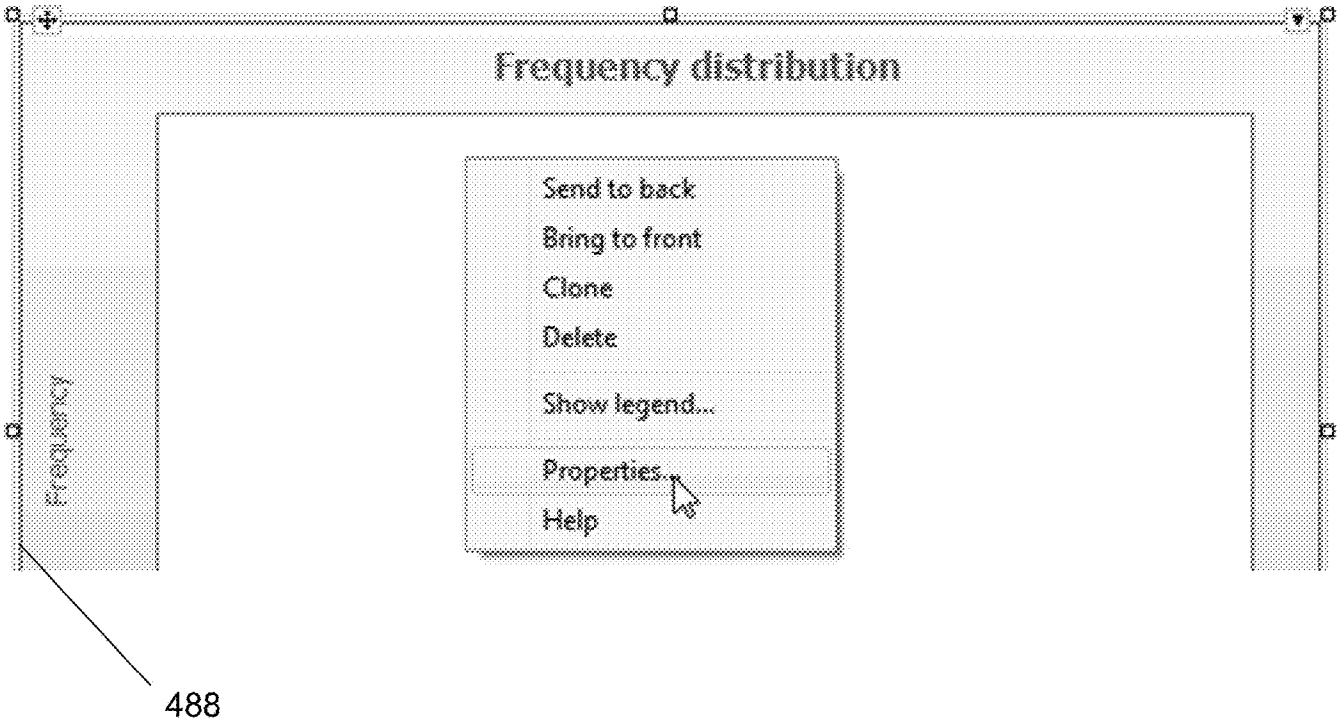
FIG. 45 shows an editable form of the Frequency Analysis Widget display.
Figure 46:
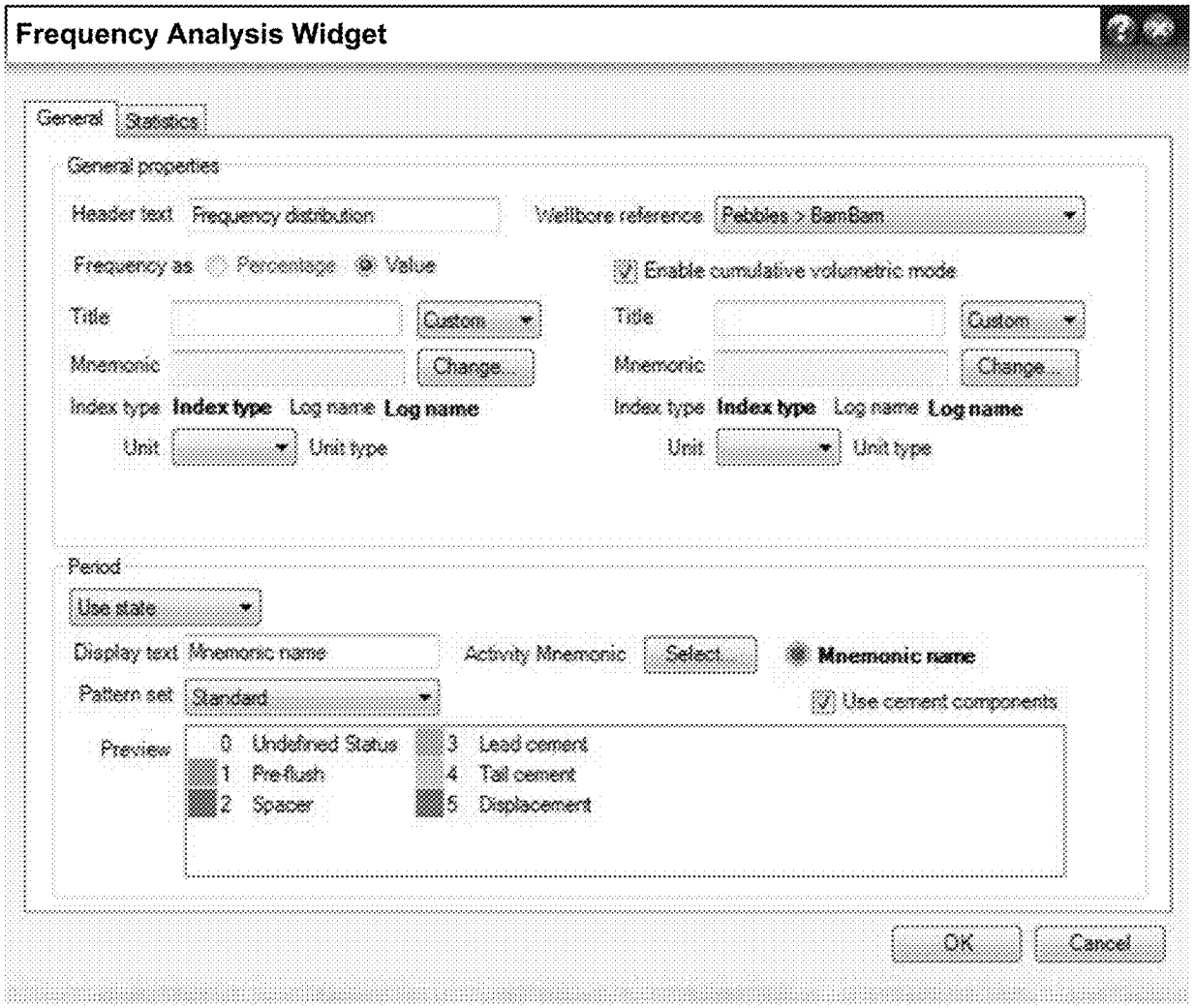
FIG. 46 shows a Frequency Analysis Widget general settings input screen.
Figure 47:
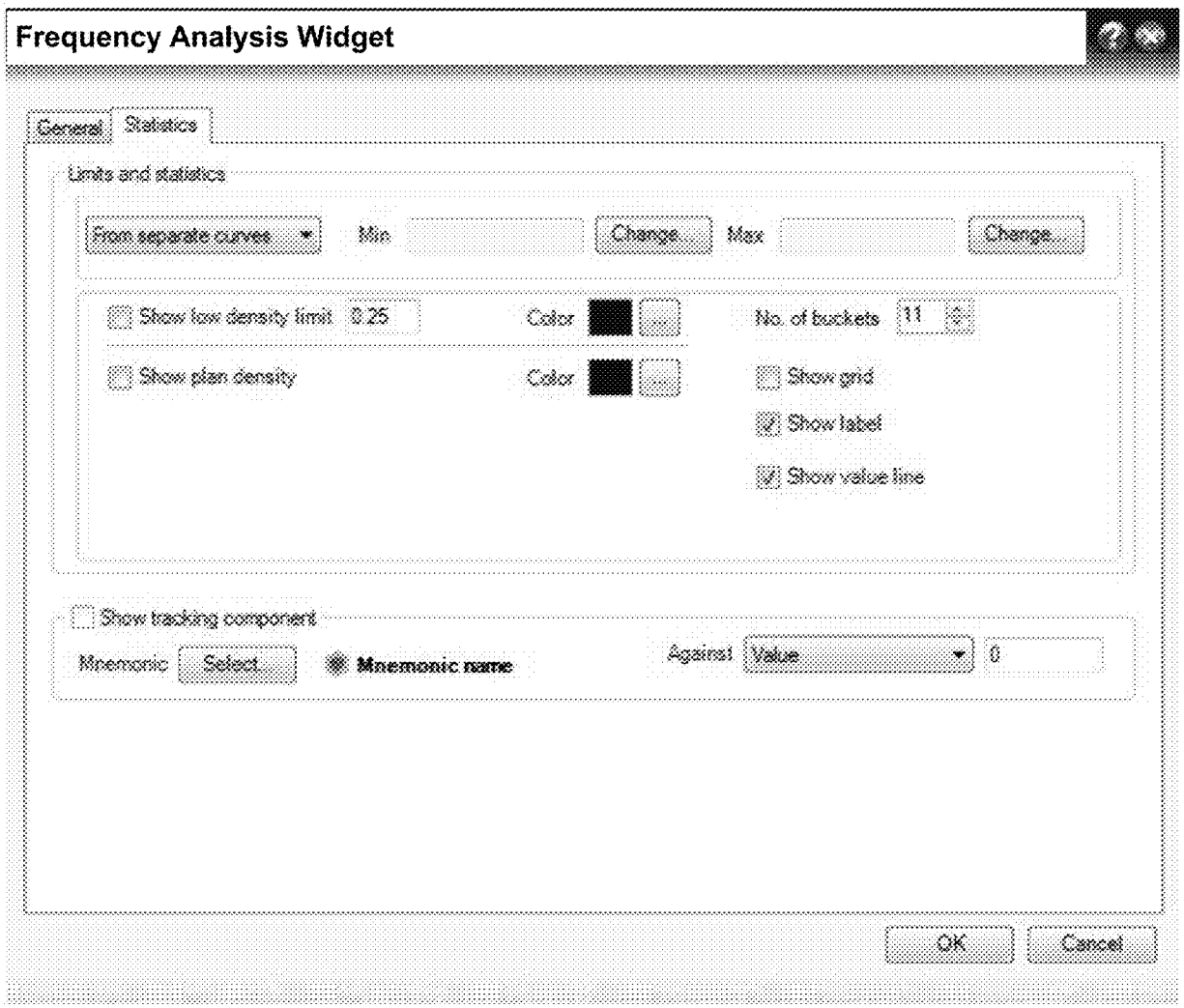
FIG. 47 shows a Frequency Analysis Widget statistics input screen.

In one embodiment, the Frequency Analysis Widget may be configured through the Properties dialog, which may be accessed by right-clicking on the display tab and selecting "Edit display," 480 as seen in FIG. 44A. A row of design mode icons is presented, and the user can then select the Frequency Analysis Widget icon 482, as seen in FIG. 44B. This causes an editable form of the widget to appear (in the embodiment shown in FIG. 45, a red line 488 appears around the widget display, indicating it can be edited). Right-clicking in the widget and selecting "Properties" in the menu displays the "General" and "Statistics" tabs, as seen in FIGS. 46 and 47.

Figure 48:
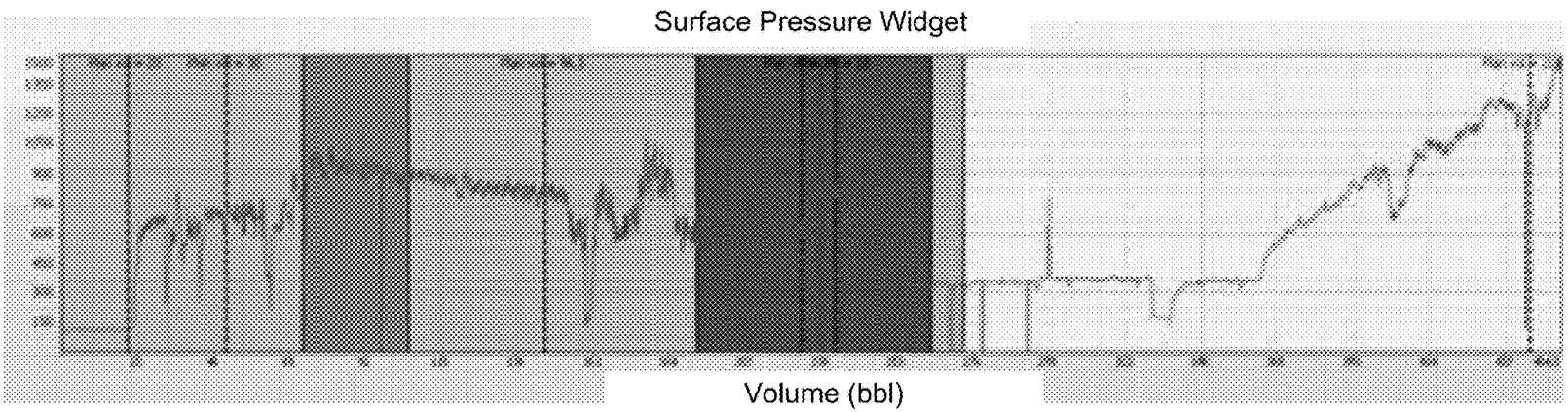
FIG. 48 shows a display produced through the Plan Tracking Widget.

The Plan Tracking Widget allows the user to compare real-time data curves against planned curves. The data can be monitored based on elapsed time or cumulative volume. The Plan Tracking Widget is used to set up the Cumulative Volume Widget, Pumping Schedule Widget, and Surface Pressure widgets, examples of which are seen in FIGS. 29 and 48 (and described elsewhere herein). The Plan Tracking Widget can run with the cementing agent output, although it also can be run without it.

Figure 49A:
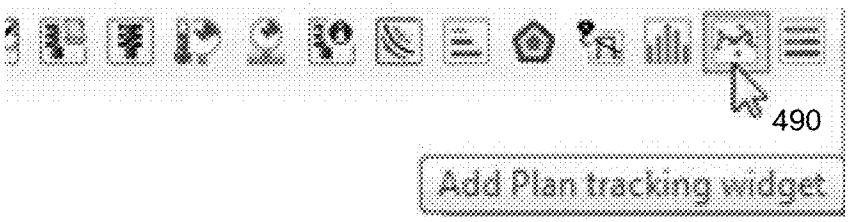
FIG. 49A shows a row of design mode icons.
Figure 49B:
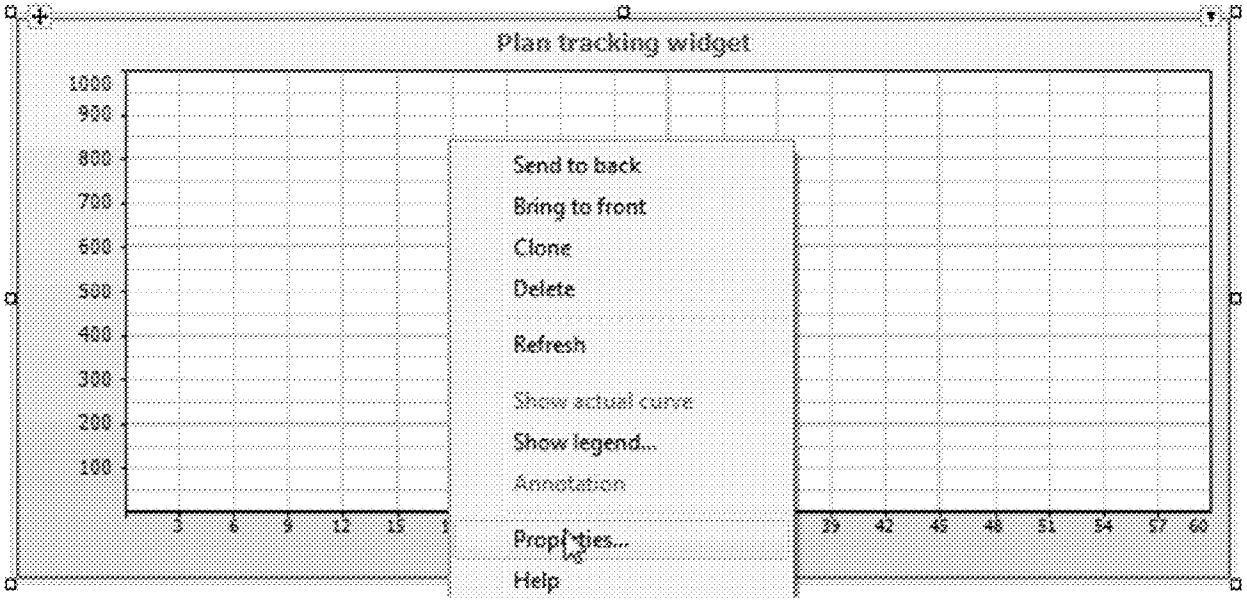
FIG. 49B shows an editable form of the Plan Tracking Widget.
Figure 50:
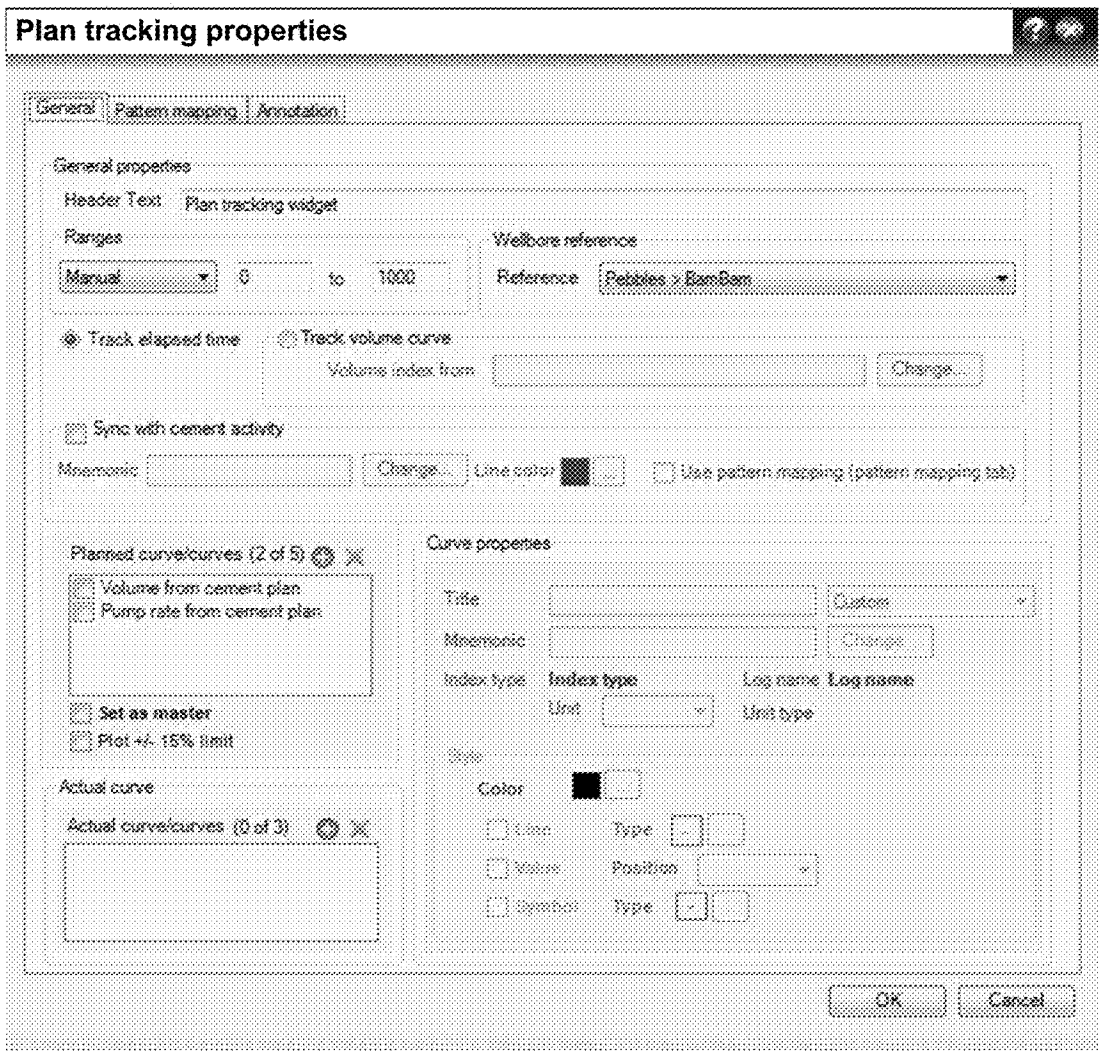
FIG. 50 shows a Plan Tracking Widget general settings input screen.
Figure 51:
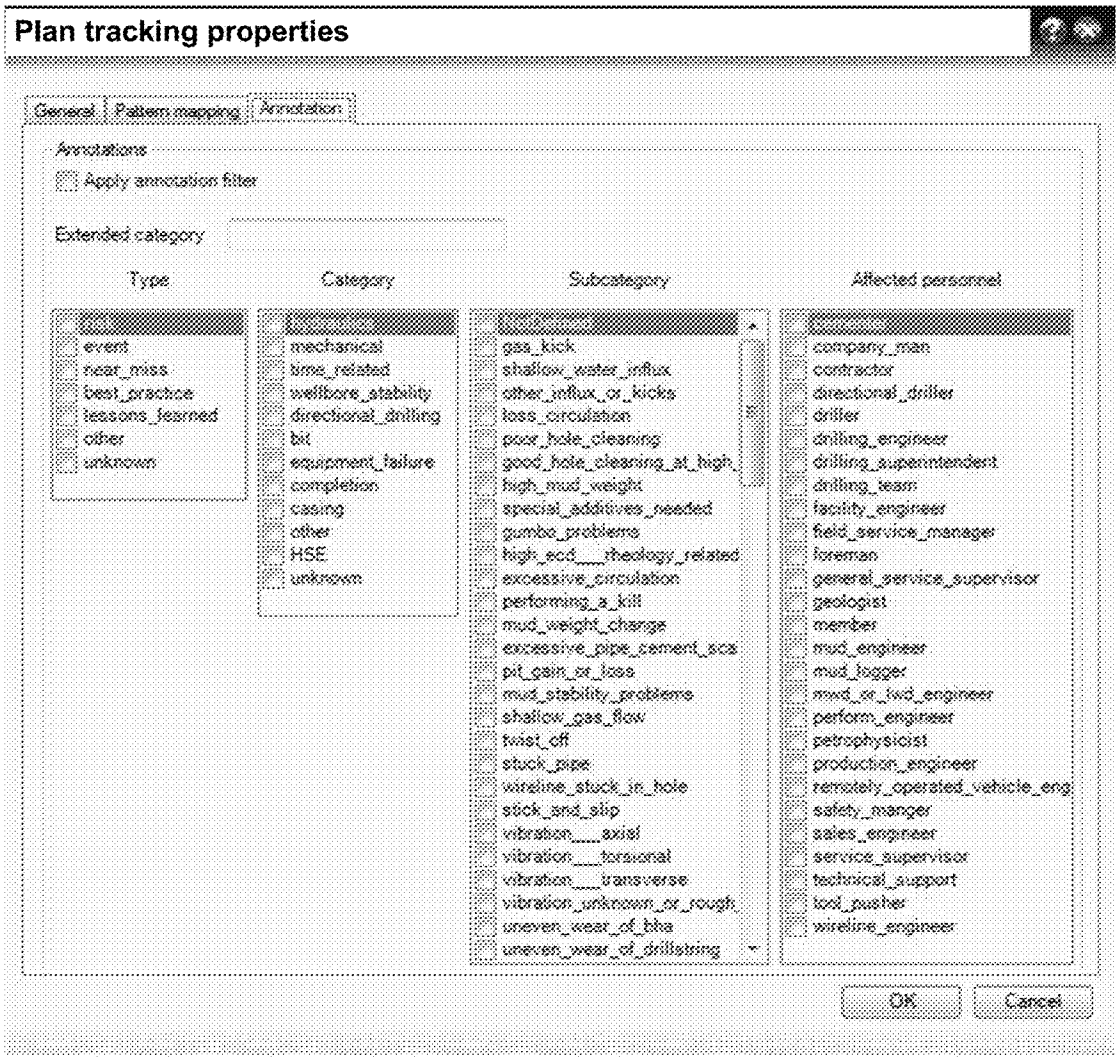
FIG. 51 shows a Plan Tracking Widget annotation input screen.

The Plan Tracking Widget may be configured through the Properties dialog in a similar manner to the Frequency Analysis Widget (i.e., select "Edit display" and select the Plan Tracking Widget icon 490, as seen in FIG. 49A). The editable form of the Plan Tracking Widget is shown in FIG. 49B. Selecting "Properties" from the menu displays the "General" and "Annotation" tabs, as seen in FIGS. 50 and 51.

If the "sync with cement activity" option is selected, the widget will automatically start drawing real-time data when the cementing smart agent has detected that the cement job has started. It also will annotate the widget displays in the form of background colors representing the various cement components being pumped. If it is not selected, the user can manually start the real-time plot by selecting the "Show actual curve" option from the context menu, and the widget will plot real-time data from that moment. If the "sync with cement activity" option is selected, the "Pattern mapping" tab or page also become enabled. This allows the user to select the pattern mapping to use.

Figure 52:
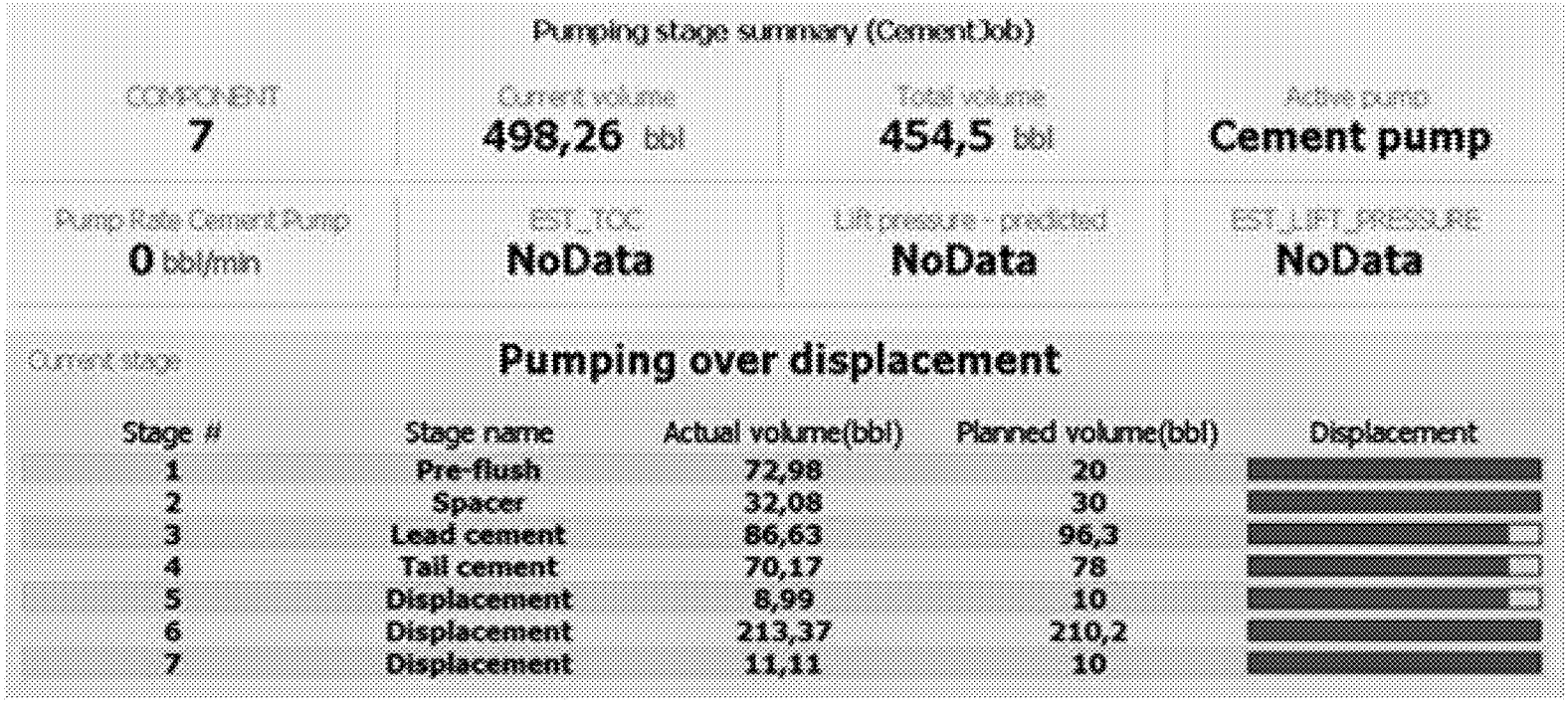
FIG. 52 shows a display produced by the Pumping Stage Widget.

FIG. 52 shows an example of a visual display provided by the Pumping Stage Widget, which gives an overview of the cement job and tracks the volume pumped for each component. It also displays information about what pump is currently being used, and the current state of the cement job. Each of the value sections at the top of the display can be customized to show any real-time data, some of which is obtained from the cementing smart agent by default.

Figure 53A:
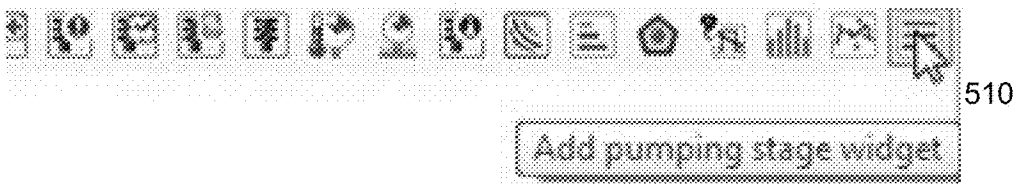
FIG. 53A shows a row of design mode icons.
Figure 53B:
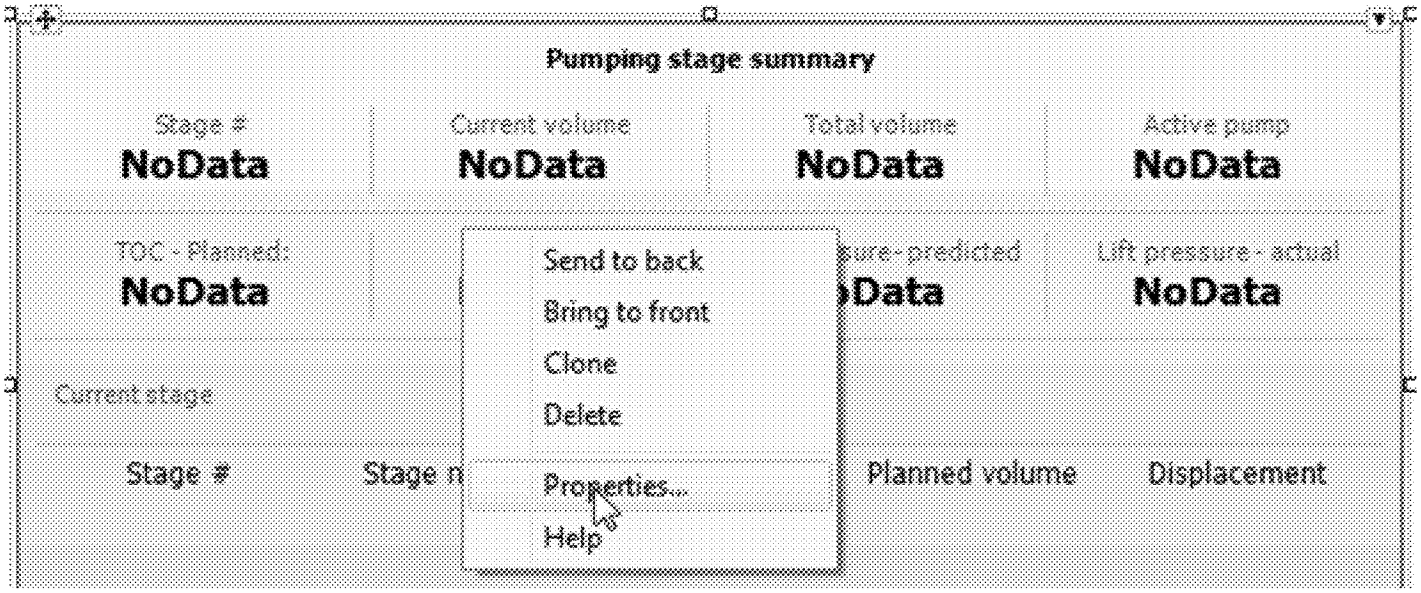
FIG. 53B shows an editable form of the Pumping Stage Widget.
Figure 54:
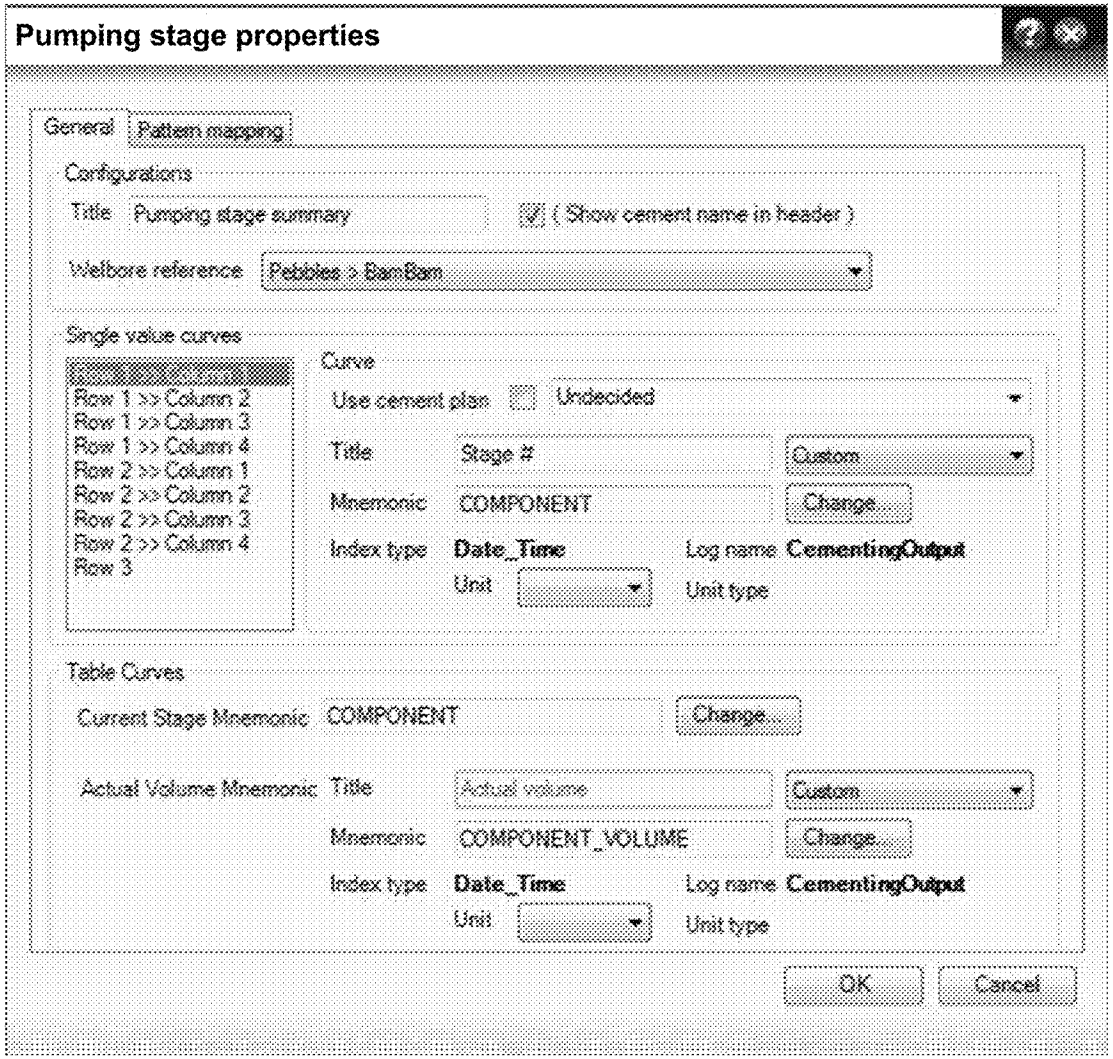
FIG. 54 shows a Pumping Stage Widget general settings input screen.
Figure 55:
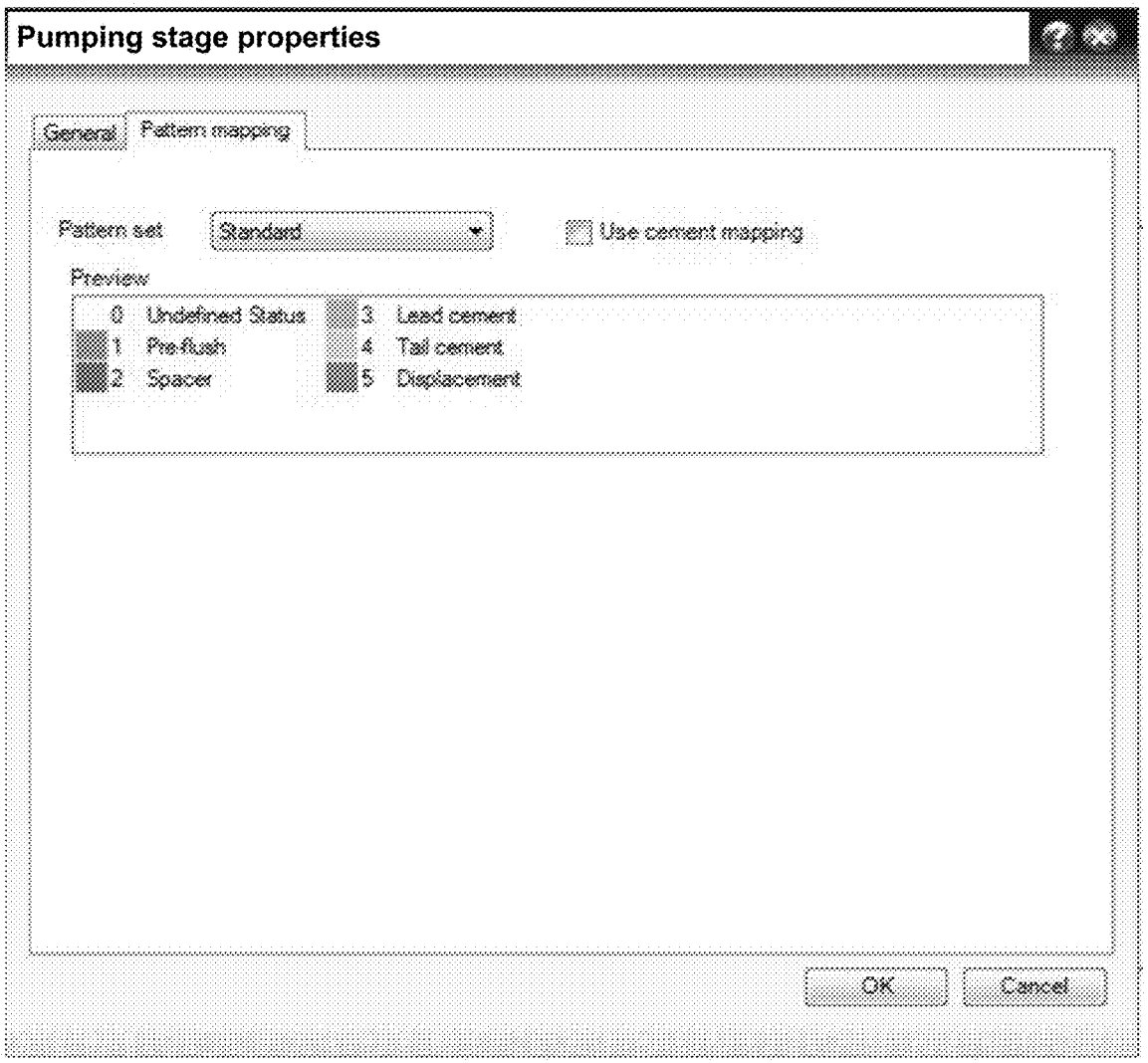
FIG. 55 shows a Pumping Stage Widget pattern mapping screen.

The Pumping Stage Widget may be configured through the Properties dialog in a similar manner to the Frequency Analysis Widget (i.e., select "Edit display" and select the Pumping Stage Widget icon 510, as seen in FIG. 53A). The editable form of the Pumping Stage Widget is shown in FIG. 53B. Selecting "Properties" from the menu displays the "General" and "Pattern Mapping" tabs, as seen in FIGS. 54 and 55.

If "Use cement mapping" is chosen as an option, the widget will use colors in the mapping file to file in the displacement volumes in the widget display. If the volume exceeds the planned volume, a red rectangle (or other warning indicator) is displayed on the end of the displacement bar. If not chosen as an option, the widget display will use a green color while the volume is less than the planned volume, as seen in FIG. 52. If the volume exceeds the planned volume, the displacement bar will turn red. Other forms of indicating a volume-exceeded condition may be used.

Figure 56:
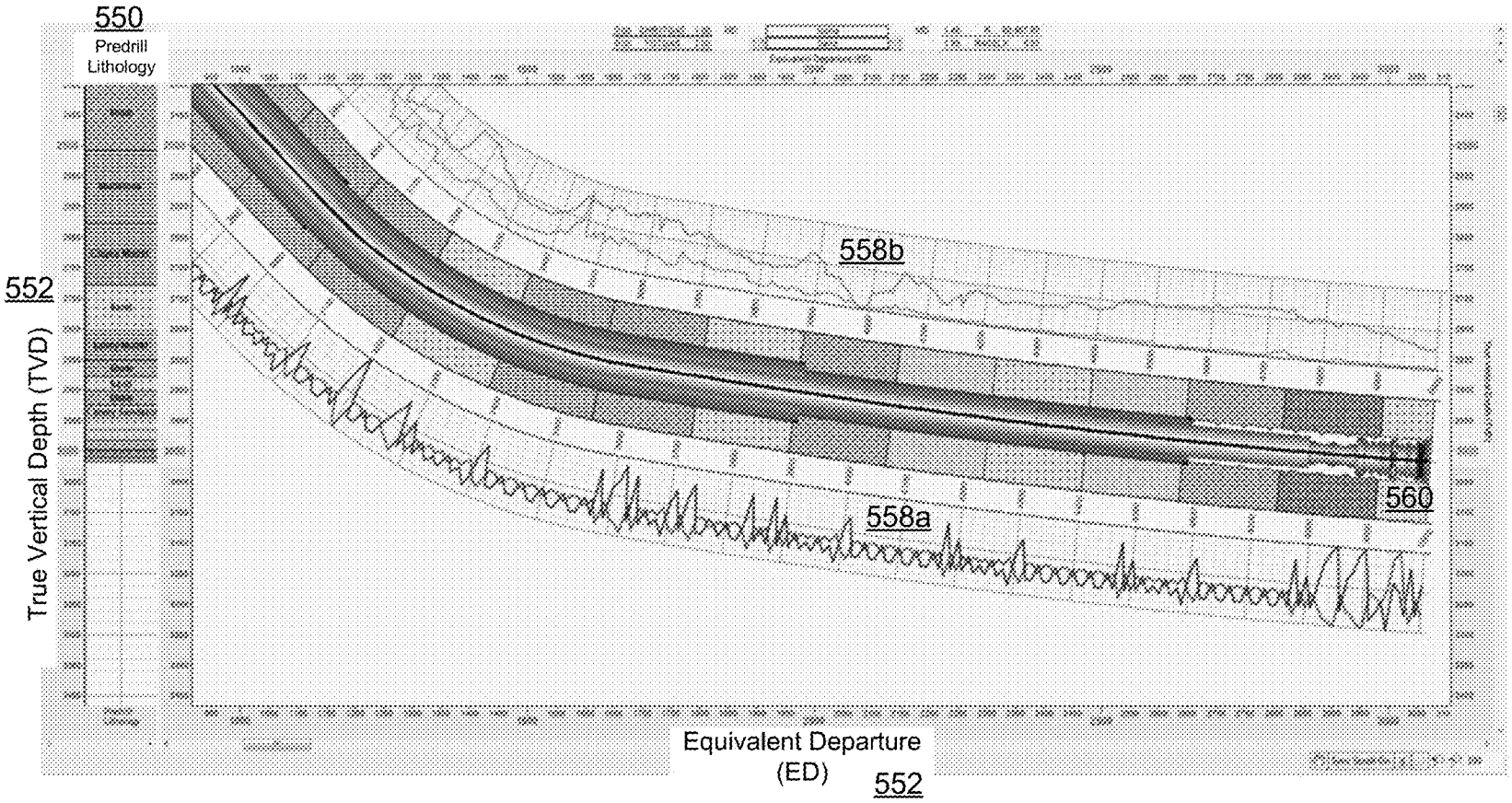
FIG. 56 shows a display produced by the 2D Wellbore Schematic Widget.

FIG. 56 shows an example of a visual display provided by the 2D Wellbore Schematic Widget. This widget allows drilling and cementing activities to be visualized in real time. In the example shown, a vertical track showing lithography 550 is on the left, and the two-dimension view of the wellbore. In one embodiment, the two-dimensional display has a horizontal scale of equivalent departure ("ED") 552 and a vertical scale of true vertical depth 554. The display comprises two outer deviated log tracks 558*a, b*, and a central inner track 560 that displays lithography, well-bore geometry, tubular components, the drill bit and string, caliper (representing the diameter of the hole while being drilled), and annotations (as overlaid view).

Figure 57A:
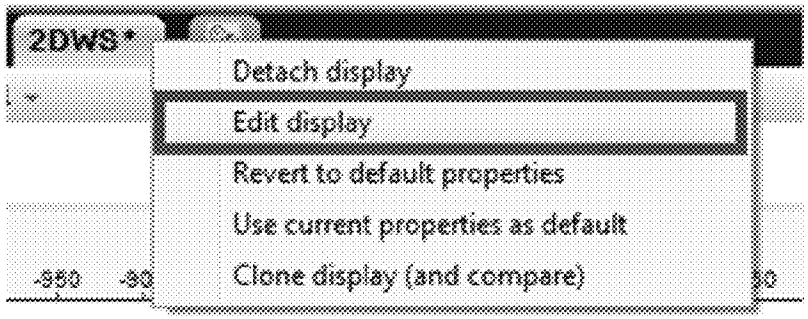
FIG. 57A shows an example of a "edit display" menu.
Figure 57B:
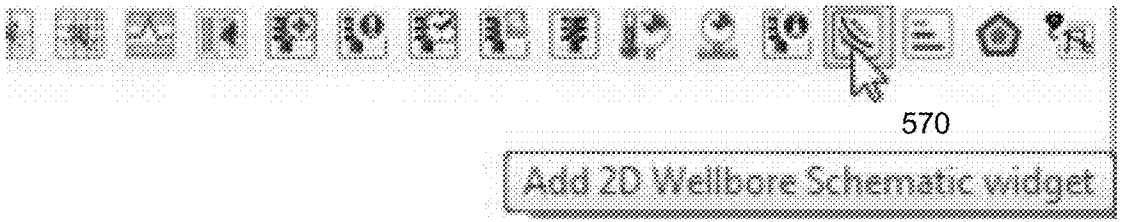
FIG. 57B shows a row of design mode icons.
Figure 58:
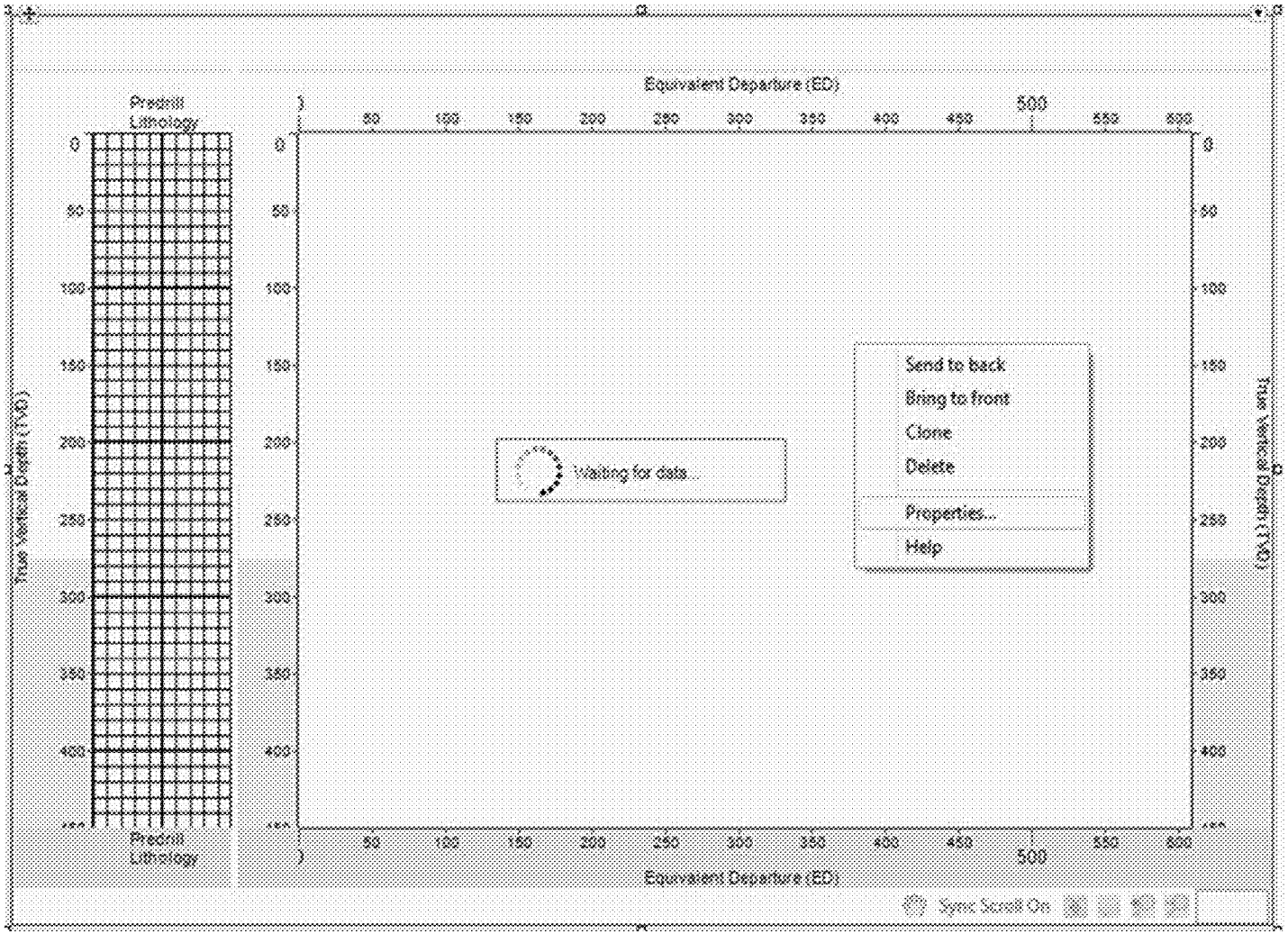
FIG. 58 shows an editable form of the 2D Wellbore Schematic Widget display.
Figure 59:
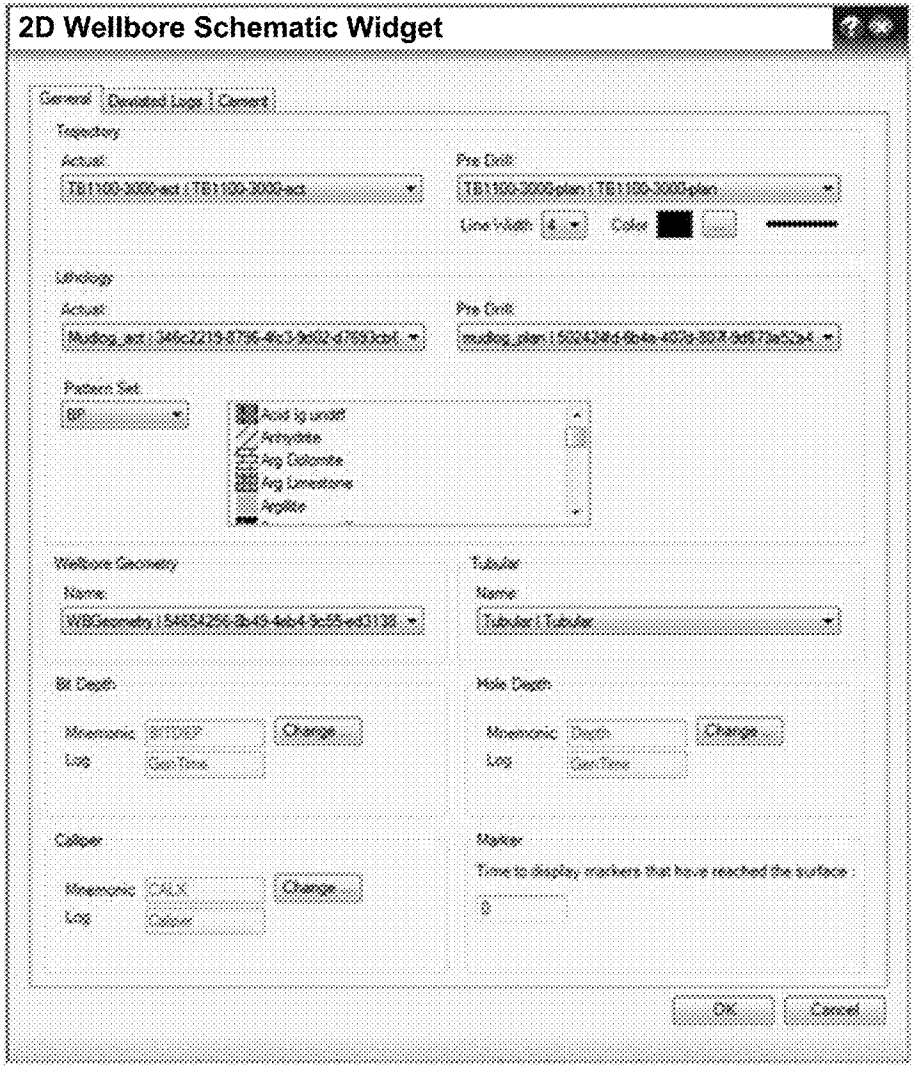
FIG. 59 shows a 2D Wellbore Schematic Widget general settings input screen.
Figure 60:
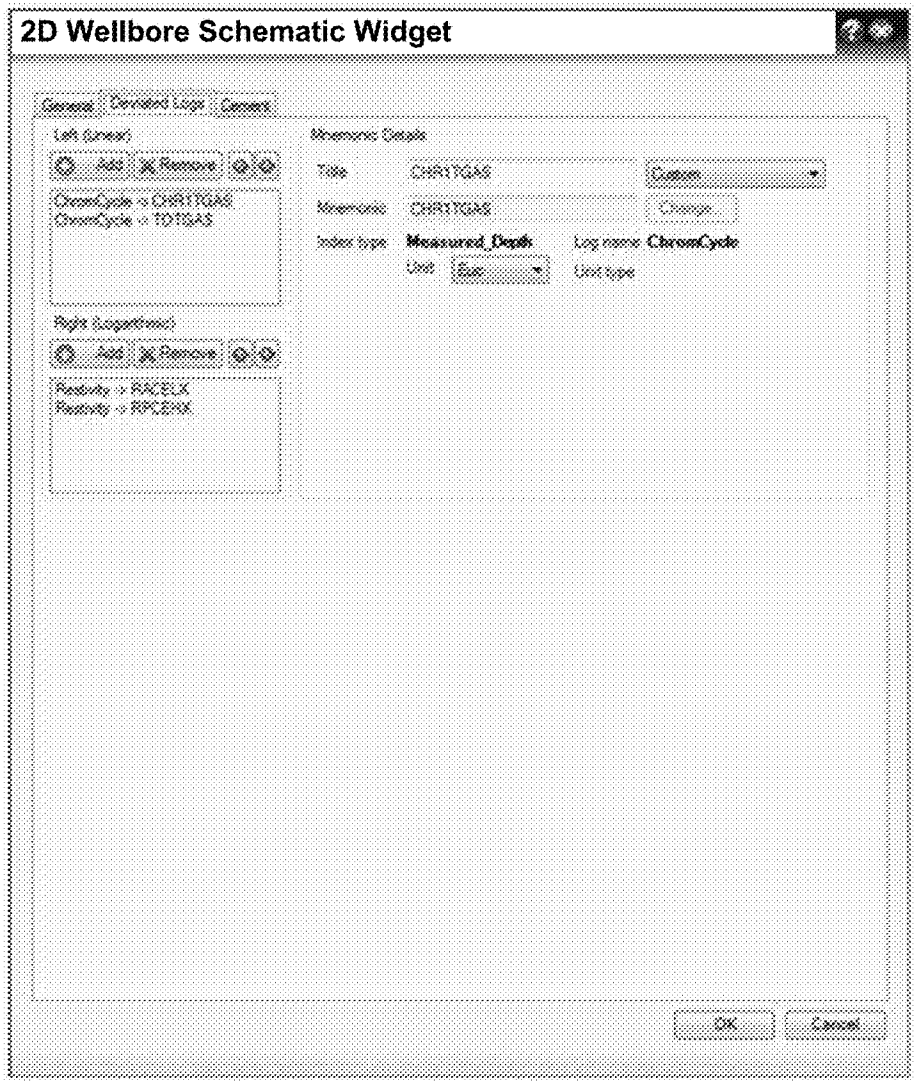
FIG. 60 shows a 2D Wellbore Schematic Widget deviated logs screen.
Figure 61:
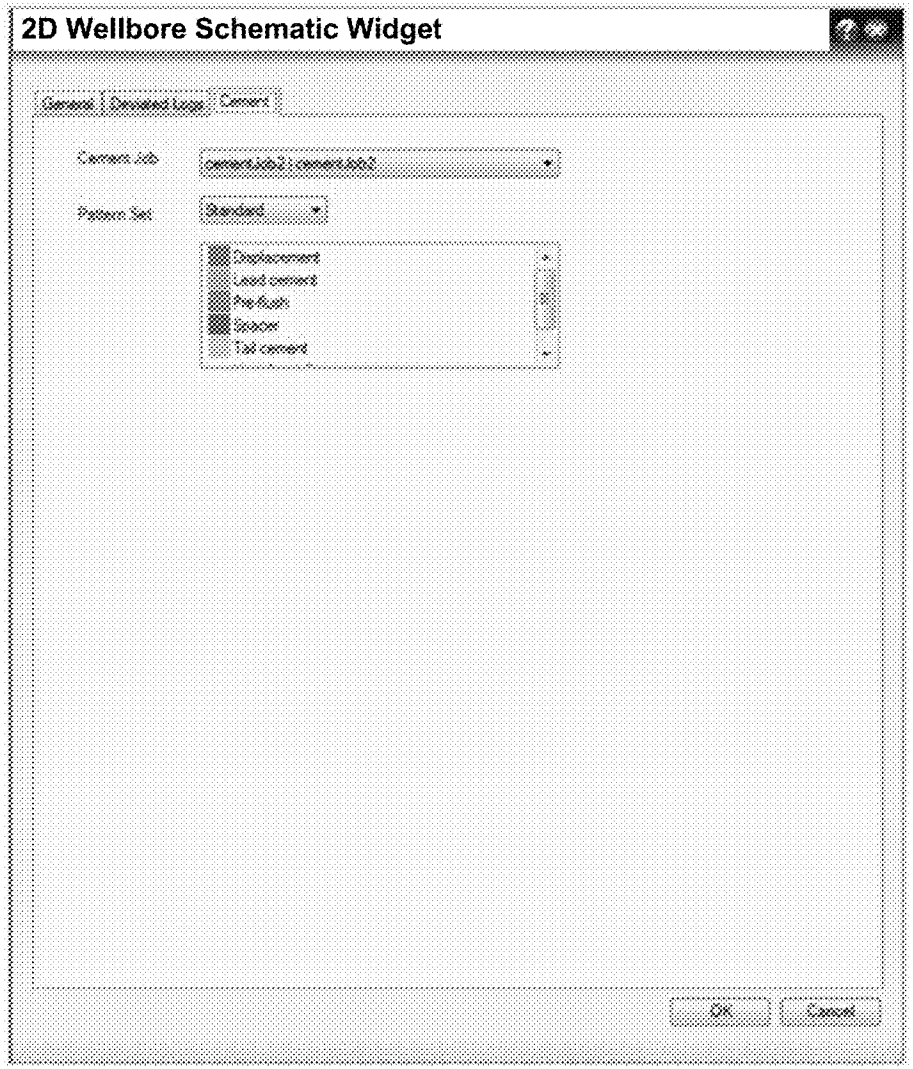
FIG. 61 shows 2D Wellbore Schematic Widget cement screen.

The 2D Wellbore Schematic Widget may be configured through the Properties dialog in a similar manner to the Frequency Analysis Widget and other widgets described above (i.e., select "Edit display" and select the 2D Wellbore Schematic Widget icon 570, as seen in FIGS. 57A and B). The editable form of the 2D Wellbore Schematic Widget is shown in FIG. 58. Selecting "Properties" from the menu displays the "General," "Deviated Logs," and "Cement" tabs, as seen in FIGS. 59-61.

The cementing phase can be activated once a drilling phase is finished and a cement job is starting. The cement is represented by colored sections (e.g., rectilinear) that move down inside the tubular components while descending, and outside the tubular components and inside the caliper curve when ascending. This is updated in real-time, allowing the user to visually monitoring the progress of the cementing job in relation to the wellbore. Multiple cement components can be represented.

Figure 62:
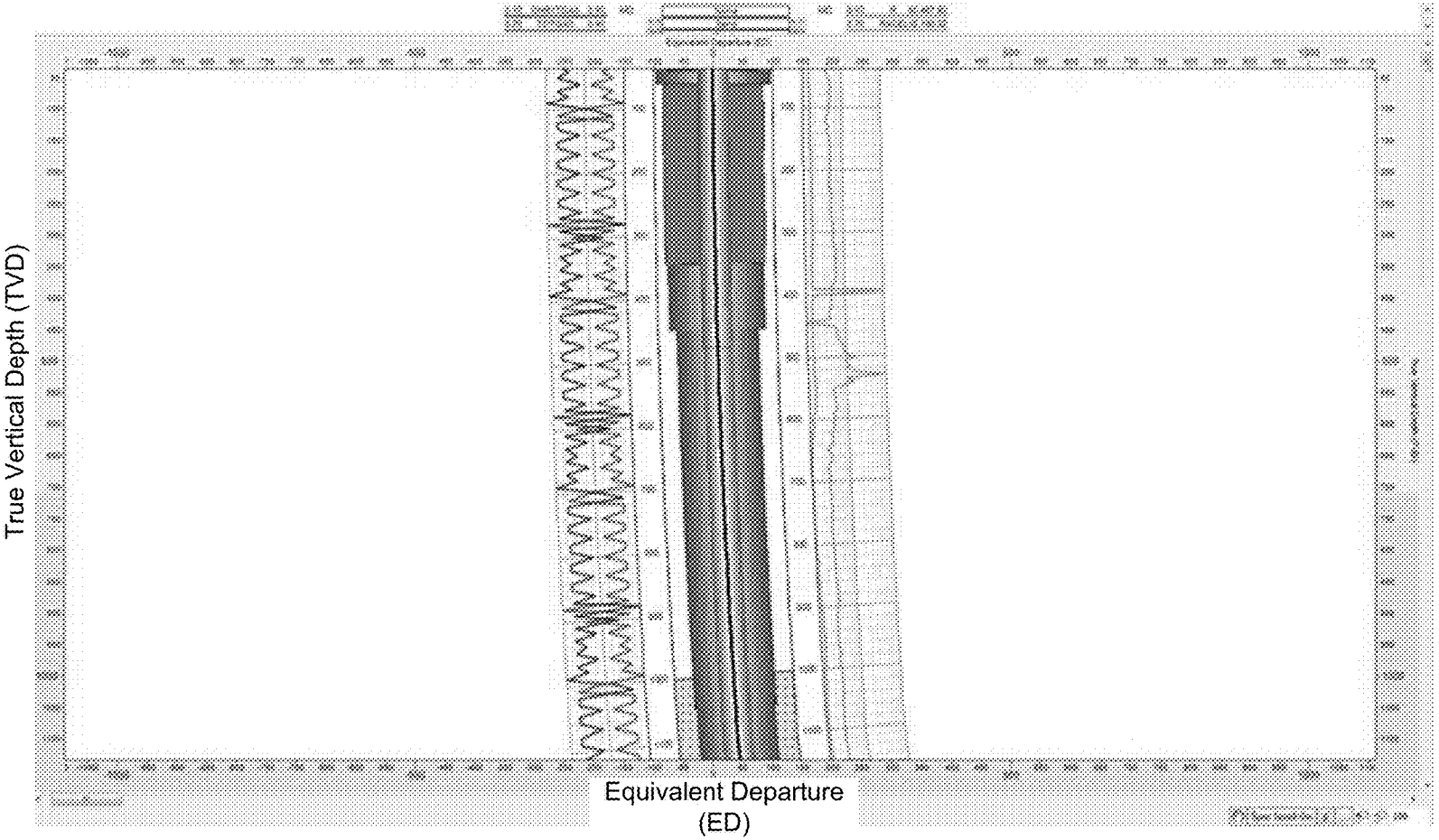
FIG. 62 shows an example of a 2D Wellbore Schematic Widget display zoomed in to the top of a wellbore.
Figure 63:
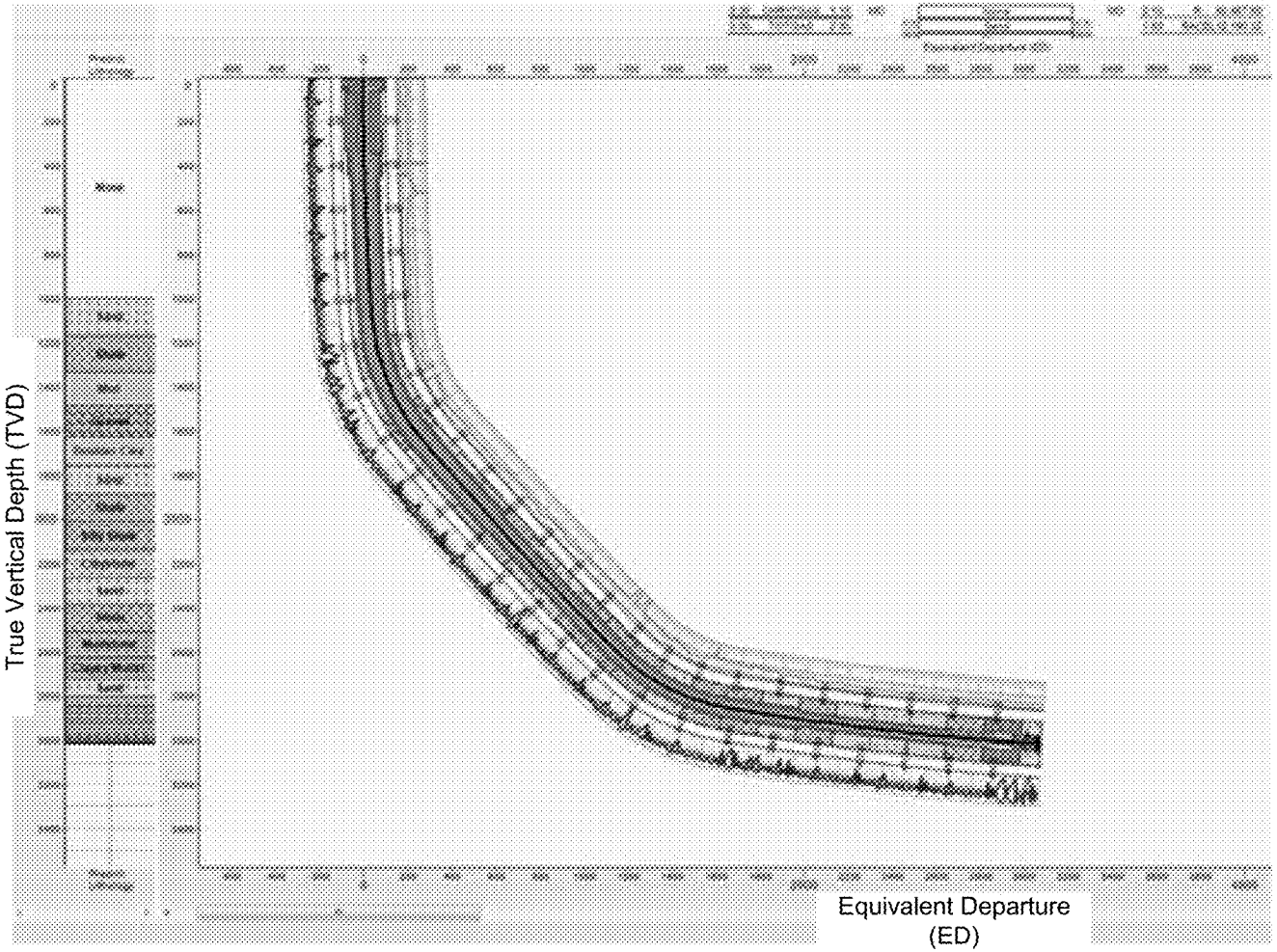
FIG. 63 shows an example of a 2D Wellbore Schematic Widget display zoomed out to show the entire wellbore.
Figure 64:
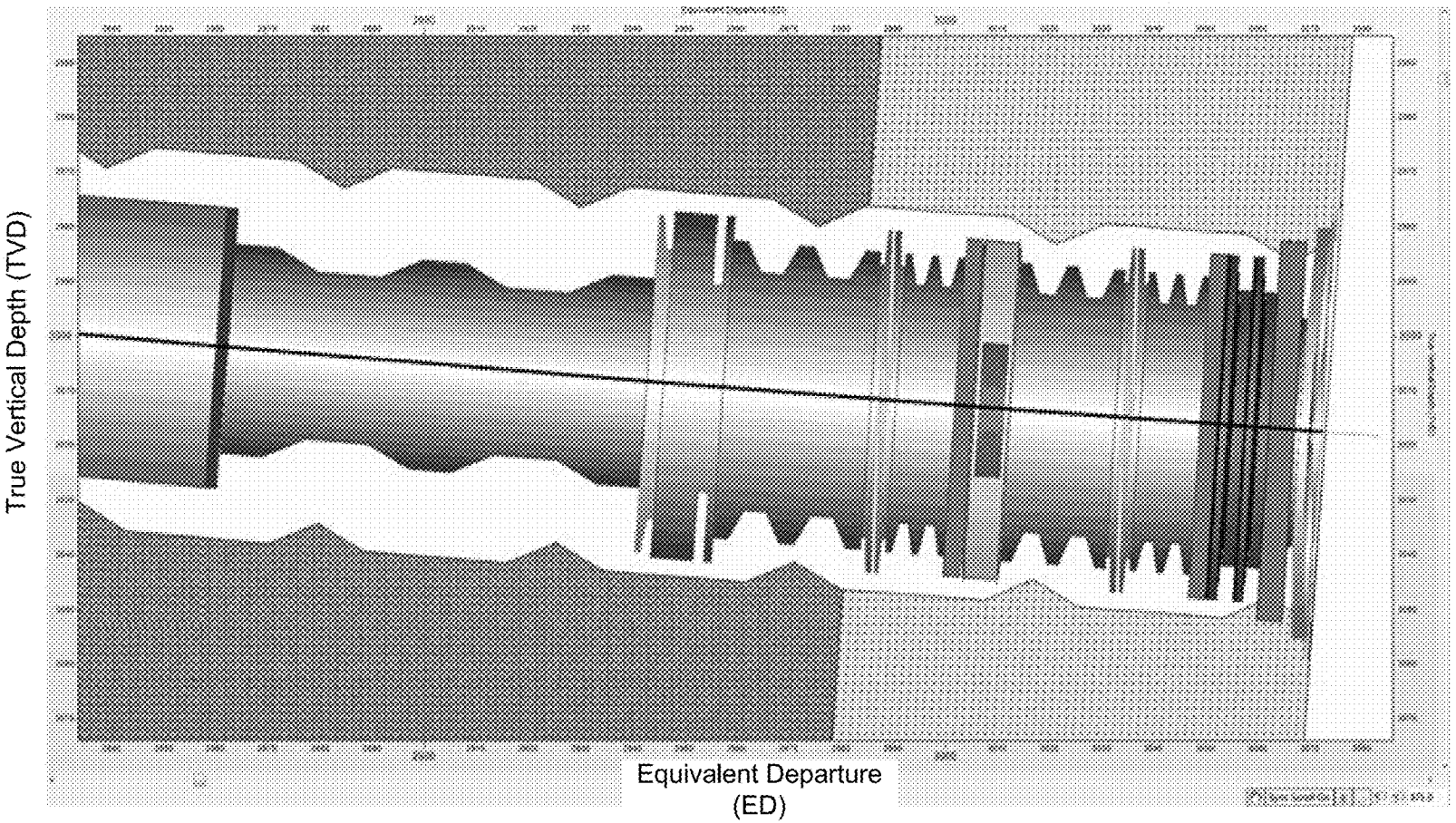
FIG. 64 shows an example of a 2D Wellbore Schematic Widget display zoomed in to the bottom of a wellbore to show the bottom hole assembly.

The user can actively manipulate the widget display, allowing panning, scrolling, zooming or similar actions. Examples of the display using these functions are shown in FIGS. 62 (zoomed in to top of well), 63 (zoomed out to show entire wellbore), and 64 (zoomed into the bottom hole assembly).

Rig Site Fluid Management Console

Figure 65:
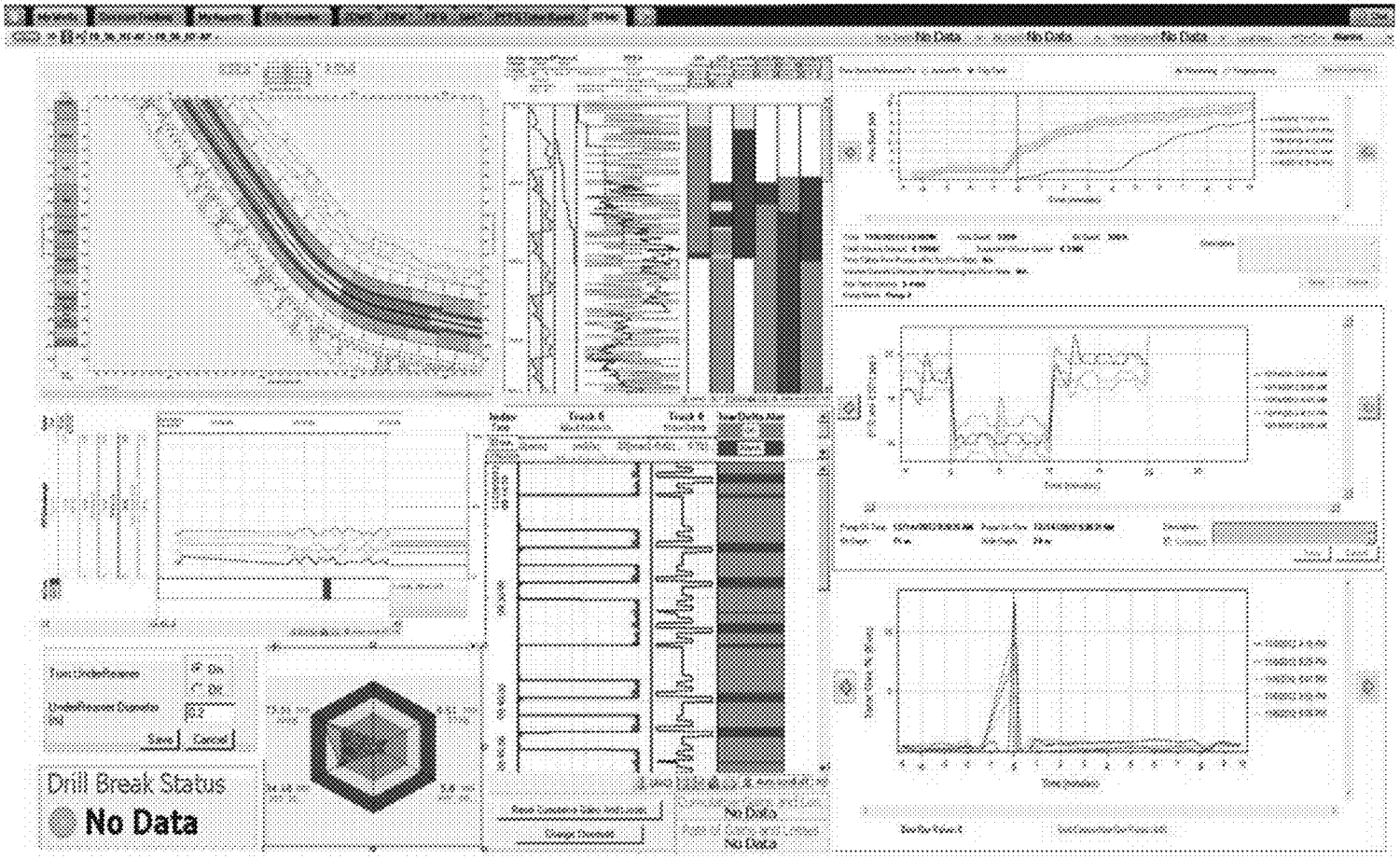
FIG. 65 shows a Rig Site Fluid Management Console display screen.

The GUI display for an embodiment of a Rig Site Fluid Management Console is shown in FIG. 65. The Rig Site Fluid Management Console is used to monitor real-time data to provide early warnings and intelligence to users during all drilling and well construction activities and operations. More particularly, the console aggregates and presents the data in manner to assist a user to visualize and interpret the data, and identify and predict fluid gains and losses during operations. In the embodiment shown, the Rig Site Fluid Management Console comprises smart agents and nine widgets (2D Wellbore Schematic, Zone, Gas Monitor, Flow Back, Pressure While Drilling, Fluid Monitoring Configuration, Log Widget Template configurations, Pore Pressure Fracture Gradient Look-Ahead, and Under Reaming).

The Zone Widget and 2D Wellbore Schematic Widgets have been discussed in detail above.

Figure 66:
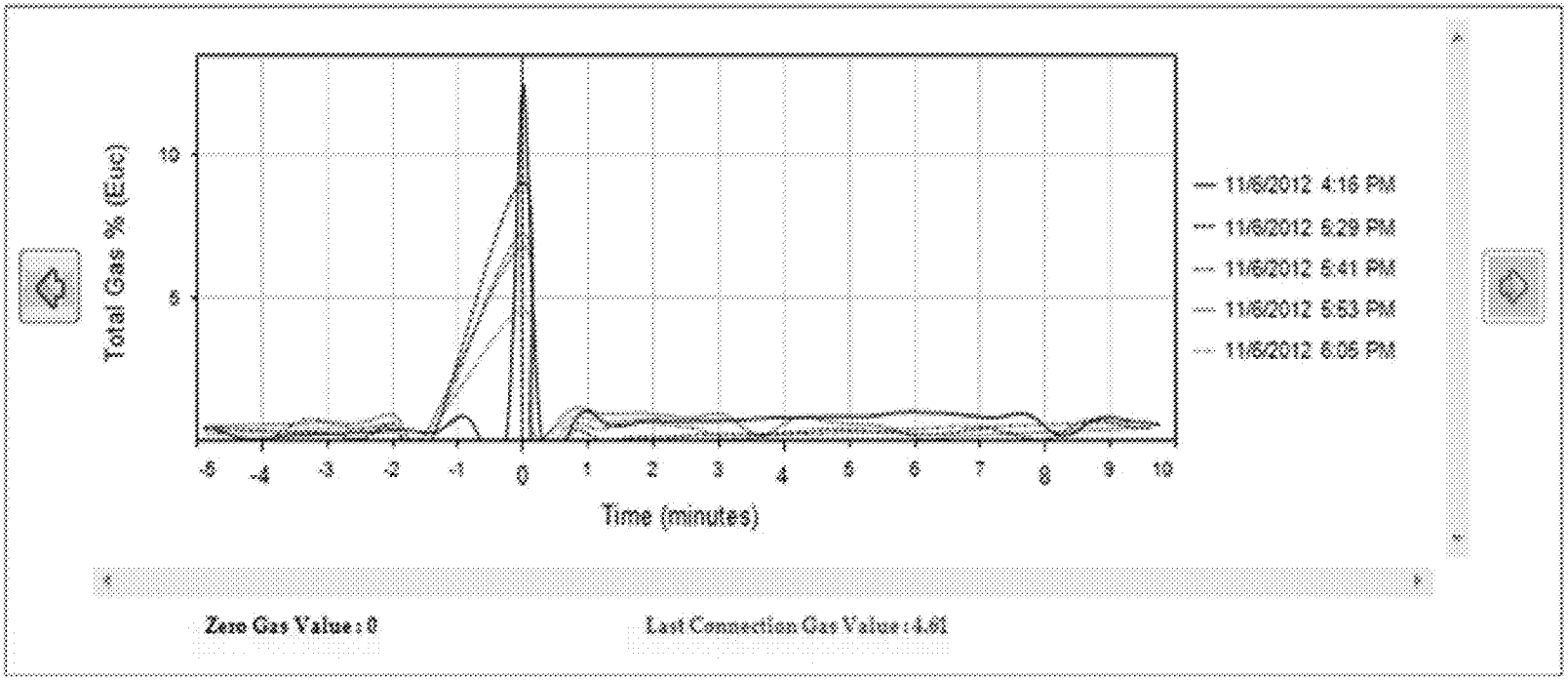
FIG. 66 shows a display produced by the Gas Monitor Widget.

FIG. 66 shows an example of a visual display provided by the Gas Monitor Widget, which monitors the surface gas response that may be associated with connection events or when the pumps are switched off. The widget allows pumps with switched-off activities to be visualized in historical and real-time views. In the embodiment shown, the display is two-dimensional, with a horizontal scale of equivalent time, and a vertical scale of true total gas. The total gas volume versus time for the latest and several preceding connections of pump on/off events can be plotted (FIG. 66 shows the latest and the four previous events). In one embodiment, plotting begins five minutes (by default, although another time period may be chosen) before the fluid interface event reaches the surface (at time "0") and continues for ten minutes after (by default, although another time period may be chosen).

Figure 67A:
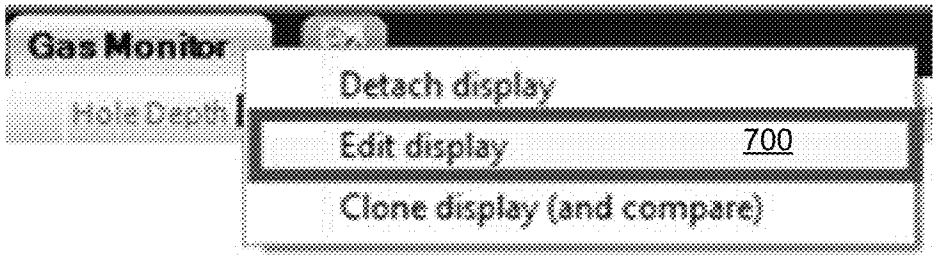
FIG. 67A shows an example of a "edit display" menu.
Figure 67B:
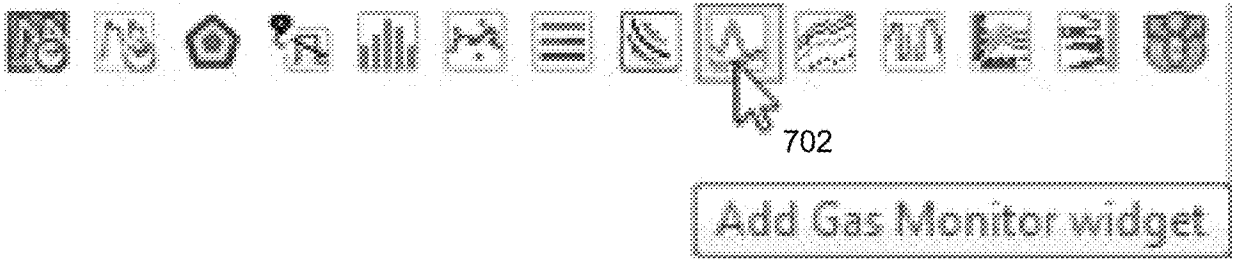
FIG. 67B shows a row of design mode icons.
Figure 68:
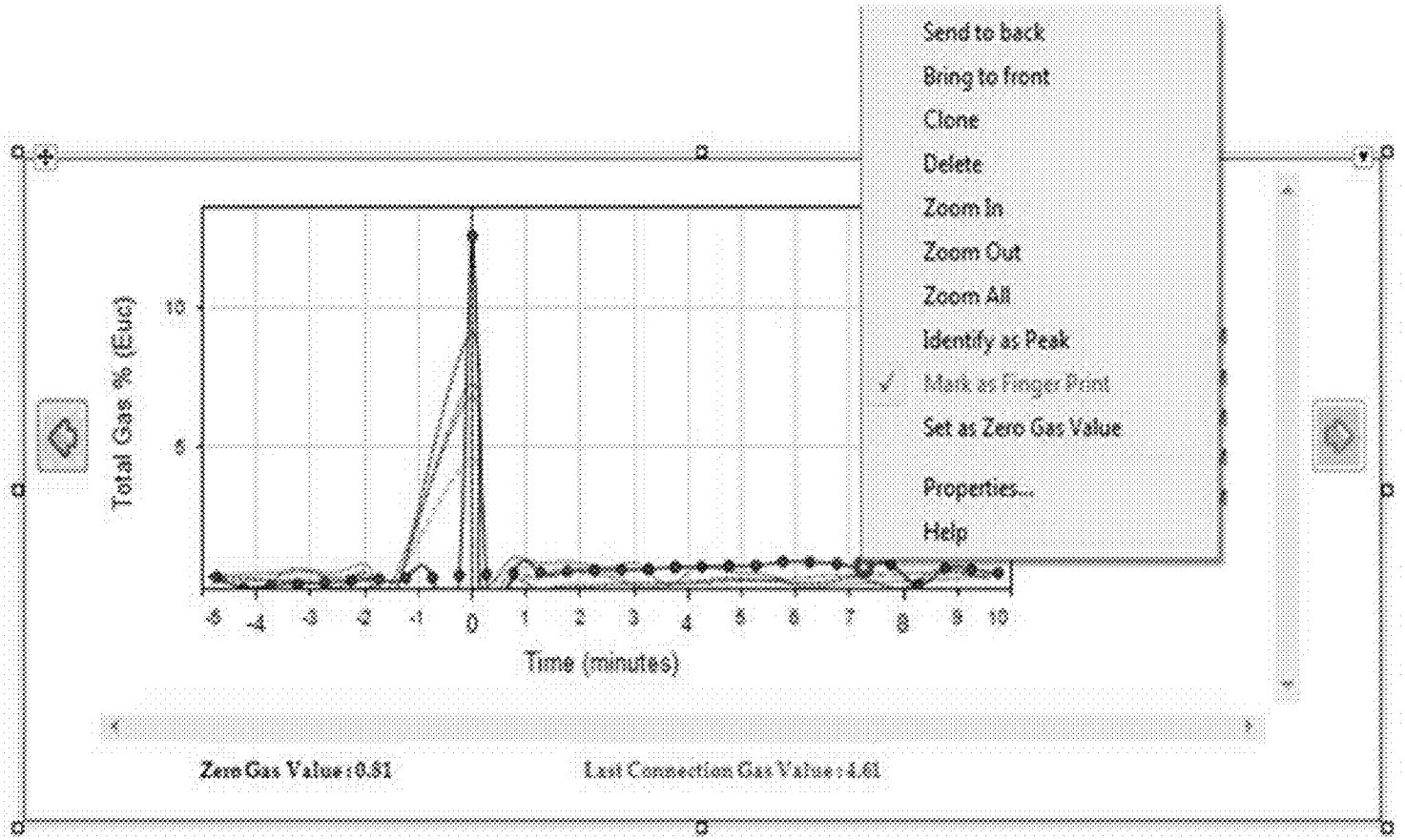
FIG. 68 shows an editable form of the Gas Monitor Widget display.
Figure 69:
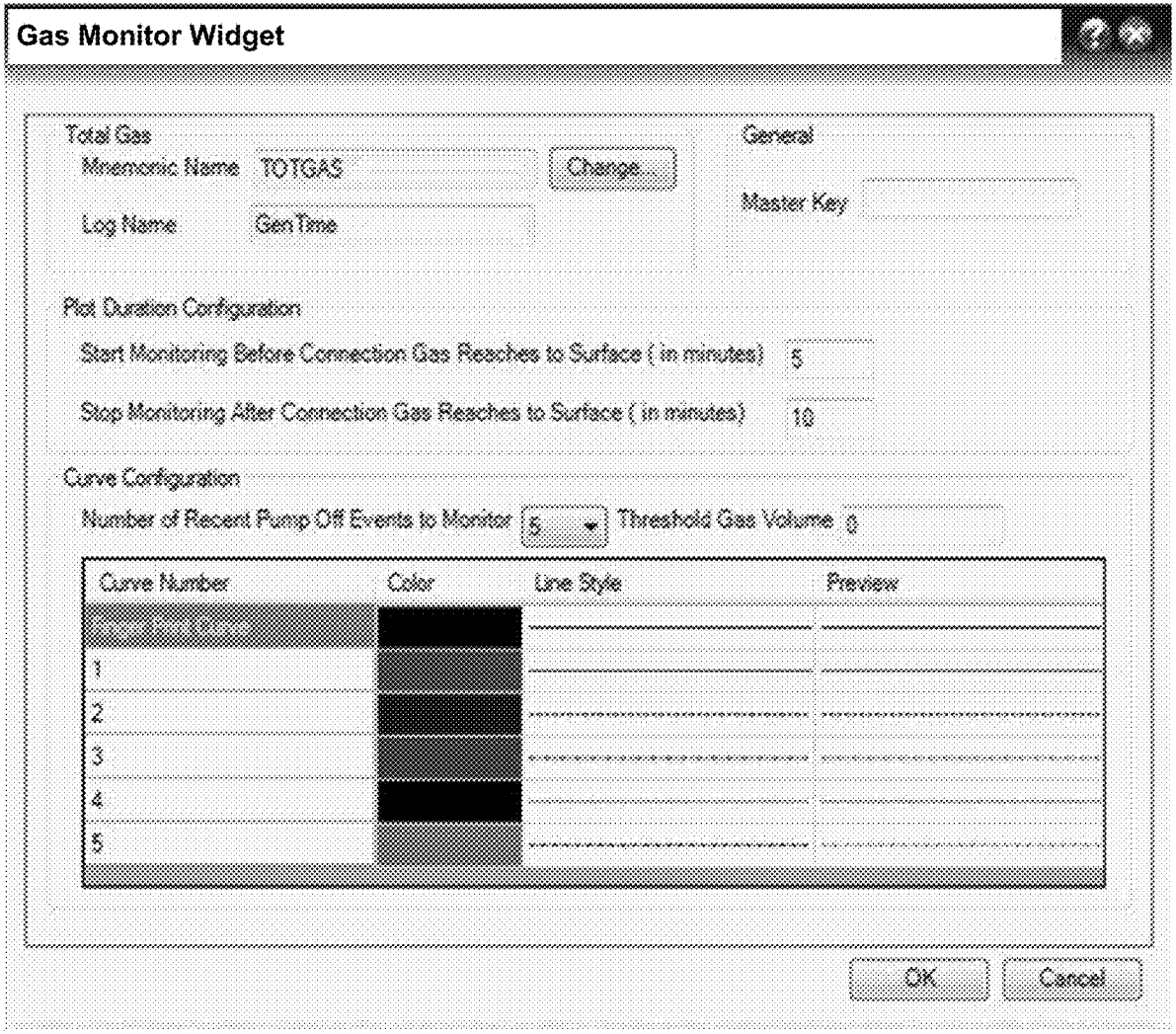
FIG. 69 shows a Gas Monitor Widget properties settings screen.

In one embodiment, the Gas Monitor Widget may be configured through the Properties dialog, which may be accessed by right-clicking on the display tab and selecting "Edit display," 700 as seen in FIG. 67A. A row of design mode icons is presented, and the user can then select the Gas Monitor Widget icon 702, as seen in FIG. 67B. This causes an editable form of the widget to appear (in the embodiment shown in FIG. 68, a red line appears around the widget display, indicating it can be edited). Right-clicking in the widget and selecting "Properties" in the menu displays the widget settings dialog window, as seen in FIG. 69.

Figure 70:
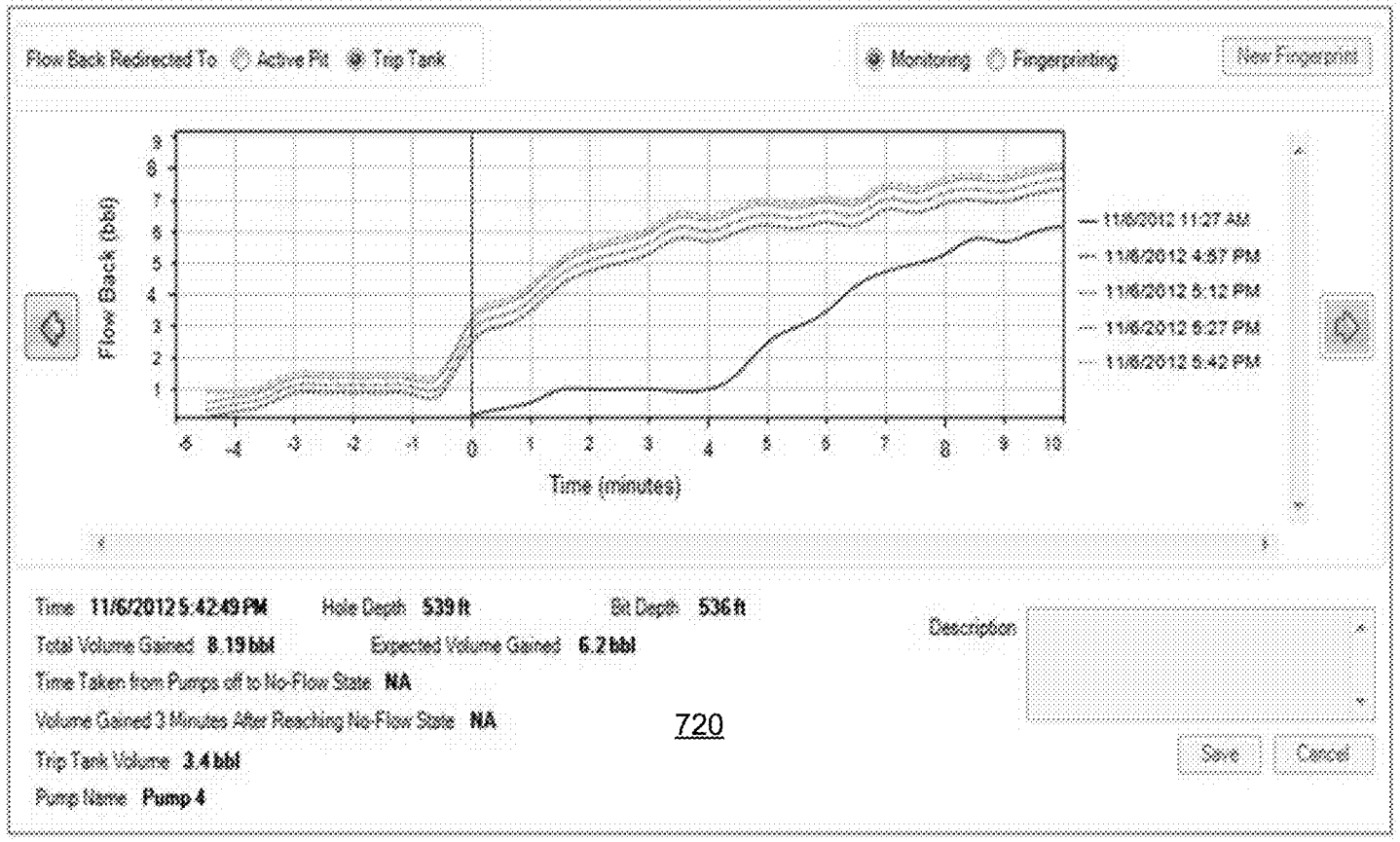
FIG. 70 shows a display produced by the Flow Back Widget.

FIG. 70 shows an example of a visual display provided by the Flow Back Widget, which visually represents the time-based horizontal log plotting of total mud flow back volume during connection events and when mud pumps are shut off. In the embodiment shown, the chart displays curves for flow back volume versus time. As with the Gas Monitor Widget, the curves for the latest and several preceding events can be plotted, and plotting may begin five minutes (or other selected time) before the event and continues for ten minutes (or other selected time) after the event.

As seen in FIG. 70, the display also comprises a text readout 720 comprising details about a particular plotted curve (the latest curve, by default, although other curves can be chosen). These details include, but are not limited to, time, hole depth, bit depth, total volume gained, expected volume game, time taken from pumps off to a "no-flow" state, volume gained three minutes after reaching the no-flow state, trip tank volume (or active pit volume), pump name, and a description of the curve.

The display contains an indication of where the flow back is redirected to. This indicates the current status of the mud flow, i.e., whether it is redirected to the "active pit" or to the "trip tank." This information is initially obtained from the latest pump off events in the system, but the user also can choose either option. Based on the selection, the active pit or trip tank curves will be plotted in the chart. Changes in this option are saved in a log file, and will be used as input for a marker info tracker smart agent.

In one embodiment, there are two different modes of display that can be selected: monitoring mode, and fingerprinting mode. The monitoring mode is the default. In monitoring mode, both historic and real-time curves are plotted. The first historic curve will be marked as the default fingerprinted curve in the case there is no SPA-defined fingerprint curve or aggregated fingerprint curve. The fingerprinting mode renders only real-time curves for only one active pump. The user is prompted to confirm or select the active pump before the curves are plotted. The user can click the "New Fingerprint" button to render the real-time curves for different active pumps.

The navigation buttons are used to navigate between the curves rendered in the chart. In one embodiment, the navigation buttons are enabled only when the current curve count is greater than the number of recent pump off events to be monitored entered as an option through the properties dialog. The "Previous" button causes the widget to render the curve for the previous pump off event, while the "Next" button causes the widget to render the curve for the next pump off event.

Figure 71A:
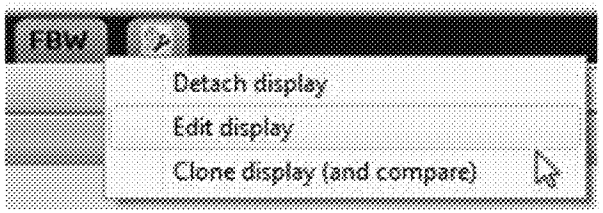
FIG. 71A shows an example of an "edit display" menu.
Figure 71B:
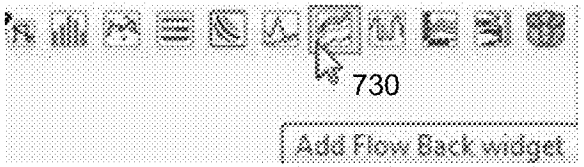
FIG. 71B shows a row of design mode icons.
Figure 71C:
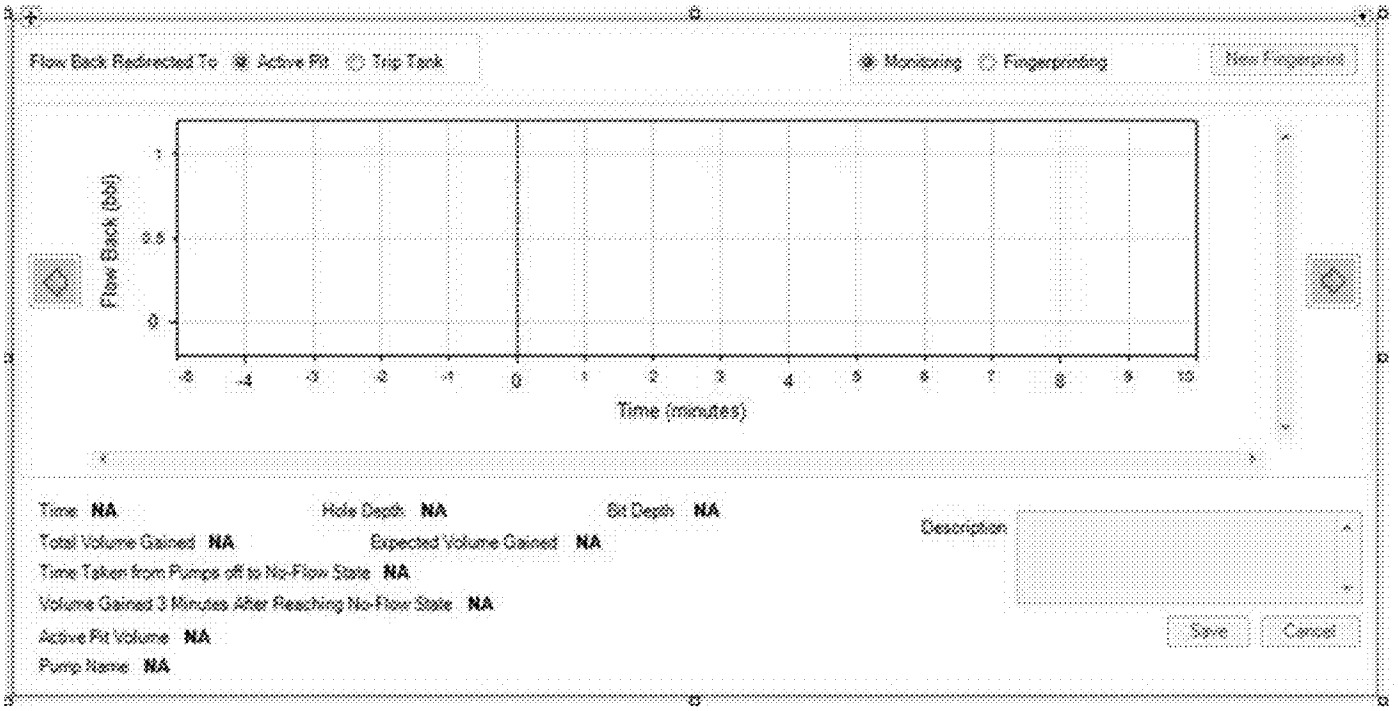
FIG. 71C shows an editable form of the Flow Back Widget display.
Figure 72:
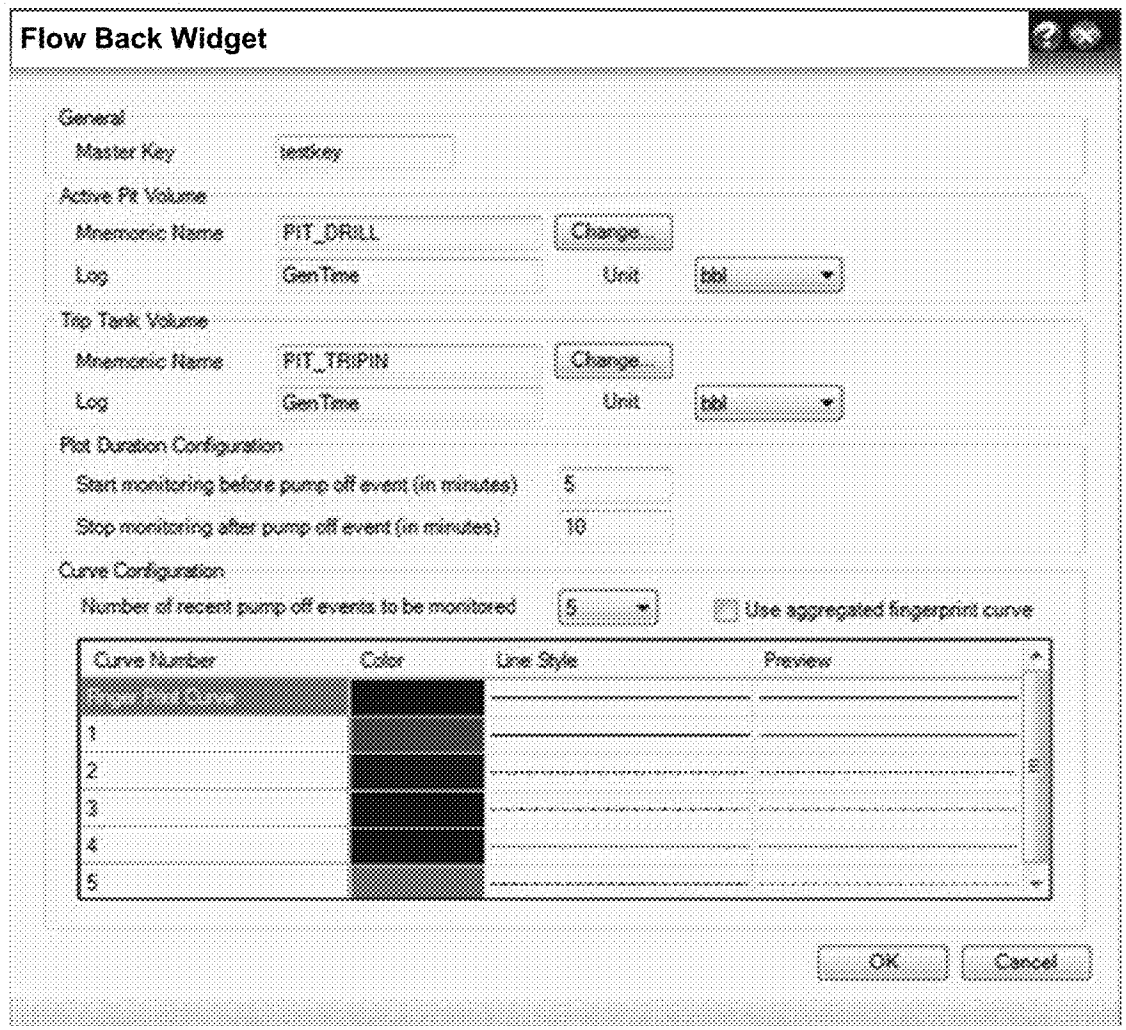
FIG. 72 shows a Flow Back Widget properties settings screen.

The Flow Back Widget may be configured through the Properties dialog in a similar manner to the Gas Monitor Widget (i.e., select "Edit display" and select the Flow Back Widget icon 730, as seen in FIGS. 71A and B). The editable form of the Flow Back Widget is shown in FIG. 71C. Selecting "Properties" from the menu displays the settings dialog window, as seen in FIG. 72.

Figure 73:
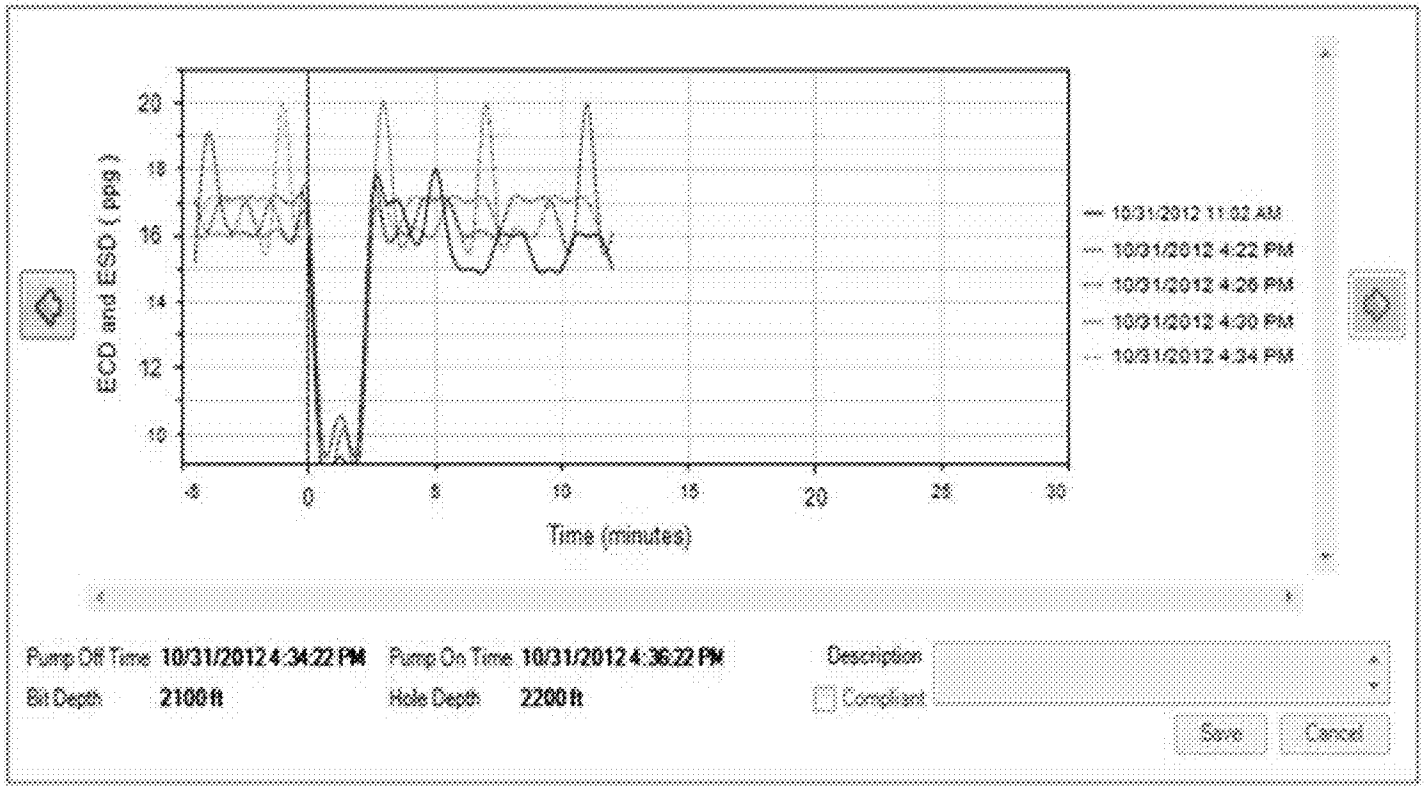
FIG. 73 shows a display produced by the Pressure While Drilling Widget.

FIG. 73 shows an example of a visual display provided by the Pressure While Drilling Widget. The display shows the time-based pressure response curves for Equivalent Circulating Density (ECD) and Equivalent Static Density (ESD) that result from switching the mud pumps from on to off then on again. This widget allows "switched off" and "switched on" pump activities to be visualized in historical and real-time views. In the embodiment shown, the display is two-dimensional, with a horizontal scale of equivalent time, and a vertical scale of true ECD/ESD. ECD and ESD versus time for the latest and several preceding connections of pump on/off events can be plotted (FIG. 73 shows the latest and the four previous events). In one embodiment, plotting begins five minutes (by default, although another time period may be chosen) before the fluid interface event reaches the surface (at time "0") and continues for ten minutes after (by default, although another time period may be chosen).

The display also comprises a text readout (or data view) comprising details about a particular plotted curve (the latest curve, by default, although other curves can be chosen). These details include, but are not limited to, pump off time, pump on time, bit depth, hole depth, compliancy indicator, and a description of the curve.

Figure 74A:
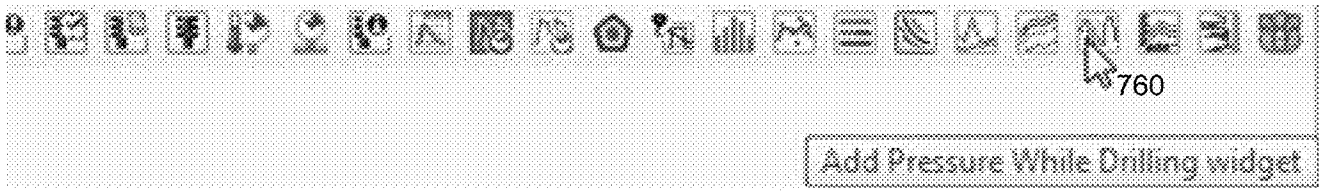
FIG. 74A shows a row of design mode icons.
Figure 74B:
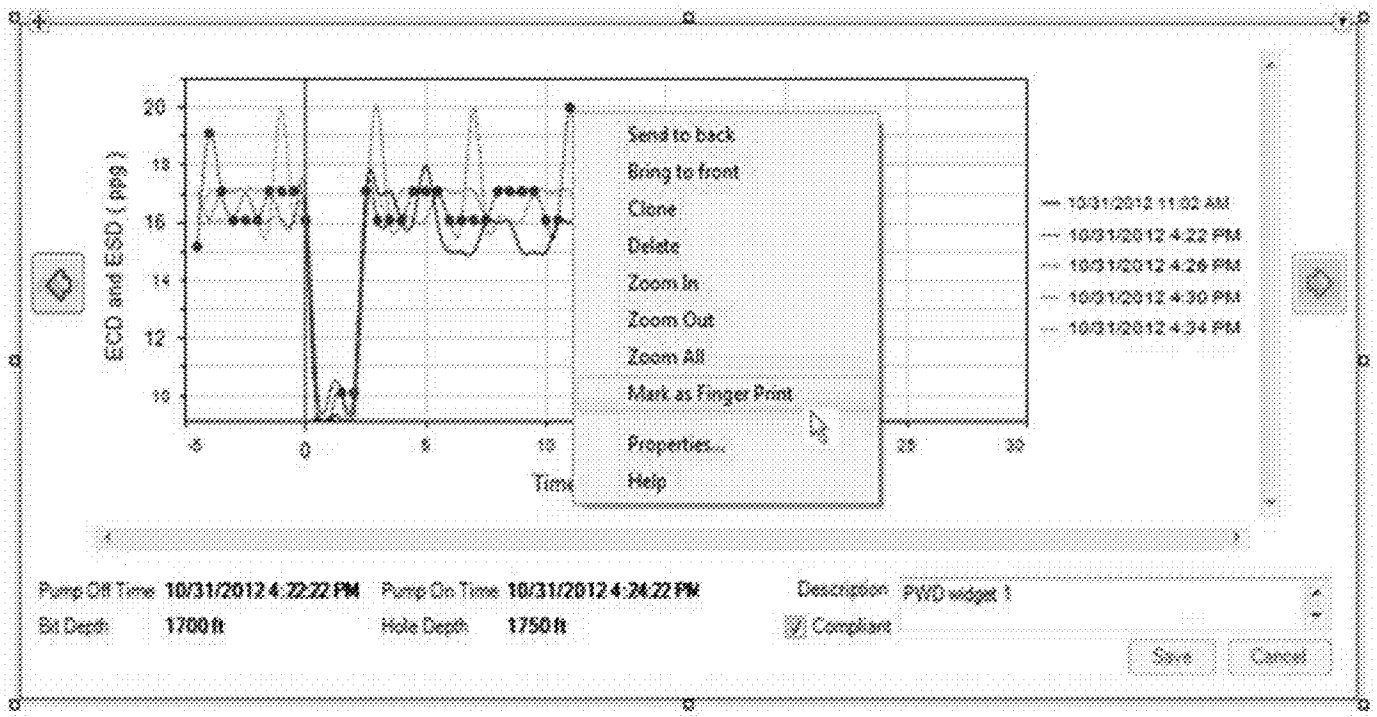
FIG. 74B shows an editable form of the Pressure While Drilling Widget display.
Figure 75:
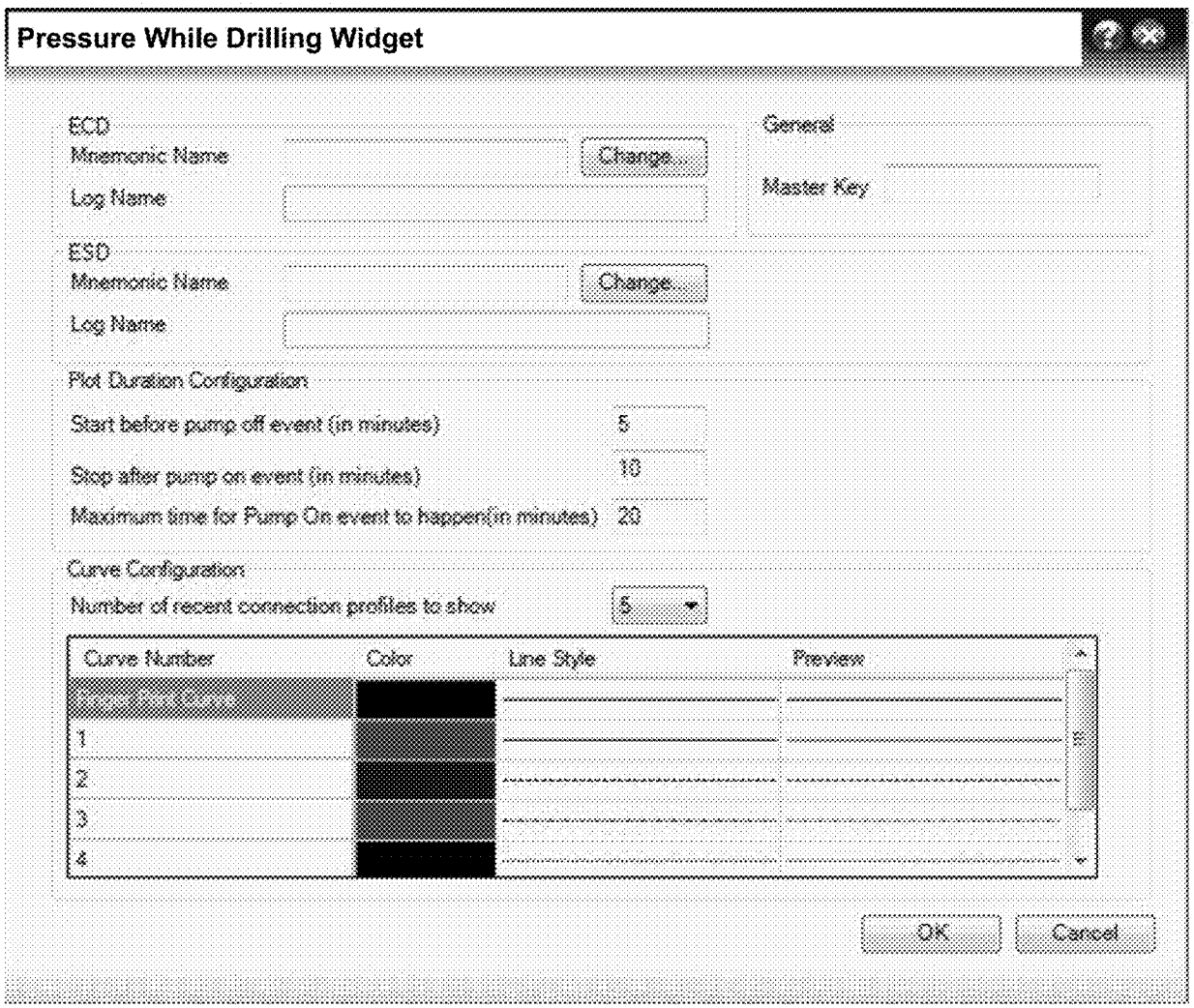
FIG. 75 shows a Pressure While Drilling Widget properties settings screen.

The Pressure While Drilling Widget may be configured through the Properties dialog in a similar manner to the Gas Monitor Widget (i.e., select "Edit display" and select the Pressure While Drilling icon 760, as seen in FIG. 74A). The editable form of the Pressure While Drilling Widget is shown in FIG. 74B. Selecting "Properties" from the menu displays the settings dialog window, as seen in FIG. 75.

Figure 76B:
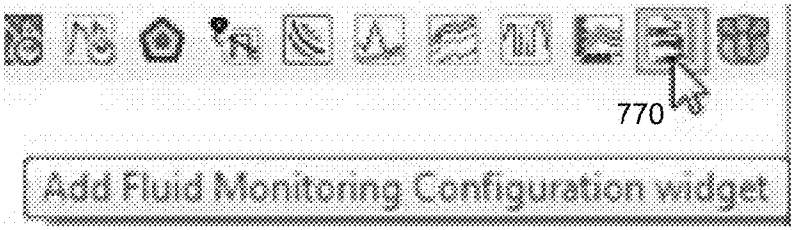
FIG. 76B shows a row of design mode icons.
Figure 76D:
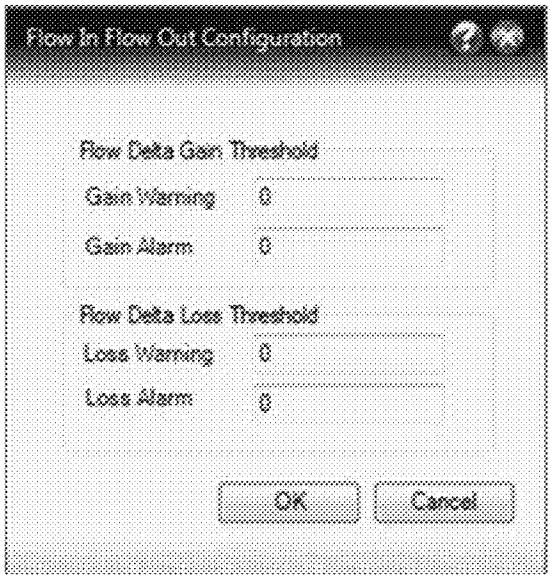
FIG. 76D shows a configuration window for warnings and alarms for the Flow In Flow Out Widget.
Figure 76A:
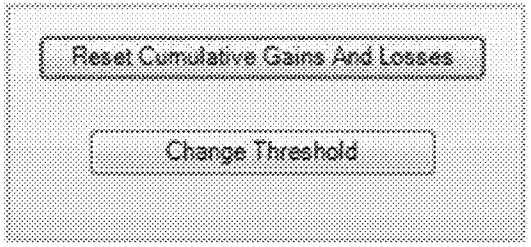
FIG. 76A shows an example of a Fluid Monitoring Configuration Widget display.
Figure 76C:
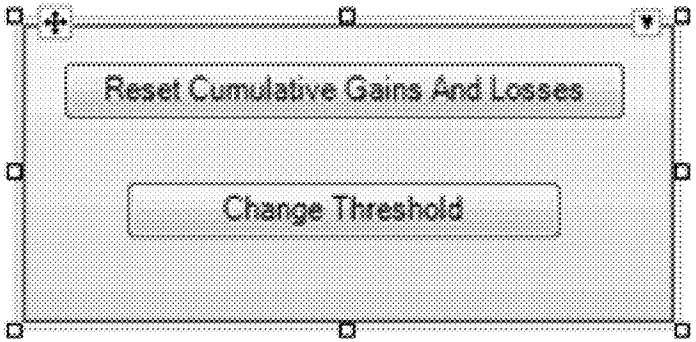
FIG. 76C shows an editable form of the Fluid Monitoring Configuration Widget display.

The Fluid Monitoring Configuration Widget, as seen in FIG. 76A, allows the user to configure the Flow In Flow Out (FIFO) Widget. The Fluid Monitoring Configuration Widget may be configured through the Properties dialog in a similar manner to the Gas Monitor Widget (i.e., select "Edit display" and select the Fluid Monitoring Configuration Widget icon 770, as seen in FIG. 76B). The editable form of the Fluid Monitoring Configuration Widget is shown in FIG. 76C. The top button allows the user to reset the cumulative gains and losses to zero. The "Change Threshold" button opens a configuration window (FIG. 76D) to specify threshold values for warnings and alarms that will appear in the Flow In Flow Out Widget.

The Pore Pressure Fracture Gradient (PPFG) LookAhead Widget is used during drilling phases to help monitor ECD, ESD, and Mud Weight, and compare them against pore pressure and fracture gradient values determined prior to drilling. There are several variations of real-time pore pressure measurements, including, but not limited to, pore pressure resistivity (PPRes), pore pressure dT (PPdT), pore pressure dTs (PPdTs), and pore pressure Dxc (PPdxc).

The PPFG LookAhead widget allows the user to monitor the gamma ray and/or rate of penetration, which can provide sand or shale formation visibility. The porosity of the formation can be determined by monitoring the resistivity, dT, dTs, and Dxc across the entire depth. Warnings and alarms are displayed when there is a risk of gain or loss in the real-time or lookahead regions.

Figure 77:
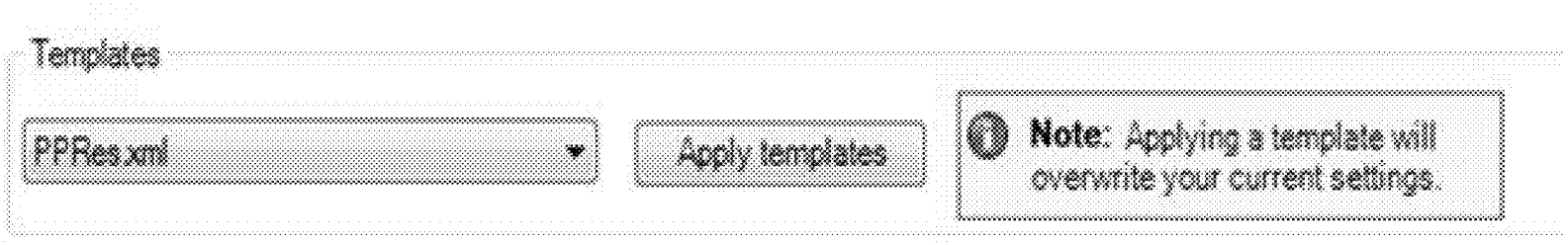
FIG. 77 shows an example of a template screen for the Pore Pressure Fracture Gradient LookAhead Widget.

In one embodiment, as seen in FIG. 77, the widget has five templates that can be imported from the Log Widget property page to display different tracks. These templates are "PPRes," "PPdT," "PPdTs," "PPdxc," and "PPFGCombo." Each has ten tracks, as follows:

A. PPRes

1. Track1—A curve track displaying the Gamma Ray.
2. Track 2—A lithology track displaying the sand or shale formation across the depth.
3. Track 3—A curve track displaying the Resistivity and Resistivity in Shale formation.
4. Track 4—A curve track displaying multiple curves which allow the user to monitor ECD, ESD and Mud Weight, and compare them against maximum Predrill Pore Pressure and/or minimum predrill Fracture Gradient and Real-time Pore Pressure for Resistivity. Curves displayed in this track are: Max Pore Pressure (Predrill); Min Pore Pressure (Predrill); Most likely Pore Pressure (Predrill); Fracture Gradient for Shale (Predrill); Fracture Gradient for Sand (Real-time); Fracture Gradient for Shale (Real-time); Fracture Gradient for Sand (Predrill); Pore Pressure Resistivity (Real-time); ECD (Real-time); ESD (Real-time); Mud weight (Real-time);
5. Track 5—A curve track displaying Total Gas Volume and the Flow In Temperature. The use also can configure any other curve.
6. Track 6—A status track displaying a warning or alarm when there is risk of gain. In one embodiment, the color red indicates an alarm, while yellow is the warning. Green means there is no risk.
7. Track 7—A status track, similar to Track 6, displaying a warning or alarm when there is risk of loss.
8. Track 8—A status track, similar to Track 6, displaying a warning or alarm when there is risk of gain in the look-ahead region.
9. Track 9—A status track, similar to Track 6, displaying a warning or alarm when there is risk of loss in the look-ahead region.
10. Track 10—A status track, similar to Track 6, displaying a warning or alarm when the real time resistivity is beyond a certain threshold applied on the expected resistivity.

B. PPdT

1. Track1—A curve track displaying the Gamma Ray.
2. Track 2—A lithology track displaying the sand or shale formation across the depth.
3. Track 3—A curve track displaying the dT and dT in Shale formation.
4. Track 4—A curve track displaying multiple curves which allow the user to monitor ECD, ESD and Mud Weight, and compare them against maximum Predrill Pore Pressure and/or minimum predrill Fracture Gradient and Real-time Pore Pressure for dT. Curves displayed in this track are: Max Pore Pressure (Predrill); Min Pore Pressure (Predrill); Most likely Pore Pressure (Predrill); Fracture Gradient for Shale (Predrill); Fracture Gradient for Sand (Real-time); Fracture Gradient for Shale (Real-time); Fracture Gradient for Sand (Predrill); Pore Pressure dT (Real-time); ECD (Real-time); ESD (Real-time); Mud weight (Real-time);
5. Track 5—A curve track displaying Total Gas Volume and the Flow In Temperature. The use also can configure any other curve.
6. Track 6—A status track displaying a warning or alarm when there is risk of gain. In one embodiment, the color red indicates an alarm, while yellow is the warning. Green means there is no risk.
7. Track 7—A status track, similar to Track 6, displaying a warning or alarm when there is risk of loss.
8. Track 8—A status track, similar to Track 6, displaying a warning or alarm when there is risk of gain in the look-ahead region.
9. Track 9—A status track, similar to Track 6, displaying a warning or alarm when there is risk of loss in the look-ahead region.
10. Track 10—A status track, similar to Track 6, displaying a warning or alarm when the real time dT is beyond a certain threshold applied on the expected dT.

C. PPdTs

1. Track1—A curve track displaying the Gamma Ray.
2. Track 2—A lithology track displaying the sand or shale formation across the depth.
3. Track 3—A curve track displaying the dTs and dTs in Shale formation.
4. Track 4—A curve track displaying multiple curves which allow the user to monitor ECD, ESD and Mud Weight, and compare them against maximum Predrill Pore Pressure and/or minimum predrill Fracture Gradient and Real-time Pore Pressure for dTs. Curves displayed in this track are: Max Pore Pressure (Predrill); Min Pore Pressure (Predrill); Most likely Pore Pressure (Predrill); Fracture Gradient for Shale (Predrill); Fracture Gradient for Sand (Real-time); Fracture Gradient for Shale (Real-time); Fracture Gradient for Sand (Predrill); Pore Pressure dTs (Real-time); ECD (Real-time); ESD (Real-time); Mud weight (Real-time);
5. Track 5—A curve track displaying Total Gas Volume and the Flow In Temperature. The use also can configure any other curve.
6. Track 6—A status track displaying a warning or alarm when there is risk of gain. In one embodiment, the color red indicates an alarm, while yellow is the warning. Green means there is no risk.
7. Track 7—A status track, similar to Track 6, displaying a warning or alarm when there is risk of loss.
8. Track 8—A status track, similar to Track 6, displaying a warning or alarm when there is risk of gain in the look-ahead region.

9. Track 9—A status track, similar to Track 6, displaying a warning or alarm when there is risk of loss in the look-ahead region.

10. Track 10—A status track, similar to Track 6, displaying a warning or alarm when the real time dTs is beyond a certain threshold applied on the expected dTs.

D. PPdxc

1. Track1—A curve track displaying the Gamma Ray.

2. Track 2—A lithology track displaying the sand or shale formation across the depth.

3. Track 3—A curve track displaying the dxc and dxc in Shale formation. Dxc may be calculated using the D-Exponent agent.

4. Track 4—A curve track displaying multiple curves which allow the user to monitor ECD, ESD and Mud Weight, and compare them against maximum Predrill Pore Pressure and/or minimum predrill Fracture Gradient and Real-time Pore Pressure for dxc. Curves displayed in this track are: Max Pore Pressure (Predrill); Min Pore Pressure (Predrill); Most likely Pore Pressure (Predrill); Fracture Gradient for Shale (Predrill); Fracture Gradient for Sand (Real-time); Fracture Gradient for Shale (Real-time); Fracture Gradient for Sand (Predrill); Pore Pressure dxc (Real-time); ECD (Real-time); ESD (Real-time); Mud weight (Real-time);

5. Track 5—A curve track displaying Total Gas Volume and the Flow In Temperature. The use also can configure any other curve.

6. Track 6—A status track displaying a warning or alarm when there is risk of gain. In one embodiment, the color red indicates an alarm, while yellow is the warning. Green means there is no risk.

7. Track 7—A status track, similar to Track 6, displaying a warning or alarm when there is risk of loss.

8. Track 8—A status track, similar to Track 6, displaying a warning or alarm when there is risk of gain in the look-ahead region.

9. Track 9—A status track, similar to Track 6, displaying a warning or alarm when there is risk of loss in the look-ahead region.

10. Track 10—A status track, similar to Track 6, displaying a warning or alarm when the real time dxc is beyond a certain threshold applied on the expected dxc.

E. PPFGCombo

1. Track1—A curve track displaying the Rate of Penetration (ROP).

2. Track 2—A lithology track displaying the sand or shale formation across the depth (based on ROP).

3. Track 3—A curve track displaying the resistivity, dT, dTs and dxc for the entire depth, and the same curves in the Shale formation region.

4. Track 4—A curve track displaying multiple curves which allow the user to monitor ECD, ESD and Mud Weight, and compare them against maximum Predrill Pore Pressure and/or minimum predrill Fracture Gradient and Real-time Pore Pressure for the specified parameters. Curves displayed in this track are: Max Pore Pressure (Predrill); Min Pore Pressure (Predrill); Most likely Pore Pressure (Predrill); Fracture Gradient for Shale (Predrill); Fracture Gradient for Sand (Real-time); Fracture Gradient for Shale (Real-time); Fracture Gradient for Sand (Predrill); Pore Pressure dxc (Real-time); Pore Pressure resistivity (Real-time); Pore Pressure dT (Real-time); Pore Pressure dTs (Real-time); ECD (Real-time); ESD (Real-time); Mud weight (Real-time);

5. Track 5—A curve track displaying Total Gas Volume and the Flow In Temperature. The use also can configure any other curve.

6. Track 6—A status track displaying a warning or alarm when there is risk of gain. In one embodiment, the color red indicates an alarm, while yellow is the warning. Green means there is no risk.

7. Track 7—A status track, similar to Track 6, displaying a warning or alarm when there is risk of loss.

8. Track 8—A status track, similar to Track 6, displaying a warning or alarm when there is risk of gain in the look-ahead region.

9. Track 9—A status track, similar to Track 6, displaying a warning or alarm when there is risk of loss in the look-ahead region.

10. Track 10—A status track, similar to Track 6, displaying a warning or alarm when the real time resistivity, dT, dTs and/or dxc is beyond a certain threshold applied on the expected resistivity, dT, dTs and/or dxc.

Figure 78:
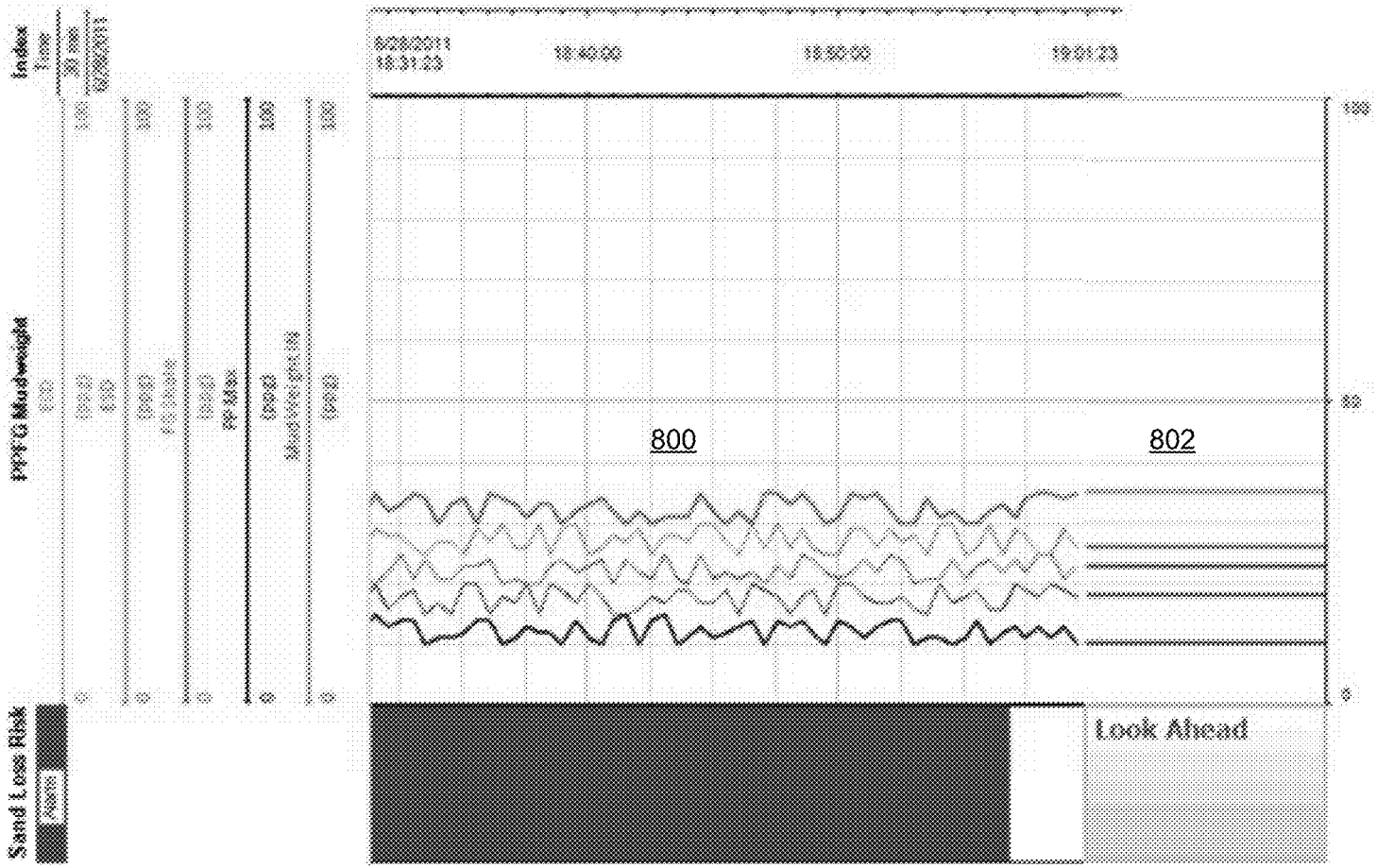
FIG. 78 shows an example of a PPFG Time Based Widget display.

When drilling is not taking place, the PPFG Time Based Widget is used to monitor mud density (e.g., ECD, ESD, and Mud Weight), and compare these values against maximum pore pressure (pre-drill determination), minimum fracture gradient for sand, and pore pressure resistivity. The PPFG Time Based Widget display, as seen in FIG. 78, combines a Log Widget display (on the left) 800 with the LookAhead Widget display 802. In one embodiment, the Log Widget uses a template for the tracks and curves.

The template shown has two horizontal tracks: a multiple curve track on top, and a status track on the bottom. The multiple curve track can display a number of curves based on real-time or pre-drill data, including, but not limited to, fracture gradient for sand, ECD, ESD, Mud Weight, Pore Pressure Resistivity, Minimum Pore Pressure, Maximum Pore Pressure, and Most Likely Pore Pressure. This track can be configured by modifying the template (e.g., PPFGtime-based.xml) in the Property page of the Log Widget. The status track displays a warning or alarm when there is a risk of loss.

The LookAhead portion of the display can be configured through the PPFG LookAhead Widget configuration (as described below). This section of the display allows the user to observe and monitor the maximum pore pressure and minimum fracture gradient in the LookAhead region, and compare it against the current real-time values for ECD, ESD and Mud Weight (which are expected to be within the maximum pore pressure and minimum fracture gradient value ranges).

Figure 79A:
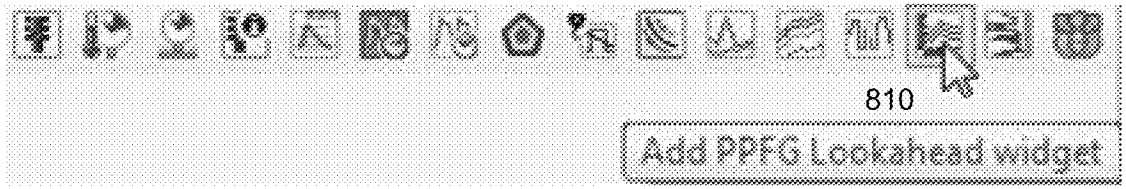
FIG. 79A shows a row of design mode icons.
Figure 79B:
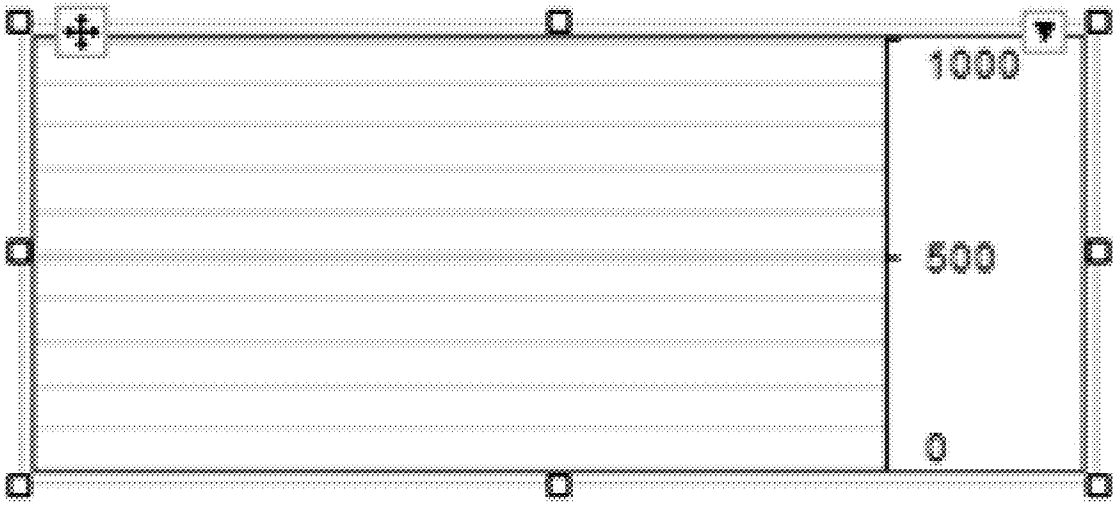
FIG. 79B shows an editable form of the PPFG LookAhead Widget display.
Figure 80:
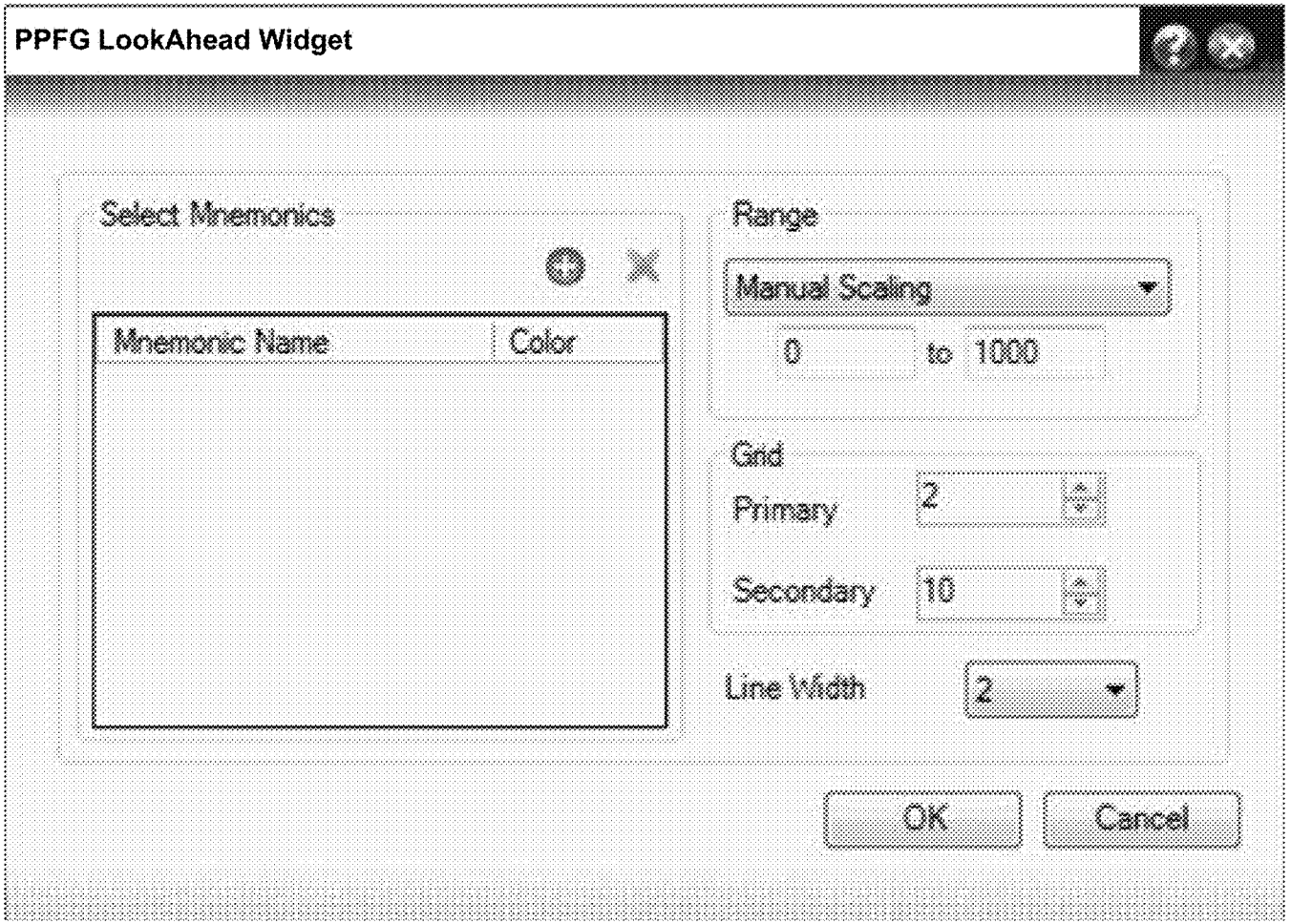
FIG. 80 shows a PPFG LookAhead Widget properties settings screen.

The PPFG LookAhead Widget may be configured through the Properties dialog in a similar manner to the Gas Monitor Widget (i.e., select "Edit display" and select the PPFG LookAhead Widget icon 810, as seen in FIG. 79A). The editable form of the PPFG LookAhead Widget is shown in FIG. 79B. Selecting "Properties" from the menu displays the settings dialog window, as seen in FIG. 80.

Figure 81A:
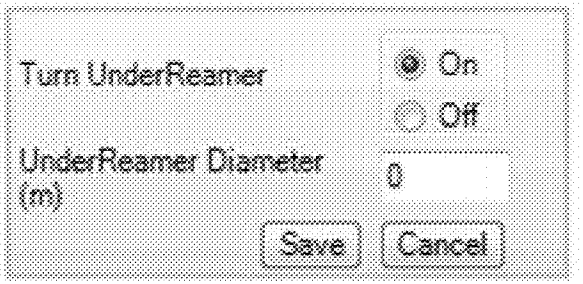
FIG. 81A shows an example of an UnderReaming Widget display.
Figure 81B:
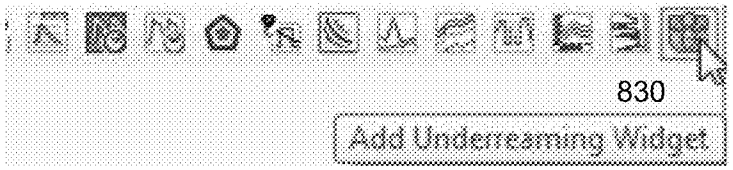
FIG. 81B shows a row of design mode icons.
Figure 81C:
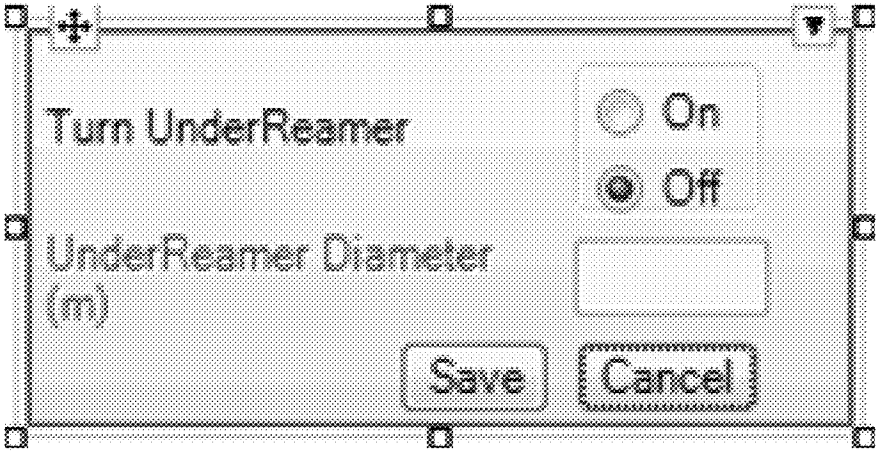
FIG. 81C shows an editable form of the UnderReaming Widget display.

The UnderReaming Widget, as seen in FIG. 81A, allows the user to turn the UnderReamer (used in conjunction with the 2D Wellbore Schematic Widget) on and off, and specify its diameter. Turning it on and changing its diameter has a direct impact on the Marker Tracker smart agent used to track the movement of markers in the 2D Wellbore Schematic Widget. Increasing its diameter increases the volume of mud at the bottom of the wellbore, thereby slowing down the markers. The UnderReaming Widget may be configured through the Properties dialog in a similar manner to the Gas Monitor Widget (i.e., select "Edit display" and select the UnderReaming Widget icon 830, as seen in FIG. 81B). The editable form of the UnderReaming Widget is shown in FIG. 81C.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A system for managing installation of casing or tubular goods at a well-site, comprising:

a string of casing or tubular goods adapted for installation in a wellbore;

a plurality of sensors to sample or detect parameters related to installation of casing or tubular goods in a well, said plurality of sensors comprising surface sensors or downhole sensors or a combination thereof, said plurality of sensors comprising a hookload sensor and a block height sensor;

one or more computing devices adapted to receive parameter information in real time from said plurality of sensors, said one or more computing devices each further comprising a processor or microprocessor, said processor or microprocessor adapted to process the received parameter information to calculate derived parameter information;

one or more software agents having one or more formulations applicable to said installation of casing or tubular goods, wherein said one or more software agents include a hookload signature agent, and said one or more formulations include analysis of hookload data and block height data;

at least one non-transitory computer-readable storage medium for storing some or all of said received parameter information and said derived parameter information; and a visual display, coupled to said one or more computing devices, for displaying some or all of the received parameter information and said derived parameter information for said installation of casing or tubular goods, wherein said visual display comprises:

a visual display of average trip time in and out during the installation of casing or tubular goods;

a hookload chart display comprising one or more hookload charts, each chart displaying a real-time hookload curve and a real-time block height curve for a particular run; and a drag chart display with multiple tracks including drag results curves, static drag curves, and hookload and block speed curves.

2. The system of claim 1, wherein the visual display of some or all of the received parameter information and said derived parameter information is in real time.

3. The system of claim 1, wherein said visual display further comprises event symbols placed in proximity to plot lines.

4. The system of claim 1, wherein said visual display comprises a geometric performance metric display of the current status of selected parameters based upon established threshold values.

5. The system of claim 4, wherein said geometric performance metric display comprises a polygon with vertices, each vertex representing a particular parameter, with threshold values normalized in scale for each parameter so that corresponding thresholds appear to be the same distance along a line between the center of the polygon and the respective vertex for each parameter;

further wherein the value of a particular parameter is plotted as a point along its respective line, and the plotted points of adjacent parameters are connected by a straight line to form a polygon of changing size and shape over time.

6. A system, comprising:

a string of casing or tubular goods adapted for installation in a wellbore;

a plurality of sensors to sample or detect parameters related to installation of casing or tubular goods in a well, said plurality of sensors comprising surface sensors or downhole sensors or a combination thereof, said plurality of sensors comprising a hookload sensor and a block height sensor; and a non-transitory computer-readable storage medium with an executable program stored thereon, wherein the program instructs a processor or microprocessor to perform the following steps:

receive parameter information related to the installation of casing or tubular goods in a well in real time from a plurality of sensors;

process the received parameter information to calculate derived parameter information, using one or more software agents having one or more formulations applicable to said installation of casing or tubular goods, wherein said one or more software agents include a hookload signature agent, and said one or more formulations include analysis of hookload data and block height data;

store some or all of the received parameter information and derived parameter information on a non-transitory computer-readable storage device; and display some or all of the received parameter information and said derived parameter information for said installation of casing or tubular goods, wherein said display step comprises display of:

a visual display of average trip time in and out during the installation of casing or tubular goods;

a hookload chart display comprising one or more hookload charts, each chart displaying a real-time hookload curve and a real-time block height curve for a particular run; and a drag chart display with multiple tracks including drag results curves, static drag curves, and hookload and block speed curves.

7. The system of claim 6, wherein the display of some or all of the received parameter information and said derived parameter information is in real time.

8. The system of claim 6, wherein said display further comprises event symbols placed in proximity to plot lines.

9. The system of claim 6, wherein said display comprises a geometric performance metric display of the current status of selected parameters based upon established threshold values.

10. A method of managing installation of casing or tubular goods at a well site, comprising the steps of:

installing a string of casing or tubular goods in a wellbore;

receiving in real time, using a processor or microprocessor, parameter information related to installation of said casing or tubular goods in a well from a plurality of sensors, said plurality of sensors comprising a hookload sensor and a block height sensor;

processing, using a processor or microprocessor, the received parameter information to calculate derived parameter information, using one or more software agents having one or more formulations applicable to said installation of casing or tubular goods, wherein said one or more software agents include a hookload signature agent, and said one or more formulations include analysis of hookload data and block height data;

storing the received parameter information and derived parameter information on a non-transitory computer-readable storage device; and displaying, on a visual display, some or all of the received parameter information and said derived parameter information for said installation of casing or tubular goods, wherein said step of displaying comprises displaying:

a visual display of average trip time in and out during the installation of casing or tubular goods;

a hookload chart display comprising one or more hookload charts, each chart displaying a real-time hookload curve and a real-time block height curve for a particular run; and a drag chart display with multiple tracks including drag results curves, static drag curves, and hookload and block speed curves.

11. The method of claim 10, wherein the visual display of some or all of the received parameter information and said derived parameter information is in real time.

12. The method of claim 10, wherein said visual display further comprises event symbols placed in proximity to plot lines.

13. The method of claim 10, wherein said visual display comprises a geometric performance metric display of the current status of selected parameters based upon established threshold values.

* * * * *